US007150963B2

(12) United States Patent
Watanabe et al.

(10) Patent No.: US 7,150,963 B2
(45) Date of Patent: Dec. 19, 2006

(54) SILVER HALIDE EMULSION, SILVER HALIDE PHOTOSENSITIVE MATERIAL, AND PHOTOTHERMOGRAPHIC MATERIAL

(75) Inventors: Katsuyuki Watanabe, Kanagawa (JP); Hideo Hanawa, Kanagawa (JP); Takeshi Funakubo, Kanagawa (JP)

(73) Assignee: Fuji Photo Film Co., Ltd., Tokyo (JP)

( * ) Notice: Subject to any disclaimer, the term of this patent is extended or adjusted under 35 U.S.C. 154(b) by 0 days.

(21) Appl. No.: 10/936,559

(22) Filed: Sep. 9, 2004

(65) Prior Publication Data

US 2005/0058956 A1 Mar. 17, 2005

(30) Foreign Application Priority Data

Sep. 11, 2003 (JP) ..... 2003-319622

(51) Int. Cl.
*G03C 1/005* (2006.01)
*G03C 1/494* (2006.01)
*G03C 1/06* (2006.01)

(52) U.S. Cl. ..... 430/567; 430/599; 430/600; 430/603; 430/607; 430/611; 430/613

(58) Field of Classification Search ..... 430/567, 430/599, 600, 603, 607, 611, 613
See application file for complete search history.

(56) References Cited

U.S. PATENT DOCUMENTS

| | | | | |
|---|---|---|---|---|
| 2004/0131983 | A1* | 7/2004 | Ohzeki et al. | 430/619 |
| 2004/0137389 | A1* | 7/2004 | Fukui et al. | 430/619 |
| 2004/0202971 | A1* | 10/2004 | Sasaki et al. | 430/613 |
| 2005/0069827 | A1* | 3/2005 | Nariyuki et al. | 430/619 |
| 2005/0074707 | A1* | 4/2005 | Yamane et al. | 430/348 |
| 2005/0079457 | A1* | 4/2005 | Naruyuki | 430/619 |

FOREIGN PATENT DOCUMENTS

EP 1308776 A2 5/2003

* cited by examiner

*Primary Examiner*—Geraldine Letscher
(74) *Attorney, Agent, or Firm*—Margaret A. Burke; Sheldon J. Moss

(57) ABSTRACT

A silver halide emulsion containing a compound represented by the following formula (1) or (2):

Formula (1)

Formula (2)

wherein $R_1$ represents an OH group, an SH group, or an —$NR_2R_3$ group in which $R_2$ and $R_3$ each independently represent a hydrogen atom, an alkyl group, an aryl group, a heterocyclic group, an alkylsulfonyl group, or an arylsulfonyl group; L represents an alkenylene group, an arylene group, an —N═N— group, a divalent aromatic heterocyclic group, or a —$C(R_4)$═N— group in which $R_4$ represents a hydrogen atom, an alkyl group, an aryl group, or a heterocyclic group; n represents 0 or 1; X and Y each independently represent a nitrogen atom or a —$CR_5$— group in which $R_5$ represents a hydrogen atom or a substituent bondable to the carbon atom; Z represents an atomic group in the 5- to 7-membered ring; and M represents a hydrogen atom, a metal ion, or a quaternary ammonium ion.

19 Claims, No Drawings

SILVER HALIDE EMULSION, SILVER HALIDE PHOTOSENSITIVE MATERIAL, AND PHOTOTHERMOGRAPHIC MATERIAL

CROSS-REFERENCE TO RELATED APPLICATION

This application claims priority under 35 USC 119 from Japanese patent Application No. 2003-319622, the disclosure of which is incorporated by reference herein.

BACKGROUND OF THE INVENTION

1. Field of the Invention

The present invention relates to a highly sensitive silver halide emulsion, a silver halide photosensitive material, and a photothermographic material, and particularly to a highly sensitive silver halide emulsion using silver halide grains having a high silver iodide content, a silver halide photosensitive material, and a photothermographic material.

2. Description of the Related Art

In recent years, there have been needs for dry development of photographs in the fields of medical diagnoses and printings from the viewpoints of environmental preservation and space saving. Digitalization has progressed in those fields. In a system, image information is input into a computer, stored in the computor, then modified if necessary; a laser image setter or a laser imager at a place where the image is needed accesses the image information through communication, output the image information onto a photosensitive material; the photosensitive material is developed to provide an image on the spot. Such a system is rapidly becoming popular. The photosensitive material needs to be a material on which the image information can be recorded by laser exposure with a high illuminance and on which a clear black image with high resolution and sharpness can be formed. Examples of such digital imaging recording devices are various hard copy systems using pigment or dye such as inkjet printers and electrophotographic devices. The systems have been used as conventional image formation system. However, the systems are not satisfactory in image quality (sharpness, graininess, gradation and color tone), which is important when the system is used to provide medical images, and a recording speed (sensitivity). Therefore, the systems has not been developed to such a degree that they can be used in place of conventional wet-developing silver salt films for medical use.

A heat image-forming system using an organic silver salt has been known. The system uses an image-forming layer in which a reducible silver salt such as organic silver salt, a photosensitive silver halide, and an optional toning agent for controlling color tone of silver are dispersed in the binder matrix.

When a photothermographic material is image-wise exposed and heated to a high temperature (e.g. 80° C. or higher), a black silver image is formed by a redox reaction between a reducing agent and the silver halide or a reducible silver salt that acts as an oxidizing agent. The redox reaction is accelerated by catalysis of the silver halide latent image formed by the exposure, and the black silver image is formed in the exposed region. The photothermographic material has been disclosed in literature, and Fuji Medical Dry Laser Imager FM-DPL started to be sold as a practical system for medical image formation.

Because the image-forming system using an organic silver salt does not have a fixing process, the silver halide remains in the film even after the heat development. The system has two major problems.

One of the problems is that a heat-developed image does not have good storability. Particularly, printout of the image is deteriorated by light. Methods of using silver iodide are known as techniques by which the printout can be improved. The silver iodide causes little printout compared with silver bromide or silver iodobromide with an iodide content of 5 mol % or less. Therefore, there is a possibility that silver iodide can solve the problem. However, since known silver iodide grains have very low sensitivity and cannot be used practically in photothermographic systems. Further, when the silver iodide grains are treated so that the recombination of photoelectrons and positive holes is prevented in order to increase the sensitivity, the excellent printout property is lost.

As described in academic literature, the sensitivity of a silver iodide emulsion can be increased by soaking the silver iodide in an aqueous solution of silver nitrate or a halogen acceptor such as sodium nitrite, pyrogallol, or hydroquinone. The sensitivity can be improved also by sulfur sensitization at a pAg of 7.5. However, the sensitizing effect of the halogen acceptor is subtle and insufficient when used in photothermographic materials.

Compounds having a reducing group and an adsorbent group which adsorbs silver halides as independent groups are disclosed in EP 1308776 A2, etc. as sensitizers for silver halides. However, the compounds cannot provide sufficient sensitivity either, and there are other problems in other properties for practical use.

The other problem is that light scattering by the silver halides remaining in the image-forming system clouds the film, so that the film becomes translucent or opaque and lowers the image quality. To prevent the clouding and solve the problem, as a practical method, fine photosensitive silver halide grains having sizes of 0.08 to 0.15 μm are used and the amount of the fine grains is minimized. However, by this method, the sensitivity is further reduced, the clouding cannot be completely prevented, and the film is hazed by the clouding.

When wet-development is conducted, the material is treated with a fixing solution containing a solvent for silver halides after the development so that the remaining silver halides are removed. Various inorganic or organic compounds capable of forming a complex with a silver ion are known as the solvent for the silver halides.

It has been attempted to apply the fixing process to dry heat-development. For example, it was proposed to add a compound capable of forming a complex with a silver ion to the film so that the silver halides are solubilized (generally referred to as fixing) during the heat-development. However, the method is for silver bromide or silver chlorobromide. Since the method comprises post-heating for fixing at a temperature as high as 155 to 160° C., it is not convenient. Further proposed is a method comprising preparing a fixing sheet containing a compound capable of forming a complex with a silver ion; heat-developing a photothermographic material to form an image; overlapping the photothermographic material on the fixing sheet; and heating them to dissolve and remove the remaining silver halides. However, since the method uses 2 sheets, processes are complicated. The method is practically disadvantageous because it is difficult to maintain the operation stability and waste of the fixing sheet is caused.

In addition to the above methods, a method comprising enclosing a fixing agent for the silver halides in microcapsules and releasing the fixing agent during the heat development is proposed as a fixing method for heat-development. However, in the method, it is difficult to release the fixing agent effectively. A method of using a fixing solution after the heat development is also proposed. However, this method requires a wet process and is not suitable for a completely dry process.

As described above, the known methods for reducing the clouding have many disadvantages, and it is difficult to put the methods into practical use.

It is proposed to use the photothermographic materials as photosensitive materials for photography. When the photosensitive materials for photography is used, an image is recorded on the materials not by scanning exposure of laser or the like based on the image information but by surface exposure. The wet-developing type photosensitive materials have been commonly used as the photosensitive materials for photography such as medical films including direct or indirect X-ray films and mammography films, films for making printing plates, industrial recording films, and photographic films for common cameras. For example, double-sided X-ray photothermographic materials using blue fluorescent screens, photothermographic materials using tabular silver iodobromide grains, and medical photosensitive materials prepared by coating both sides of supports with tabular grains having a high silver chloride content and a major face of (100) are disclosed in patent documents. Further, double-sided photothermographic materials are disclosed also in other patent documents. However, when fine silver halide grains with sizes of 0.1 μm or less are used in known materials, the sensitivity is too low to be used practical photography although the grains do not haze the materials. On the other hand, when silver halide grains with sizes of 0.3 μm or more are used in known materials, the remaining grains haze the materials and deteriorate the printout properties, so that the quality of the formed image is insufficient for practical use.

Wet-developing type photosensitive materials using tabular silver iodide grains is known. However, application of the tabular silver iodide grains to photothermographic materials has not been known. That is because the sensitivity is low as described above, and because methods for effectively sensitizing the grains are not known, and it is technically more difficult to use the grains in the heat-development.

To use a photothermographic material as the photosensitive material for photography, the photothermographic material has to have higher sensitivity and capability to form an image with higher quality including haze.

SUMMARY OF THE INVENTION

An object of the present invention is to provide a highly sensitive silver halide emulsion, a highly sensitive silver halide photosensitive material, and a highly sensitive photothermographic material.

A first aspect of the invention is to provide a silver halide emulsion comprising a compound represented by the following formula (1) or (2).

Formula (1)

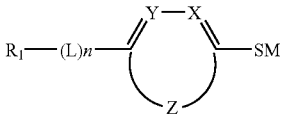

Formula (2)

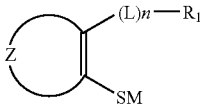

In the formulae (1) and formula (2), $R_1$ represents an OH group, an SH group, or an —$NR_2R_3$ group ($R_2$ and $R_3$ each independently representing a hydrogen atom, an alkyl group, an aryl group, a heterocyclic group, an alkylsulfonyl group, or an arylsulfonyl group); L represents an alkenylene group, an arylene group, an —N═N— group, a —$C(R_4)$═N— group ($R_4$ representing a hydrogen atom, an alkyl group, an aryl group, or a heterocyclic group), or a divalent aromatic heterocyclic group; n represents 0 or 1; X and Y each independently represent a nitrogen atom or a —$CR_5$— group ($R_5$ representing a hydrogen atom or a substituent that can be bonded to the carbon atom); Z represents an atomic group that can be the part of the ring in the formula (1) or the formula (2), which is a 5- to 7-membered ring; and M represents a hydrogen atom, a metal ion, or a quaternary ammonium ion.

A second aspect of the invention is to provide a silver halide photosensitive material comprising a support and a silver halide emulsion provided on at least one surface of the support, wherein the silver halide emulsion comprises a silver halide and a compound represented by the formula (1) or (2).

A third aspect of the invention is to provide a photothermographic material comprising a support and an image-forming layer provided on at least one surface of the support, wherein the image-forming layer comprises a non-photosensitive organic silver salt, a reducing agent for silver ions, a binder, and a silver halide emulsion, and the silver halide emulsion comprises a silver halide and a compound represented by the formula (1) or (2).

The compound represented by the formula (1) is preferably a compound represented by the following formula (1-a).

Formula (1-a)

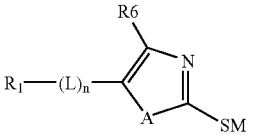

In the formula (1-a), $R_1$ represents an OH group, an SH group, or an $NR_2R_3$ group ($R_2$ and $R_3$ each independently representing a hydrogen atom, an alkyl group, an aryl group, a heterocyclic group, an alkylsulfonyl group, or an arylsulfonyl group); L represents an alkenylene group, an arylene group, an —N═N— group, a —$C(R_4)$═N— group ($R_4$ representing a hydrogen atom, an alkyl group, an aryl group, or a heterocyclic group), or a divalent aromatic heterocyclic group; n represents 0 or 1; R6 represents a hydrogen atom or a substituent bondable to the carbon atom; A represents a sulfur atom or an —$NR_7$— group ($R_7$ representing a hydrogen atom, an alkyl group, an aryl group, or a heterocyclic group); and M represents a hydrogen atom, a metal ion, or a quaternary ammonium ion.

The invention was made as a result of intensive search for new sensitizers for silver halide. Differing from the compounds described in EP1308776A2, the compound according to the invention has a group which adsorbs and reduces a silver halide. The compound according to the invention shows an unexpectedly high sensitizing effect and an unexpected effect of increasing the pressure resistance of the silver halide grains. Factors affecting the pressure resistance are not sufficiently understood even by a person in the art. It can be guessed that only a small amount of the compound recited in the invention can effectively enhance the pressure resistance because the adsorbent moiety and the reducing moiety are not separated.

DETAILED DESCRIPTION OF THE INVENTION

The present invention is described in detail below.

1. Photothermographic Material

The photothermographic material of the invention comprises a support and an image-forming layer disposed on at least one surface of the support; the image-forming layer comprises a photosensitive silver halide, a non-photosensitive organic silver salt, a reducing agent, a binder, and a sensitizer represented by the formula (1) or (2). The photothermographic material preferably comprises a surface protective layer on the image-forming layer. Also, the photothermographic material preferably comprises a back layer or a back protective layer or both on the surface of the support opposite to the image forming layer. The photothermographic material may have other layers.

The structures and the preferred components of the layers are described in detail below.

(Compound Represented by the Formula (1) or (2))

First, the compound represented by the formula (1) or (2) recited in the invention is described in detail.

Formula (1)

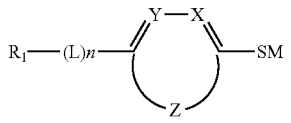

Formula (2)

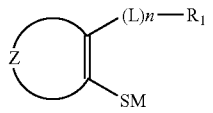

In the formulae (1) and (2), $R_1$ represents an OH group, an SH group, or an —$NR_2R_3$ group ($R_2$ and $R_3$ each independently representing a hydrogen atom, an alkyl group, an aryl group, a heterocyclic group, an alkylsulfonyl group, or an arylsulfonyl group); L represents an alkenylene group, an arylene group, an —N═N— group, a —$C(R_4)$═N— group ($R_4$ representing a hydrogen atom, an alkyl group, an aryl group, or a heterocyclic group), or a divalent aromatic heterocyclic group; n represents 0 or 1; X and Y each independently represent a nitrogen atom or a —$CR_5$— group ($R_5$ representing a hydrogen atom or a substituent that can be bonded to the carbon atom); Z represents an atomic group that can be the part of the ring in the formula (1) or formula (2), which is a 5- to 7-membered ring; and M represents a hydrogen atom, a metal ion, or a quaternary ammonium ion.

$R_2$ and $R_3$ each independently represent a hydrogen atom, an alky group, an aryl group, a heterocyclic group, an alkylsulfonyl group; or an arylsulfonyl group. The alkyl group is linear, branched, or cyclic. The alkyl group is substituted or unsubstituted. The alkyl group preferably has 1 to 30 carbon atoms and more preferably has 1 to 20 carbon atoms. For example, the alkyl group may be a methyl group, an ethyl group, an n-propyl group, an n-butyl group, an isobutyl group, an n-hexyl group, a cyclohexyl group, or a benzyl group. The aryl group is substituted or unsubstituted. The aryl group preferably has 6 to 30 carbon atoms and more preferably has 6 to 20 carbon atoms. For example, the aryl group may be a phenyl group or a naphtyl group. The heterocyclic group is aromatic or nonaromatic. The heterocyclic group is substituted or unsubstituted. The heterocyclic group has a 5- to 7-membered heterocycle. The heterocycle is a monocycle or a condensed ring. For example, the heterocyclic group may be a pyridine ring, a quinoline ring, an isoquinoline ring, a pyrrole ring, a furan ring, a thiophene ring, an imidazole ring, a thiazole ring, an oxazole ring, a triazole ring, a thiadiazole ring, a pyrimidine ring, a triazine ring, a benzothiazole ring, a pyridinium ring, or a purine ring.

$R_2$ and $R_3$ may have a substituent. The substituent on $R_2$ or $R_3$ may be, for example: a halogen atom such as a fluorine atom, a chlorine atom, a bromine atom, or an iodine atom; a linear, branched, or cyclic alkyl group wherein the alkyl group may be a bicycloalkyl group or an active methine group; an alkenyl group; an alkynyl group; an aryl group; a heterocyclic group wherein the atom bonded to $R_2$ or $R_3$ and its position are not limited; an acyl group; an alkoxycarbonyl group; an aryloxycarbonyl group; a heterocyclyloxycarbonyl group; a carbamoyl group; an N-hydroxycarbamoyl group; an N-acylcarbamoyl group; an N-sulfonylcarbamoyl group; an N-carbamoylcarbamoyl group; a thiocarbamoyl group; an N-sulfamoylcarbamoyl group; a carbazoyl group; a carboxy group or a salt thereof; an oxalyl group; an oxamoyl group; a cyano group; a carbonimidoyl group; a formyl group; a hydroxy group; an alkoxy group which may contain a plurality of ethyleneoxy or propyleneoxy groups as repetition units; an aryloxy group; a heterocyclyloxy group; an acyloxy group; an alkoxy carbonyloxy group or an aryloxy carbonyloxy group; a carbamoyloxy group; a sulfonyloxy group; an amino group; an alkyl, aryl, or heterocyclyl amino group; an acylamino group; a sulfonamide group; an ureido group; a thioureide group; an N-hydroxyureido group; an imide group; an alkoxy carbonylamino group or an aryloxy carbonylamino group; a sulfamoylamino group; a semicarbazide group; a thiosemicarbazide group; a hydrazino group; an ammonio group; an oxamoylamino group; an N-alkyl or N-aryl sulfonylureide group; an N-acylureide group; an N-acylsulfamoylamino group; a hydroxyamino group; a nitro group; a heterocyclic group containing a quaternary nitrogen atom such as a pyridinio group, an imidazolio group, a quinolinio group or an isoquinolinio group; an isocyano group; an imino group; a mercapto group; an alkyl, aryl, or heterocyclyl thio group; an alkyl, aryl, or heterocyclyl dithio group; an alkyl sulfonyl group or an aryl sulfonyl group; an alkyl sulfinyl group or an aryl sulfinyl group; a sulfo group or a salt thereof; a sulfamoyl group; an N-acylsulfamoyl group; an N-sulfonylsulfamoyl group or a salt thereof; a phosphino group; a phosphinyl group; a phosphinyloxy group; a phosphinylamino group; or a silyl group. The term "an active methine group" used herein refers to a methine group whose two valencies are occupied by two electron-attractive groups.

The electron-attractive group is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, or a carbonimidoyl group. The two electron-attractive groups may be bonded to each other to form a ring structure. The cations in the salts which are recited in the above examples are selected from metal cations such as alkaline metal ions, alkaline earth metal ions, and heavy metal ions, and organic cations such as ammonium ions and phosphonium ions. The substituent on $R_2$ or $R_3$ may be further substituted by a substituent which is selected from the examples of the subsitutent on $R_2$ or $R_3$.

Preferably, $R_2$ and $R_3$ each independently represent a hydrogen atom, an alkyl group, or an aryl group. Particularly preferably, one of $R_2$ and $R_3$ is a hydrogen atom.

$R_1$ may be dissociated from the rest of the molecule to form an ion.

In the formulae (1) and (2), L represents a substituted or unsubstituted alkenylene group which preferably has 2 to 30 carbon atoms and more preferably has 2 to 20 carbon atoms; a substituted or unsubstituted arylene group which preferably has 6 to 30 carbon atoms and more preferably has 6 to 20 carbon atoms; an —N═N— group; a —C($R_4$)═N— group, $R_4$ representing a hydrogen atom, an alkyl group, an aryl group, or a heterocyclic group; or a divalent aromatic heterocyclic group. L may have a substituent and examples of the substituent on L are the same as the examples of the substituents on $R_2$ and $R_3$ in the formula (1).

L is preferably an alkenylene group, an arylene group, or a —C($R_4$)═N— group, more preferably an arylene group. When L is an arylene group, each L group particularly preferably has 2 or 4 carbon atoms on the main chain.

In the formula (1), X and Y each independently represent a nitrogen atom or a —$CR_5$— group. $R_5$ represents a hydrogen atom or a substituent that can be bonded to the carbon atom, and examples of the substituent are the same as the examples of the substituents on $R_2$ and $R_3$ in the formula (1). $R_5$ is preferably a hydrogen atom, an alkyl group, an aryl group, a cyano group, a carbamoyl group, or an alkoxycarbonyl group. X is particularly preferably a nitrogen atom.

In the formulae (1) or (2), Z represents an atomic group that can be the part of the ring in the formula (1) or (2), which is a 5- to 7-membered, monocyclic or condensed, aromatic or nonaromatic, carbocyclic or heterocyclic ring.

The ring including Z may be, for example, a benzene ring, a naphthalene ring, a pyridine ring, a quinoline ring, an isoquinoline ring, a pyrrole ring, a furan ring, a thiophene ring, an imidazole ring, a thiazole ring, an oxazole ring, a triazole ring, a thiadiazole ring, a pyrimidine ring, a triazine ring.

In the formulae (1) and (2), M represents a hydrogen atom; an ion of a metal such as Li, Na, K, Ca, Ba, Ag, and Zn; or a quaternary ammonium ion such as a trimethylammonium ion and a benzyltrimethylammonium ion.

The compound represented by the formula (1) is particularly preferably a compound represented by the following formula (1-a).

Formula (1-a)

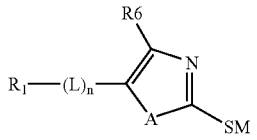

In the formula (1-a), $R_1$ represents an OH group, an SH group, or an $NR_2R_3$ group ($R_2$ and $R_3$ each independently representing a hydrogen atom, an alkyl group, an aryl group, a heterocyclic group, an alkylsulfonyl group, or an arylsulfonyl group); L represents an alkenylene group, an arylene group, an —N═N— group, a —C($R_4$)═N— group ($R_4$ representing a hydrogen atom, an alkyl group, an aryl group, or a heterocyclic group), or a divalent aromatic heterocyclic group; n represents 0 or 1; R6 represents a hydrogen atom or a substituent that can be bonded to the carbon atom; A represents a sulfur atom or an —$NR_7$— group ($R_7$ representing a hydrogen atom, an alkyl group, an aryl group, or a heterocyclic group); and M represents a hydrogen atom, a metal ion, or a quaternary ammonium ion.

The compound represented by the formula (1-a) is described in more detail below.

The definitions and preferable examples of $R_1$, L, n, and M in the formula (1-a) are the same as the definitions and preferable examples of $R_1$, L, n, and M in the formula (1).

R6 represents a hydrogen atom or a substituent that can be bonded to the carbon atom, and the definition and the preferred examples of R6 are the same as the definition and the preferred examples of $R_5$ in the formula (1).

"A" represents a sulfur atom or an —$NR_7$— group. $R_7$ represents a hydrogen atom, an alky group, an aryl group, or a heterocyclic group. The alkyl group is linear, branched, or cyclic. The alkyl group is substituted or unsubstituted. The alkyl group preferably has 1 to 30 carbon atoms and more preferably has 1 to 20 carbon atoms. For example, the alkyl group may be a methyl group, an ethyl group, an n-propyl group, an n-butyl group, an isobutyl group, an n-hexyl group, a cyclohexyl group, or a benzyl group. The aryl group is substituted or unsubstituted. The aryl group preferably has 6 to 30 carbon atoms and more preferably has 6 to 20 carbon atoms. For example, the aryl group may be a phenyl group or a naphtyl group. The heterocyclic group is aromatic or nonaromatic. The heterocyclic group is substituted or unsubstituted. The heterocyclic group has a 5- to 7-membered heterocycle which is a monocycle or a condensed cycle. $R_7$ is preferably a hydrogen atom, an alkyl group, or an aryl group. A is preferably an —$NR_7$— group.

The compound represented by the formula (1) or (2) preferably has a group that can reduce a silver ion. The group may be, for example, a triple bond-containing group such as an acetylene group or a propargyl group; or a group generated by removing one hydrogen atom from a hydroxylamine compound, a hydroxamic acid compound, a hydroxyurea compound, a hydroxyurethane compound, a hydroxysemicarbazide compound, a reductone compound (the reductone compound may be a reductone derivative), a phenol compound (the phenol compound may be a chroman-6-ol compound, a 2,3-dihydrobenzofuran-5-ol compound, an aminophenol compound, a sulfonamidophenol compound, a hydroquinone compound, a catechol compound, a resorcinol compound, a benzenetriol compound, or a polyphenol compound such as a bisphenol compound), an acylhydrazine compound, a carbamoylhydrazine compound, or a 3-pyrazolidone compound.

The compound represented by the formula (1) or (2) may have a group that can adsorb a silver halide. Examples of the group include alkylthio groups, arylthio groups, thiourea groups, thioamide groups, mercaptoheterocyclic groups, triazole groups described in U.S. Pat. Nos. 4,385,108 and 4,459,347, and JP-A Nos. 59-195233, 59-200231, 59-201045, 59-201046, 59-201047, 59-201048, 59-201049, 61-170733, 61-270744, 62-948, 63-234244, 63-234245, and 63-234246. The compound of the formula (1) or (2) may have a precursor of the group that can adsorb a silver halide. Examples of the precursor include the groups described in JP-A No. 2-285344.

The compound represented by the formula (1) or (2) may have a ballast group or a polymer moiety that is commonly used in immobile photographic additives such as couplers. The ballast group is a group which has 8 or more carbon atoms and which does not strongly affect photographic properties. Examples of the ballast group include alkyl groups, aralkyl groups, alkoxy groups, a phenyl group, alkylphenyl groups, a phenoxy group, and alkylphenoxy groups. Examples of the polymer moiety include the polymer moieties described in JP-A No. 1-100530.

The molecular weight of the compound represented by the formula (1) or (2) is preferably 100 to 10,000, more preferably 150 to 1,000, particularly preferably 170 to 500.

Preferable examples of the compounds of the formulae (1) and (2) are shown below, however the scope of the invention is by no means restricted by these examples.

(A-1)

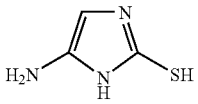

(A-2)

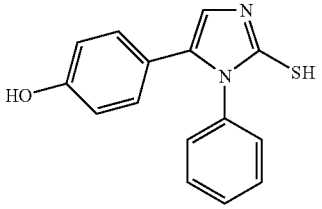

(A-3)

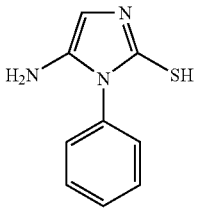

(A-4)

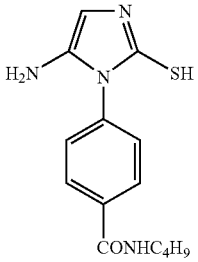

-continued (A-5)

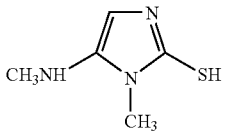

(A-6)

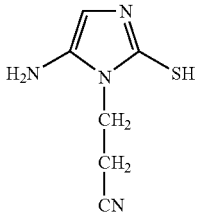

(A-7)

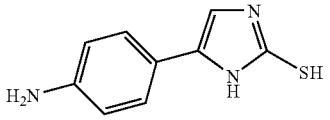

(A-8)

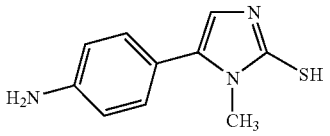

(A-9)

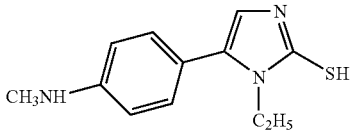

(A-10)

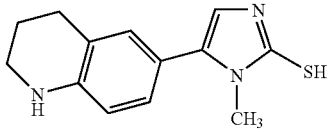

(A-11)

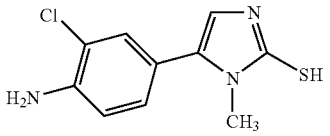

(A-12)

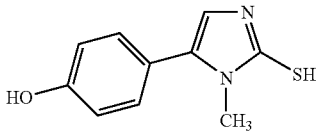

(A-13)

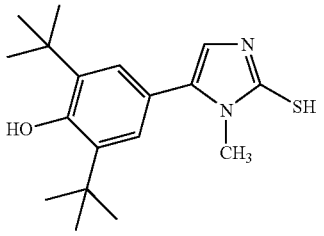

(A-14)

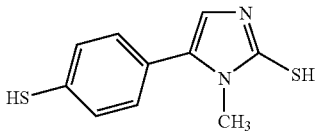

-continued
(A-15)
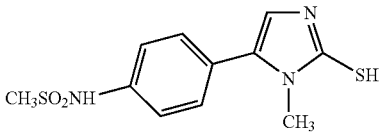
(A-16)
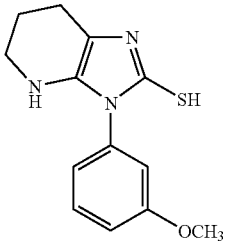
(A-17)
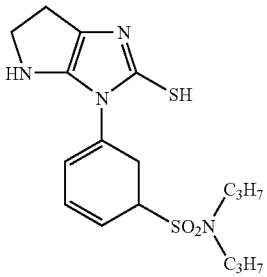
(A-18)
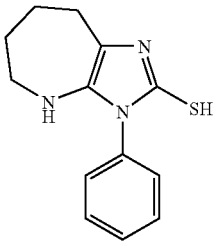
(A-19)
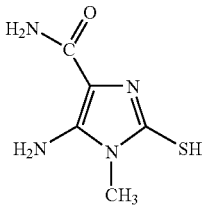
(A-20)
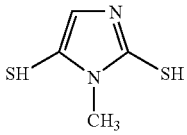
(A-21)
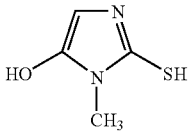
(A-22)
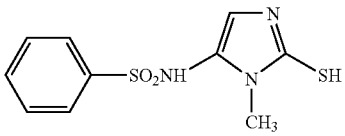
-continued
(A-23)
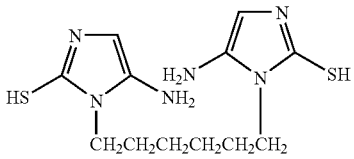
(A-24)
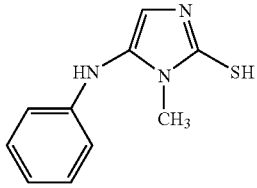
(A-25)
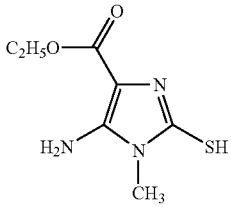
(A-26)
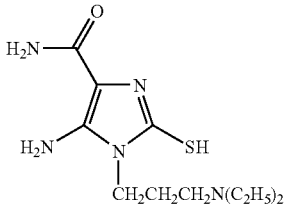
(A-27)
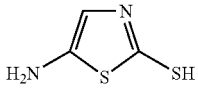
(A-28)
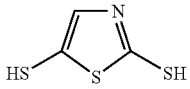
(A-29)
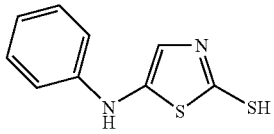
(A-30)
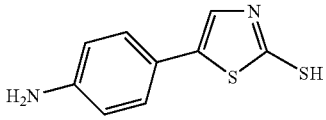
(A-31)
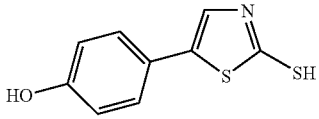
(A-32)
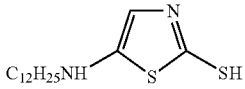

-continued (A-33)

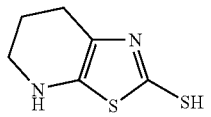

(A-34)

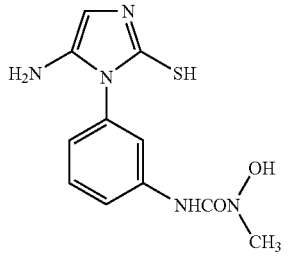

(A-35)

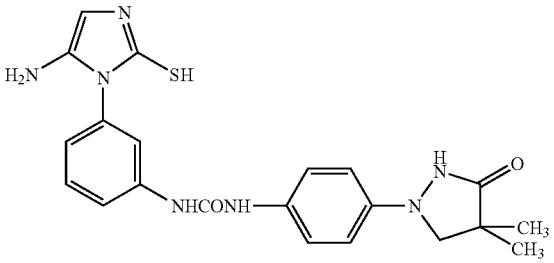

(A-36)

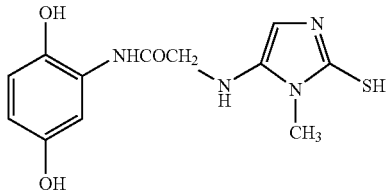

(A-37)

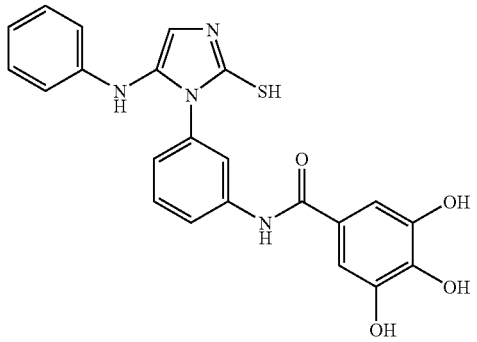

The compound represented by the formula (1) or (2) recited in the invention can be easily synthesized by known methods. Examples of the methods are described in *Labdev J. Sci. Tech., Vol.* 9-A, No. 1, January 1971, *Indian Journal of Chemistry*, Vol. 14B, 351–353 (1976), *Journal of Chemical Society,* 2028–2029 (1048), *Journal of Medicinal Chemistry,* 1997, 40, 2571–2578.

Two or more compounds represented by the formula (1) or (2) are preferably used simultaneously although only a single compound may be used. A compound represented by the formula (1) or (2) is preferably added to the silver halide emulsion layer. In that case, the compound is preferably added during the preparation of the silver halide emulsion. If the compound is added during the preparation of the emulsion, the compound may be added at any time during the preparation. For example, the compound may be added during the silver halide grains-forming step, before the desalination step, during the desalination step, before the chemical ripening step, during the chemical ripening step, or before the preparation of the final emulsion. The compound may be added several times during these steps. Although the compound is preferably added to the emulsion layer, the compound may be added to the neighboring protective layer or intermediate layer as well as to the emulsion layer so that the compound may be diffused during the application of the layers.

The preferred amount of the compound of the formula (1) or (2) to be added largely depends on the addition method and the type of the compound. The amount of the compound is generally $1\times10^{-6}$ to 1 mol, preferably $1\times10^{-5}$ to $5\times10^{-1}$ mol, more preferably $1\times10^{-4}$ to $1\times10^{-1}$ mol, per 1 mol of the photosensitive silver halide.

The compound represented by the formula (1) or (2) may be added as a solution by being dissolved in water, a water-soluble solvent such as methanol or ethanol, or a mixed solvent thereof. The pH value of the solution may be appropriately controlled by an acid or a base, and a surfactant may be added to the solution. The compound may be added as an emulsified dispersion in an organic high boiling point solvent, or as a solid dispersion.

(Compound that Practically Reduces Visible Light Absorption by Photosensitive Silver Halide through Heat Development)

The photothermographic material of the invention preferably contains a compound that can practically reduce visible light absorption by the photosensitive silver halide through the heat development. In the invention, a silver-iodide-complex forming agent is particularly preferably used as such a compound.

<Silver-iodide-complexforming Agent>

In the invention, the compound which can practically reduce the ultraviolet-visible light absorption intensity of the photosensitive silver halide through the heat development step, is preferably used. The silver-iodide-complex forming agent is particularly preferably used as the compound.

The silver-iodide-complex forming agent has at least one nitrogen or sulfur atom that can act as a coordination atom (an electron donor or a Lewis base) and donate an electron to a silver ion. The stability of the complex is defined by the consecutive stability constant or overall stability constant. The stability depends on the combination of the silver ion, the iodide ion, and the silver-iodide-complex forming agent. Generally, the stability constant can be increased by a chelate effect owing to intramolecular chelate ring formation, or by increase in the acid-base dissociation constant of the ligand.

The ultraviolet-visible absorption spectrum of the photosensitive silver halide can be measured by a transmission method or a reflection method. If the absorption spectrum of the photosensitive silver halide overlaps the absorption spectrum of other compounds in the photothermographic material, the ultraviolet-visible absorption spectrum of the photosensitive silver halide can be determined by using a difference spectrum, by removal of the other compounds with a solvent, or by both methods.

The silver-iodide-complex forming agent used in the invention is preferably a 5- to 7-membered heterocyclic compound comprising at least one nitrogen atom. When the heterocyclic compound has none of a mercapto group, a sulfide group, and a thione group as a substituent, the heterocycle of the heterocyclic compound may be saturated or unsaturated and may have another substituent. Substituents on the heterocycle may be bonded to each other to form a ring.

Preferable examples of the 5- to 7-membered heterocyclic compound include pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylidine, purine, pteridine, carbazole, acridine, phenanthridine, phenanthroline, phenazine, phenoxazine, phenothiazine, benzothiazole, benzoxazole, benzimidazole, 1,2,4-triazine, 1,3,5-triazine, pyrrolidine, imidazolidine, pyrazolidine, piperidine, piperazine, morpholine, indoline, isoindoline, etc. More preferable examples of the heterocyclic compound include pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylidine, 1,10-phenanthroline, benzimidazole, benzotriazole, 1,2,4-triazine, and 1,3,5-triazine. The heterocyclic compound is particularly preferably pyridine, imidazole, pyrazine, pyrimidine, pyridazine, phthalazine, triazine, 1,8-naphthylidine, or 1,10 -phenanthroline.

The heterocycle may have any substituent that has no adverse effects on the photographic properties. Preferred examples of the substituent on the heterocycle include halogen atoms such as a fluorine atom, a chlorine atom, a bromine atom, and an iodine atom; linear alkyl groups, branched alkyl groups, and cyclic alkyl groups (bicycloalkyl groups and active methine groups are included); alkenyl groups; alkynyl groups; aryl groups; heterocyclic groups (the atom bonded to the 5- to 7-membered heterocycle and its position are not restricted); acyl groups; alkoxycarbonyl groups; aryloxycarbonyl groups; heterocyclyloxycarbonyl groups; carbamoyl groups; N-acylcarbamoyl groups; N-sulfonylcarbamoyl groups; N-carbamoylcarbamoyl groups; N-sulfamoylcarbamoyl groups; carbazoyl groups; a carboxy group and salts thereof; oxalyl groups; oxamoyl groups; a cyano group; carbonimidoyl groups; a formyl group; a hydroxy group; alkoxy groups which may contain a plurality of ethyleneoxy or propyleneoxy groups as repetition units; aryloxy groups; heterocyclyloxy groups; acyloxy groups; alkoxy carbonyloxy groups and aryloxy carbonyloxy groups; carbamoyloxy groups; sulfonyloxy groups; amino groups; alkylamino groups, arylamino groups, and heterocyclylamino groups; acylamino groups; sulfonamide groups; ureido groups; thioureide groups; imide groups; alkoxy carbonylamino groups and aryloxy carbonylamino groups; sulfamoylamino groups; semicarbazide groups; ammonio groups; oxamoylamino groups; N-alkylsulfonylureide groups and N-arylsulfonylureide groups; N-acylureide groups; N-acylsulfamoylamino groups; a nitro group; heterocyclic groups containing a quaternary nitrogen atom such as a pyridinio group, an imidazolio group, a quinolinio group and an isoquinolinio group; an isocyano group; imino groups; alkylsulfonyl groups and arylsulfonyl groups; alkylsulfinyl groups and arylsulfinyl groups; a sulfo group and salts thereof; sulfamoyl groups; N-acylsulfamoyl groups; N-sulfonylsulfamoyl groups and salts thereof; phosphino groups; phosphinyl groups; phosphinyloxy groups; phosphinylamino groups; and silyl groups. The active methine group is a methine group having two electron-attractive groups. Each of the electron-attractive groups is selected from an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, and a carbonimidoyl group. The two electron-attractive groups may be bonded to each other to form a ring structure. Cations of the salts include metal cations such as alkaline metal ions, alkaline earth metal ions, and heavy metal ions, and organic cations such as ammonium ions and phosphonium ions. The substituents may be further substituted by a substituent selected from the substituents in the above examples.

The heterocycle in the silver-iodide-complex forming agent may be condensed with another ring. If the heterocycle has an anionic group such as $—CO_2^-$, $—SO_3^-$, or $—S^-$ as a substituent, the heterocycle may be a cation such as a pyridinium cation or a 1,2,4-triazolium cation to form an internal salt.

When the heterocyclic compound is a derivative of pyridine, pyrazine, pyrimidine, pyridazine, phthalazine, triazine, naphthylidine, or phenanthroline, the conjugate acid of the heterocycle moiety shows an acid dissociation constant (pKa) of preferably 3 to 8 in a 3/2 mixed solvent of tetrahydrofuran/water at 25° C. in the acid dissociation equilibrium of the heterocyclic compound. The pKa is more preferably 4 to 7.

The heterocyclic compound is preferably a derivative of pyridine, pyridazine, or phthalazine, particularly preferably a derivative of pyridine or phthalazine.

If the heterocyclic compound has a mercapto group, a sulfide group, or a thione group as a substituent, the heterocyclic compound is preferably a derivative of pyridine, thiazole, isothiazole, oxazole, isoxazole, imidazole, pyrazole, pyrazine, pyrimidine, pyridazine, triazine, triazole, thiadiazole, or oxadiazole, particularly preferably a derivative of thiazole, imidazole, pyrazole, pyrazine, pyrimidine, pyridazine, triazine, or triazole.

A compound represented by the following formula (1') or (2') may be used as the silver-iodide-complex forming agent.

Formula (1')

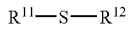

Formula (2')

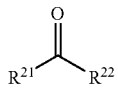

In the formula (1'), $R^{11}$ and $R^{12}$ each independently represent a hydrogen atom or a substituent. In the formula (2'), $R^{21}$ and $R^{22}$ each independently represent a hydrogen atom or a substituent. At least one of $R^{11}$ and $R^{12}$ is not a hydrogen atom, and at least one of $R^{21}$ and $R^{22}$ is not a hydrogen atom. Examples of the substituents that $R^{11}$, $R^{12}$, $R^{21}$, and $R^{22}$ may represent are the above-described examples of the substituent on the silver-iodide-complex forming agent having the nitrogen-containing 5- to 7-membered heterocycle.

Further, a compound represented by the following formula (3) can preferably be used as the silver-iodide-complex forming agent.

Formula (3)

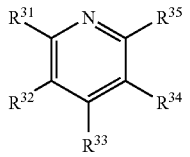

In the formula (3), $R^{31}$ to $R_{35}$ each independently represent a hydrogen atom or a substituent. Examples of the substituents that $R^{31}$ to $R^{35}$ may represent include the above-described examples of the substituents on the silver-iodide-complex forming agent including the nitrogen-containing 5- to 7-membered heterocycle. If the compound represented by the formula (3) has a substituent, the substituent is preferably any of $R^{32}$ to $R^{34}$. Any two selected from $R^{31}$ to $R^{35}$ may be bonded to each other to form a saturated or unsaturated ring. Preferable examples of the substituents represented by $R^{31}$ to $R^{35}$ include halogen atoms, alkyl groups, aryl groups, carbamoyl groups, a hydroxy group, alkoxy groups, aryloxy groups, carbamoyloxy groups, amino groups, acylamino groups, ureido groups, alkoxycarbonylamino groups, and aryloxycarbonylamino groups.

The conjugate acid of the pyridine ring moiety in the compound represented by the formula (3) preferably has an acid dissociation constant (pKa) of 3 to 8 at 25° C. in a 3/2 mixed solvent of tetrahydrofuran/water. The pKa is particularly preferably 4 to 7.

Further, a compound represented by the following formula (4) can be preferably used as the silver-iodide-complex forming agent.

Formula (4)

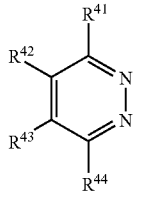

In the formula (4), $R^{41}$ to $R^{44}$ each independently represent a hydrogen atom or a substituent. Any two selected from $R^{41}$ to $R^{44}$ may be bonded to each other to form a saturated or unsaturated ring. Examples of the substituents represented by $R^{41}$ to $R^{44}$ include the above-described examples of the substituents on the silver-iodide-complex forming agent including the nitrogen-containing 5- to 7-membered heterocycle. Preferable examples of the substituents include alkyl groups, alkenyl groups, alkynyl groups, aryl groups, a hydroxy group, alkoxy groups, aryloxy groups, and heterocyclyloxy groups. A benzene ring is preferably condensed with the ring in the formula (4) to form a phthalazine ring. When a hydroxyl group is bonded to a carbon atom adjacent to a nitrogen atom in the formula (4), the compound represented by the formula (4) may assume a pyridazinone form. In that case, there is equilibrium between the two forms.

The compound represented by the formula (4) preferably includes a phthalazine ring represented by the following formula (5). The phthalazine ring particularly preferably has at least one substituent. Examples of $R^{51}$ to $R^{56}$ in the formula (5) are the above-described examples of the substituents on the silver-iodide-complex forming agent including the nitrogen-containing 5- to 7-membered heterocycle. Preferred examples of the substituent on the phthalazine ring include alkyl groups, alkenyl groups, alkynyl groups, aryl groups, a hydroxy group, alkoxy groups, and aryloxy groups. The substituent is more preferably an alkyl group, an alkenyl group, an aryl group, an alkoxy group, or aryloxy group, further preferably, an alkyl group, an alkoxy group, or an aryloxy group.

Formula (5)

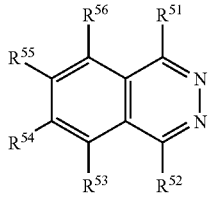

Further, a compound represented by the following formula (6) can be preferably used as the silver-iodide-complex forming agent.

Formula (6)

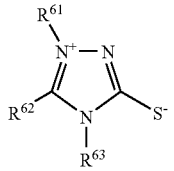

In the formula (6), $R^{61}$ to $R^{63}$ each independently represent a hydrogen atom or a substituent. The substituents represented by $R^{62}$ may be selected from the above-described examples of the substituents on the silver-iodide-complex forming agent including the nitrogen-containing 5- to 7-membered heterocycle.

A compound represented by the following formula (7) can be preferably used as the silver-iodide-complex forming agent.

$$R^{71}—S-(L)_n-S—R^{72}$$ Formula (7)

In the formula (7), $R^{71}$ and $R^{72}$ each independently represent a hydrogen atom or a substituent. L represents a divalent linking group. n represents 0 or 1. Examples of the substituents represented by $R^{71}$ and $R^{72}$ include alkyl groups (cycloalkyl groups are included), alkenyl groups (cycloalkenyl groups are included), alkynyl groups, aryl groups, heterocyclic groups, acyl groups, aryloxycarbonyl groups, alkoxycarbonyl groups, carbamoyl groups, imide groups, and combined groups each including some of the above groups. The divalent linking group represented by L is preferably a linking group whose linking length is from 1 to 6 atoms, more preferably, from 1 to 3 atoms. The divalent linking group may have a substituent.

A compound represented by the following formula (8) also can be preferably used as the silver-iodide-complex forming agent.

Formula (8)

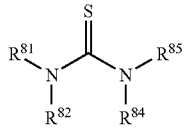

In the formula (8), $R^{81}$, $R^{82}$, $R^{84}$, and $R^{85}$ each independently represent a hydrogen atom or a substituent, and examples of the substituents include alkyl groups (cycloalkyl groups are included), alkenyl groups (cycloalkenyl groups are included), alkynyl groups, aryl groups, heterocyclic groups, acyl groups, aryloxycarbonyl groups, alkoxycarbonyl groups, carbamoyl groups, and imide groups.

Among the above silver-iodide-complex forming agents, the compounds represented by the formula (3), (4), (5), (6), or (7) are more preferable. The compounds represented by the formula (3) or (5) are particularly preferable.

Preferable examples of the silver-iodide-complex forming agents are shown below. However, the scope of the invention is by no means restricted by these examples.

(1)

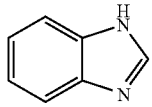

(2)

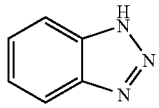

(3)

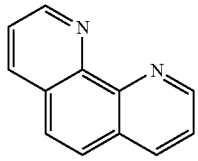

(4)

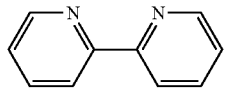

(5)

$C_5H_{11}SC_5H_{11}$ (6)

$C_4H_9SCH_2CH_2SC_4H_9$ (7)

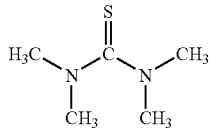

(8)

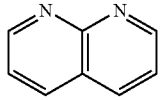

-continued (9)

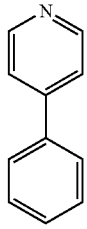

(10)

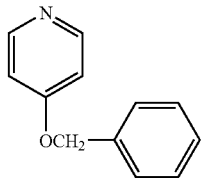

(11)

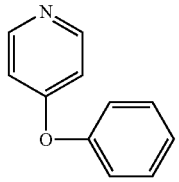

(12)

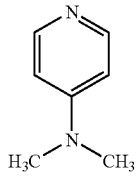

(13)

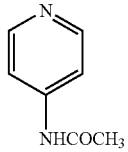

(14)

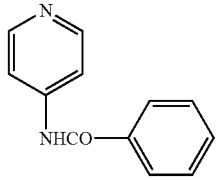

(15)

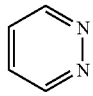

(16)

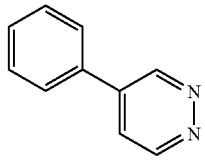

-continued
(17)
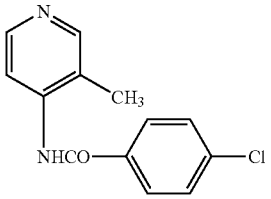
(18)
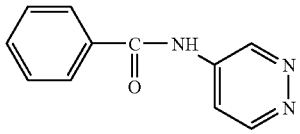
(19)
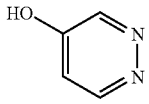
(20)
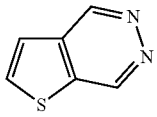
(21)
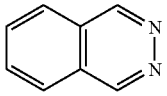
(22)
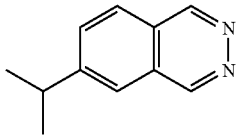
(23)
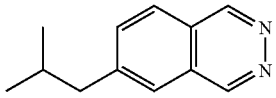
(24)
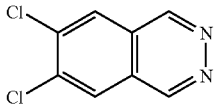
(25)
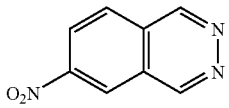
(26)
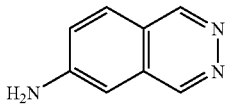
(27)
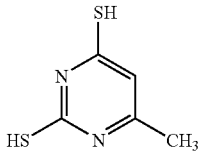
-continued
(28)
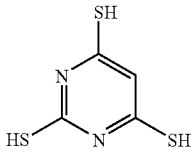
(29)
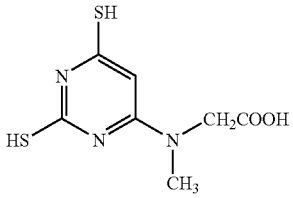
(30)
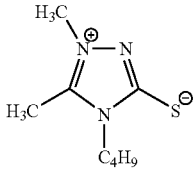
(31)
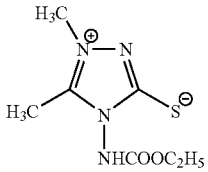
(32)
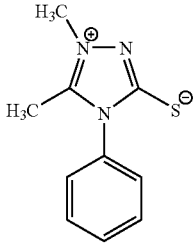
(33)
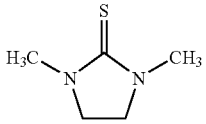
(34)
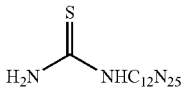
(35)
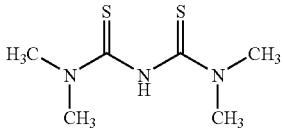
(36)
$HO(CH_2)_3S(CH_2)_2S(CH_2)_3OH$
(37)
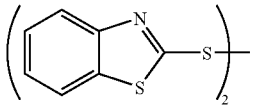

-continued (38)

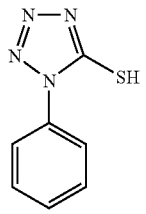

(39)

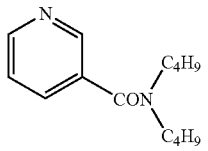

(40)

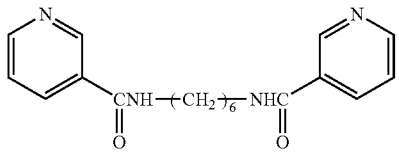

(41)

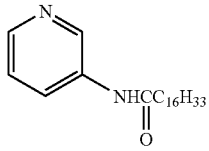

(42)

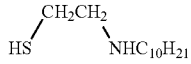

The silver-iodide-complex forming agent used in the invention may be used in combination with a toning agent. If the silver-iodide-complex forming agent has the function as a toning agent, the agent can be considered to be both a silver-iodide-complex forming agent and a toning agent. Two or more silver-iodide-complex forming agents may be used in combination.

In the film, the silver-iodide-complex forming agent is preferably separated from the photosensitive silver halide. For example, the silver-iodide-complex forming agent is preferably contained in the film in a solid state. The silver-iodide-complex forming agent is preferably added to a layer adjacent to the photosensitive silver halide layer. The melting point of the silver-iodide-complex forming agent is preferably so controlled that the agent melts when heated to the heat development temperature.

In the invention, the ultraviolet-visible light absorption intensity of the photosensitive silver halide measured after the heat development is preferably 80% or less, more preferably 40% or less, particularly preferably 10% or less, of the intensity measured before the heat development.

The silver-iodide-complex forming agent may be added to the coating solution in any form. For example, it can be added in a solution form, an emulsified dispersion form, or a solid grain dispersion form. The silver-iodide-complex forming agent in the coating solution will be included in the photosensitive material.

Well-known emulsification and dispersion methods include methods in which the silver-iodide-complex forming agent is dissolved using an oil and an optional auxiliary solvent and mechanically emulsified and dispersed. The oil may be, for example, dibutyl phthalate, tricresyl phosphate, glyceryl triacetate, or diethyl phthalate. The auxiliary solvent may be, for example, ethyl acetate or cyclohexanone.

The solid grain dispersion may be prepared by dispersing powder of the silver-iodide-complex forming agent in an appropriate solvent such as water by a ball mill, a colloid mill, a vibration ball mill, a sand mill, a jet mill, a roll mill, or ultrasonic wave. A protective colloid (e.g. polyvinyl alcohol) or a surfactant may be used in the preparation. The surfactant may be an anionic surfactant. The anionic surfactant may be, for example, a mixture of sodium triisopropylnaphthalene sulfonates each having three isopropyl groups at different positions. Beads such as zirconia beads are generally used as a dispersion medium in the mills. A substance such as Zr is occasionally eluted from the beads and mixed with the dispersion. The amount of the eluted and mixed component depends on the dispersion conditions, and is generally within the range of 1 to 1,000 ppm. When the Zr content of the photothermographic material is 0.5 mg or less per 1 g of silver, there are no practical difficulties.

An antiseptic agent such as a benzoisothiazolinone sodium salt is preferably added to the aqueous dispersion.

The silver-iodide-complex forming agent is preferably used in the state of the solid dispersion.

The mole ratio of the silver-iodide-complex forming agent to the photosensitive silver halide is preferably 1 to 5,000 mol %, more preferably 10 to 1,000 mol %, furthermore preferably 50 to 300 mol %.

(Photosensitive Silver Halide)

1) Halogen Composition

The photosensitive silver halide grains used in the invention preferably has a high silver iodide content of 40 to 100 mol %. There are no other restrictions on the photosensitive silver halide. Silver halides such as silver chloride and silver bromide may be used. Organic silver salts such as silver thiocyanate and silver phosphate may also be used. Particularly preferably, silver bromide or silver chloride is used. When the silver halide has such a high silver iodide content, the photothermographic material of the invention can form a developed image with excellent storability. Particularly, the fogging of the image due to exposure to light is extremely little.

The silver iodide content is preferably 70 to 100 mol %, more preferably 80 to 100 mol %, further preferably 90 to 100 mol %, because the storability of the developed image under the light exposure is good when the silver iodide content is in the range.

In a photosensitive silver halide grain, the halogen composition may be uniform, or may be changed stepwise or continuously. The photosensitive silver halide grains preferably has a core-shell structure. The core-shell grains preferably has 2- to 5-layered structure, more preferably has 2- to 4-layered structure. The core-shell grains preferably has a core portion with a high silver iodide content or a shell portion with a high silver iodide content. Techniques of localizing on the grains an epitaxial portion of silver chloride or silver bromide are preferably used in the invention.

The silver iodide used in the invention may have any β-phase content and any γ-phase content. The β-phase has a high-silver iodide hexagonal wurtzite structure, and the γ-phase has a high-silver iodide cubic zinc blende structure. The γ-phase content is determined by a method proposed by C. R. Berry. In the method, the γ-phase content is determined based on ratio of the peaks of the γ-phase ((100), (101), and (002)) and the β-phase ((111)) in powder X-ray diffraction. The method is described in detail, for example in *Physical Review*, Volume 161, No. 3, p. 848–851 (1967).

2) Grain Size

The silver halide grains having a high-silver iodide content used in the invention may have a sufficiently large grain size to obtain a high sensitivity. The average sphere-equivalent diameter of the silver halide grains is preferably 0.3 to 5.0 μm, more preferably 0.35 to 3.0 μm. In the invention, a sphere-equivalent diameter of a silver halide grain refers to a diameter of a sphere having the same volume as the grain. The sphere-equivalent diameter can be determined by observing a grain with an electron microscope, measuring its projected area and thickness, calculating its volume, and determining the radius of the sphere having the same volume.

3) Application Amount

Silver halide grains remain in the photothermographic material after the heat development. Therefore, generally, the transparency of the film is generally reduced to lower the image qualities when a large amount of the silver halide grains is applied. Thus, the application amount of the silver halide grains has been limited to a low level even though there has been needs for photothermographic materials with high sensitivity. However, in the invention, the haze of the film owing to the silver halide grains can be reduced by the heat development, whereby a larger amount of the silver halide grains may be applied. In the invention, the amount of the silver halide grains is preferably 0.5 to 100 mol %, more preferably 5 to 50 mol %, per 1 mol of silver in the non-photosensitive organic silver salt.

4) Method for Forming Photosensitive Silver Halide Grains

Methods for forming the photosensitive silver halide grains are well known in the field. For example, the methods described in *Research Disclosure*, No. 17029, June 1978 and U.S. Pat. No. 3,700,458 may be used in the invention. Specifically, the photosensitive silver halide grains may be prepared by adding a silver source and a halogen source to a solution of gelatin or another polymer to prepare a silver halide and mixing the silver halide with an organic silver salt. Further, the methods described in JP-A No. 11-119374, paragraphs 0217 to 0224, JP-A No. 11-352627, and Japanese Patent Application No. 2000-42336 are also preferably used in the invention.

Tabular silver iodide grains are preferably prepared by the methods described in JP-A Nos. 59-119350 and 59-119344.

5) Shape of Photosensitive Silver Halide Grains

The photosensitive silver halide grains used in the invention may be, for example cuboidal grains, octahedral grains, tetradecahedral grains, dodecahedral grains, tabular grains, spherical grains, rod-shape grains, potato-like grains. Preferred among them are dodecahedral grains, tetradecahedral grains, and tabular grains. The dodecahedral grains have (001), {1(−1)0}, and {101} faces, and the tetradecahedral grains have (001), {100}, and {101} faces. The {100} face and the {101} face have face indexes equivalent to the (100) face and the (101) face respectively.

The dodecahedral, tetradecahedral, or octahedral silver iodide grains may be prepared with reference to Japanese Patent Application Laid-Open Nos. 2004-4586, 2003-287835, 2003-287836.

The projected-area-equivalent diameter of the tabular silver halide grain used in the invention is preferably 0.4 to 8.0 μm, more preferably 0.5 to 3 μm. A projected-area-equivalent diameter refers to a diameter of a circle having the same area as the projected area of a silver halide grain. The projected-area-equivalent diameter can be determined by observing a silver halide grain with an electron microscope, measuring its projected area, determining the radius of a circle having the same area as the projected area of the grain.

The thickness of the photosensitive silver halide grains used in the invention is preferably 0.3 μm or less, more preferably 0.2 μm or less, further preferably 0.15 μm or less. The aspect ratio of the photosensitive silver halide grains is preferably 2 to 100, more preferably 5 to 50.

The photosensitive silver halide grains having a high silver iodide content may take a complicated shape, and are preferably the conjugated grains or tabular grains described in R. L. Jenkins, et al., *J. of Phot. Sci.*, Vol. 28 (1980), page 164, FIG. 1. Also silver halide grains with roundish corners are preferably used in the invention. The face index (Miller indices) of the outer surface plane of the photosensitive silver halide grains is not particularly limited. The silver halide grains preferably have a higher proportion of [100] faces, which show a higher spectral sensitization efficiency when a spectrally sensitizing dye is adsorbed by the [100] faces. The proportion of the [100] faces is preferably 50% or higher, more preferably 65% or higher, further preferably 80% or higher. The proportion of the [100] faces according to the Miller indices can be obtained by the method described in T. Tani, *J. Imaging Sci.,* 29, 165 (1985) using adsorption dependency between [111] face and [100] face upon adsorption of a sensitizing dye.

6) Heavy Metal

The photosensitive silver halide grains used in the invention may contain a metal of Groups 8 to 10 of the Periodic Table of Elements which consists of Groups 1 to 18, or a complex thereof. Preferred as the metal of Groups 8 to 10 are rhodium, ruthenium, and iridium. The metal complex may be used singly or in combination with other complexes containing the same or different metal. The amount of the metal or the complex thereof is preferably $1\times10^{-9}$ to $1\times10^{-3}$ mol per 1 mol of silver. The heavy metals, the metal complexes, and methods for adding them are described in JP-A No. 7-225449, JP-A No. 11-65021, paragraphs 0018 to 0024, and JP-A No. 11-119374, paragraphs 0227 to 0240.

In the invention, the silver halide grains preferably have a hexacyano metal complex on their outermost surface. Examples of the hexacyano metal complexes include $[Fe(CN)_6]^{4-}$, $[Fe(CN)6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. Hexacyano Fe complexes are preferably used in the invention.

When the hexacyano metal complex is added, the complex may be in gelatin, water, or a mixed solvent of water and a water-miscible organic solvent such as an alcohol, an ether, a glycol, a ketone, an ester, or an amide.

The amount of the hexacyano metal complex to be added is preferably $1\times10^{-5}$ to $1\times10^{-2}$ mol per 1 mol of silver, more preferably $1\times10^{-4}$ to $1\times10^{-3}$ mol per 1 mol of silver.

To dispose the hexacyano metal complex on the outermost surface of the silver halide grains, the hexacyano metal complex may be directly added after the addition of an aqueous silver nitrate solution for grain formation. The complex is added in the following period: before the completion of the preparation steps; in the water-washing step; in the dispersion step; or before the chemical sensitization. The preparation steps, the water-wahing step, and the dispersion step are prior to the chemical sensitization step. The chemical sensitization may be a chalcogen sensitization such as sulfur sensitization, selenium sensitization, or tellurium sensitization, or a noble metal sensitization such as gold sensitization. The hexacyano metal complex is added preferably rapidly after the grain formation, particularly preferably before the completion of the preparation steps when the growth of the silver halide grains should be prevented.

Other metal atoms and compounds thereof such as $[Fe(CN)_6]^{4-}$ which may be added to the silver halide grains, and the desalination methods and the chemical sensitization methods for the silver halide emulsion are described in JP-A No. 11-84574, paragraphs 0046 to 0050, JP-A No. 11-65021, paragraphs 0025 to 0031, and JP-A No. 11-119374, paragraphs 0242 to 0250.

7) Gelatin

Various gelatins may be contained in the photosensitive silver halide emulsion used in the invention. The gelatin preferably has a low molecular weight of 500 to 60,000 to maintain the excellent dispersion of the photosensitive silver halide emulsion in the organic silver salt-containing coating solution. The low-molecular-weight gelatin is preferably used in the dispersion step after the desalting treatment although it may be used also during the grain formation.

8) Chemical Sensitization

The photosensitive silver halide grains for the invention is preferably chemically sensitized by at least one of chalcogen sensitization methods, gold sensitization methods, and reduction sensitization methods although the chemically sensitization is not essential. The chalcogen sensitization methods include sulfur sensitization methods, selenium sensitization methods, and tellurium sensitization methods.

Unstable sulfur compounds may be used in the sulfur sensitization. For example, the unstable sulfur compounds described in P. Grafkides, *Chimie et Physique Photographique* (Paul Momtel, 1987, 5th edition), *Research Disclosure*, Vol. 307, No. 307105 may be used.

Specific examples of the sulfur compounds include thiosulfate compounds such as hypo; thiourea compounds such as diphenylthiourea, triethylthiourea, N-ethyl-N'-(4-methyl-2-thiazolyl)thiourea, and carboxymethyltrimethylthiourea; thioamide compounds such as thioacetoamide; rhodanine compounds such as diethylrhodanine and 5-benzylidene-N-ethylrhodanine; phosphine sulfide compounds such as trimethylphosphine sulfide; thiohydantoin compounds; 4-oxo-oxazolidine-2-thione compounds; di-sulfide compounds and poly-sulfide compounds such as dimorpholine disulfide, cystine, and lenthionine (1,2,3,5,6-pentathiepane); polythionate compounds; and elemental sulfur. Also an activated gelatin may be used in the sulfur sensitization methods. Particularly preferred among them are thiosulfate compounds, thiourea compounds, and rhodanine compounds.

Unstable selenium compounds may be used in the selenium sensitization methods. For example, the unstable selenium compounds described in JP-B Nos. 43-13489 and 44-15748, JP-A Nos. 4-25832, 4-109340, 4-271341, 5-40324, 5-11385, 6-051415, 6-175258, 6-180478, 6-208186, 6-208184, 6-317867, 7-92599, 7-98483, and 7-140579 may be used.

Specific examples of the selenium compounds include colloidal selenium; selenourea compounds such as N,N-dimethylselenourea, trifluoromethylcarbonyl-trimethylselenourea, and acetyl-trimethylselenourea; selenoamide compounds such as selenoamide and N,N-diethylphenylselenoamide; phosphine selenide compounds such as triphenylphosphine selenide and pentafluorophenyl-triphenylphosphine selenide; selenophosphate compounds such as tri-p-tolylselenophosphate and tri-n-butylselenophosphate; selenoketone compounds such as selenobenzophenone; isoselenocyanate compounds; selenocarboxylic acid compounds; selenoester compounds; and diacylselenide compounds. Further, the non-unstable selenium compounds such as selenious acid, selenocyanate compounds, selenazole compounds, and selenide compounds described in JP-B Nos. 46-4553 and 52-34492 may be used in the selenium sensitization methods. Particularly preferred among them are phosphine selenide compounds, selenourea compounds, and selenocyanate compounds.

Unstable tellurium compounds may be used in the tellurium sensitization methods. For example, the unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879, and 7-301880 may be used.

Specific examples of the tellurium compounds include phosphine telluride compounds such as butyl-diisopropylphosphine telluride, tributylphosphine telluride, tributoxyphosphine telluride, and ethoxy-diphenylphosphine telluride; diacyl (di)telluride compounds such as bis(diphenylcarbamoyl) ditelluride, bis(N-phenyl-N-methylcarbamoyl) ditelluride, bis(N-phenyl-N-methylcarbamoyl) telluride, bis(N-phenyl-N-benzylcarbamoyl) telluride, and bis(ethoxycarbonyl) telluride; tellurourea compounds such as N,N'-dimethylethylene tellurourea and N,N'-diphenylethylene tellurourea; telluroamide compounds; and telluroester compounds. Preferred among them are diacyl (di)telluride compounds and phosphine telluride compounds, and more preferred are the compounds described in references of JP-A No. 11-65021 paragraph 0030 and the compounds represented by the formula (II), (III), or (IV) described in JP-A No. 5-313284.

In the invention, the selenium sensitization methods and the tellurium sensitization methods are preferred among the chalcogen sensitization methods, and the tellurium sensitization methods are particularly preferred.

The gold sensitizers described in P. Grafkides, *Chimie et Physique Photographique* (Paul Momtel, 1987, 5th edition) and *Research Disclosure*, Vol. 307, No. 307105 may be used in the gold sensitization methods. Specific examples of the gold sensitizers include chlorauric acid, potassium chloroaurate, potassium aurithiocyanate, gold sulfide, and gold selenide. In addition, the gold compounds described in U.S. Pat. Nos. 2,642,361, 5,049,484, 5,049,485, 5,169,751, and 5,252,455, Belgian Patent No. 691857 may be used in the gold sensitization methods. Further, the salts of noble metals other than gold such as platinum, palladium, and iridium described in P. Grafkides, *Chimie et Physique photographique* (Paul Momtel, 1987, 5th edition) and *Research Disclosure*, Vol. 307, No. 307105 may be used for sensitization.

The gold sensitization may be carried out singly. However, the gold sensitization is preferably carried out in combination with the chalcogen sensitization. Specific examples of the combination sensitization include gold-sulfur sensitization, gold-selenium sensitization, gold-tellurium sensitization, gold-sulfur-selenium sensitization, gold-sulfur-tellurium sensitization, gold-selenium-tellurium sensitization, and gold-sulfur-selenium-tellurium sensitization.

In the invention, the chemical sensitization may be carried out in any step between the completion of grain formation and the initiation of the application. For example, the chemical sensitization may be carried out (1) before the spectral sensitization step, (2) during the spectral sensitization step, (3) after the spectral sensitization step, or (4) immediately before the application step. All of the periods are posterior to the desalination step.

The amount of the chalcogen sensitizer varies depending on the type of the silver halide grains, chemical ripening conditions, and the like. The amount of the chalcogen sensitizer may be approximately $10^{-8}$ to $10^{-1}$ mol per 1 mol of the silver halide, preferably $10^{-7}$ to $10^{-2}$ mol per 1 mol of the silver halide.

The amount of the gold sensitizer varies depending on various factors. The amount of the gold sensitizer may be $10^{-7}$ to $10^{-2}$ mol per 1 mol of the silver halide, preferably $10^{-6}$ to $5\times10^{-3}$ mol per 1 mol of the silver halide. There are no restrictions on the conditions for chemically sensitization of the silver halide emulsion. The pAg value may be 8 or lower, preferably 7.0 or lower, more preferably 6.5 or lower, particularly preferably 6.0 or lower, and may be 1.5 or higher, preferably 2.0 or higher, particularly preferably 2.5 or higher. The pH value may be 3 to 10, preferably 4 to 9, and the temperature may be 20 to 95° C., preferably 25 to 80° C.

In the invention, the photosensitive silver halide grains may be subjected to reduction sensitization in addition to the chalcogen sensitization or the gold sensitization or both. The reduction sensitization is preferably carried out in combination with the chalcogen sensitization. Ascorbic acid, thiourea dioxide, or dimethylaminoborane is preferably used as the reduction sensitizer, and stannous chloride, aminoiminomethanesulfonic acid, a hydrazine derivative, a borane compound, a silane compound, or a polyamine compound is preferably used. The reduction sensitizer may be added in any step between the crystal growth step and the initiation of the application step. The reduction sensitization is preferably conducted by ripening the emulsion while keeping the pH of the emulsion at or higher than 8 or keeping the pAg of the emulsion at or lower than 4. The reduction sensitization is preferably conducted also by introducing a single addition part of silver ion during the grain formation step.

The amount of the reduction sensitizer varies depending on factors. The amount is preferably $10^{-7}$ to $10^{-1}$ mol per 1 mol of the silver halide, more preferably $10^{-6}$ to $5\times10^{-2}$ mol, per 1 mol of the silver halide.

A thiosulfonic acid compound may be added to the silver halide emulsion used in the invention by the method described in EP-A No. 293,917.

The photosensitive silver halide grains are preferably chemically sensitized by at least one of the gold sensitization methods and the chalcogen sensitization methods because the sensitization improves the sensitivity of the photothermographic material.

11) Sensitizing Dye

A sensitizing dye usable in the invention is a dye that can spectrally sensitize the silver halide grains in a desired wavelength range when adsorbed by the grains. The sensitizing dyes having a spectral sensitivity suitable for spectral characteristics of exposure light sources may advantageously be used in the invention. The photothermographic material of the invention may be spectrally sensitized so as to have a spectral sensitivity peak preferably within a range of 600 to 900 nm or 300 to 500 nm. The sensitizing dyes and methods for adding them are described in JP-A No. 11-65021, paragraphs 0103 to 0109; JP-A No. 10-186572 (the compounds represented by the formula (II)); JP-A No. 11-119374 (the dyes represented by the formula (I) and paragraph 0106); U.S. Pat. No. 5,510,236; U.S. Pat. No. 3,871,887 (the dyes described in Example 5); JP-A No. 2-96131; JP-A No. 59-48753 (the dyes disclosed therein); EP 0803764A1, page 19, line 38 to page 20, line 35; JP-A Nos. 2001-272747, 2001-290238, and 2002-023306. These sensitizing dyes may be used singly or in combination.

In the invention, the amount of the sensitizing dye added is preferably $10^{-6}$ to 1 mol per 1 mol of the silver halide in the image-forming layer, more preferably $10^{-4}$ to $10^{-1}$ mol per 1 mol of the silver halide in the image-forming layer, although the amount may be selected depending on the sensitivity and the fogging properties.

A super-sensitizer may be used to increase the spectral sensitization efficiency in the invention. Examples of the super-sensitizers usable in the invention include the compounds described EP-A No. 587,338, U.S. Pat. Nos. 3,877,943 and 4,873,184, JP-A Nos. 5-341432, 11-109547, and 10-111543.

12) Combination of Silver Halide Grains

In the photothermographic material of the invention, one kind of the photosensitive silver halide emulsion may be used, or two or more emulsions may be used in combination. Such emulsions may differ in average grain sizes, halogen compositions, crystal habits, or chemical sensitization conditions. The gradation can be controlled by using a plurality of photosensitive silver halide emulsions having different sensitivities. The related techniques are described in JP-A Nos. 57-119341, 53-106125, 47-3929, 48-55730, 46-5187, 50-73627, and 57-150841. The sensitivity difference between the emulsions is preferably 0.2 log E or larger.

13) Mixing of Silver Halide and Organic Silver Salt

The photosensitive silver halide grains are particularly preferably prepared and chemically sensitized in the absence of the non-photosensitive organic silver salt because the silver halide grains prepared by adding a halogenating agent to an organic silver salt occasionally show insufficient sensitivity.

The photosensitive silver halide grains may be mixed with the organic silver salt by a method in which the silver halide grains and the organic silver salt are separately prepared and then mixed by a high-speed stirrer, a ball mill, a sand mill, a colloid mill, a vibrating mill, a homogenizer or the like, or by a method in which the prepared photosensitive silver halide grains are added during the preparation of the organic silver salt then the preparation of the organic silver salt is completed. The effects of the invention can be sufficiently obtained by either method.

14) Addition of Silver Halide to Coating Solution

In the invention, the silver halide is added to the coating solution for the image-forming layer preferably during the period between 180 minutes before the application of the coating solution and immediately before the application, more preferably during the period between 60 minutes before the application and 10 seconds before the application. There are no particular restrictions on the methods and conditions of the addition as long as the advantageous effects of the invention can be sufficiently obtained. Specific examples of the mixing method include a mixing method in a tank, so as to obtain a desired average stay time calculated from an addition flow rate and a liquid supply rate to a coater, and a method of using a static mixer described, for example, in N. Harnby and M. F. Edwards and A. W. Nienow, "Ekitai Kongou Gijutsu" (Liquid mixing technology), translated by Koji Takahashi and published by Nikkan Kogyo Shimbun, 1989, Chapter 8.

(Organic Silver Salt)

1) Composition

The organic silver salt usable in the invention is any silver salt that is relatively stable to light but functions as a silver ion supplying substance when heated to 80° C. or higher in the presence of a photosensitive silver halide that has been exposed and a reducing agent, thereby forming a silver image. The organic silver salt can be an arbitrary organic substance that can be reduced by the reducing agent and can supply silver ions. Such a non-photosensitive organic silver salt is described for example in JP-A No. 10-62899, paragraphs 0048–0049, EP-A No. 0803764A1, page 18, line 24 to page 19, line 37, EP-A No. 0962812A1, and JP-A Nos. 11-349591, 2000-7683 and 2000-72711. A silver salt of an organic acid is preferable and a silver salt of a long-chain aliphatic carboxylic acid (with 10 to 30 carbon atoms, preferably 15 to 28 carbon atoms) is particularly preferable. Preferred examples of the fatty acid silver salt include silver lignoserate, silver behenate, silver arachidate, silver stearate, silver oleate, silver laurate, silver caproate, silver myristate, silver palmitate, silver erucate and a mixture thereof. In the invention, among these fatty acid silver salts, it is preferable to use an fatty acid silver salt having a silver behenate content of 50 mol % to 100 mol %, more preferably 85 mol % to 100 mol % and further preferably 95 mol % to 100 mol %. Further, the content of silver erucate in the fatty acid silver salts is preferably 2 mol % or less, more preferably 1 mol % or less, further preferably 0.1 mol % or less.

Further, the content of silver stearate is preferably 1 mol % or less in order to achieve a low Dmin, high sensitivity, and excellent image storability. The content of silver stearate is more preferably 0.5 mol % or less. Particularly preferably, substantially no silver stearate should be contained.

If the photothermographic material contains silver arachidate as the organic silver salt, the content of silver arachidate is preferably 6 mol % or less in order to achieve a low Dmin and excellent image storability. The content of silver arachidate is more preferably 3 mol % or less.

2) Shape

A shape of the organic silver salt employable in the invention is not particularly restricted, and may have an acicular shape, a rod shape, a flat shape or a scale shape.

In the invention, an organic silver salt of scale shape is preferable. Preferable examples of the shape includes a short acicular form, a rectangular parallelepiped or cubic particle or a potato-like amorphous shape each of which has a ratio of its longer axis to its shorter axis of 5 or lower. Organic silver grains with these shapes have an advantage of a lower fog level at the heat development in comparison with a grain of a long acicular shape having a ratio of its longer axis to its shorter axis equal to or larger than 5. In particular, a grain with a ratio of its longer axis to its shorter axis of 3 or lower is preferable because of an improved mechanical stability of the coated film. In the present specification, the organic silver salt of scale shape is defined in the following manner. The organic silver salt is observed under an electron microscope, and the grain shape is approximated by a rectangular parallelepiped with sides a, b and c in the increasing order (c may be equal to b), and following value x is determined from the smaller values a and b in the following manner:

$$x=b/a$$

The value x is determined for about 200 grains to determine the average value x(average). If the organic silver salt takes a scale shape, the relation x(average)≧1.5 is satisfied. The organic silver salt grains preferably satisfy a relation 30≧x(average)≧1.5, more preferably 15≧x(average)≧1.5. For reference, an acicular shape is defined by 1≦x(average) <1.5.

In a scale-shaped grain, the value "a" can be regarded as the thickness of the flat grain having a principal plane defined by sides b and c. The average of the value "a" is preferably within a range from 0.01 to 0.3 μm, more preferably from 0.1 to 0.23 μm. Also the average of c/b is preferably within a range from 1 to 6, more preferably 1 to 4, further preferably from 1 to 3.

When the sphere-equivalent diameters of the organic silver salt grains are 0.05 to 1 μm, the grains hardly aggregate in the photosensitive material, resulting in the excellent image storability. The sphere-equivalent diameter is preferably 0.1 to 1 μm. In the invention, the sphere-equivalent diameter is measured by directly photographing a sample using an electron microscope and image-processing the negative.

The aspect ratio of the grains is defined as the value of sphere-equivalent diameter/a. The aspect ratios of the flaky grains is preferably 1.1 to 30, more preferably 1.1 to 15, in order to prevent the aggregation of the grains in the photosensitive material and to improve the image storability.

The grain size distribution of the organic silver salt is preferably monodispersed. Being Monodispersed means that the percentage of the standard deviation of each length of the shorter axis and longer axis, divided respectively by the shorter axis and the longer axis, is preferably 100% or less, more preferably 80% or less and further preferably 50% or less. The shape of the organic silver salt can be determined from a transmission electron microscope image of an organic silver salt dispersion. The monodispersion property can also be measured by determining a standard deviation of a volume-weighted average diameter of the organic silver salt, and the percentage (variation coefficient) of the value obtained by dividing the standard deviation of the volume-weighted average diameter by the volume-weighted average diameter is preferably 100% or less, more preferably 80% or less and further preferably 50% or less. For example, the grain size (the volume-weighted average diameter) may be measured by dispersing the organic silver salt grains in a liquid, and exposing the dispersion to a laser light to obtain an autocorrelation function of fluctuation of the scattering light to time.

3) Preparation

For manufacturing and dispersing the organic silver salt usable in the invention, a known method can be employed. For example, reference may be made to JP-A No. 10-62899, EP-A Nos. 0803763A1 and 0962812A1, JP-A Nos. 11-349591, 2000-7683 and 2000-72711, JP-A Nos. 2001-163889, 2001-163890, 2001-163827, 2001-033907, 2001-188313, 2001-083652, 2002-006442, 2002-49117, 2002-31870, and 2002-107868.

Since the presence of a photosensitive silver salt at the dispersion of the organic silver salt increases the fog level and significantly decreases the sensitivity, the photosensitive silver salt is preferably substantially absent during the dispersion. In the invention, the amount of the photosensitive silver salt in an aqueous dispersion to be dispersed is preferably 1 mol % or less per 1 mol of organic silver salt in such dispersion, more preferably 0.1 mol % or less and further preferably, photosensitive silver salt should not be added actively.

In the invention, the photosensitive material can be prepared by mixing an aqueous dispersion of the organic silver salt and an aqueous dispersion of the photosensitive silver salt. The mixing ratio of the organic silver salt to the photosensitive silver salt can be selected according to the purpose. The proportion of the photosensitive silver salt to the organic silver salt is preferably within a range of 1 to 30 mol %, more preferably 2 to 20 mol %, and particularly preferably 3 to 15 mol %. At the mixing, a method of mixing two or more aqueous dispersions of the organic silver salt and two or more aqueous dispersions of the photosensitive silver salt are preferably used in order to control the photographic characteristics.

4) Amount

The organic silver salt of the invention may be employed in a desired amount. However, the total amount of the coated silver including silver halide is preferably within a range of 0.1 to 5.0 g/m$^2$, more preferably 0.3 to 3.0 g/m$^2$, further preferably 0.5 to 2.0 g/m$^2$. Particularly, to improving the image preservability, the total amount of coated silver is preferably 1.8 g/m$^2$ or less, more preferably 1.6 g/m$^2$ or less. When the preferred reducing agent of the present invention is used, a sufficient image density can be obtained even with such a low silver amount.

(Reducing Agent)

The photothermographic material of the invention preferably includes a heat development agent, which is a reducing agent for the organic silver salt. The reducing agent for the organic silver salt may be an arbitrary substance (preferably organic substance) capable of reducing a silver ion into metallic silver. Examples of such a reducing agent are described in JP-A No. 11-65021, paragraphs 0043–0045 and EP-A No. 0803764A1, page 7, line 34 to page 18, line 12.

In the invention, the reducing agent is preferably a so-called hindered phenol reducing agent having a substituent at an ortho position of the phenolic hydroxyl group, or a bisphenol reducing agent, more preferably a compound represented by the following formula (R).

Formula (R)

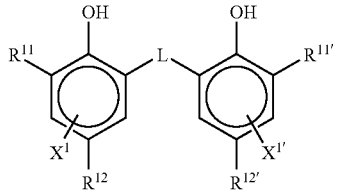

In the formula (R), $R^{11}$ and $R^{11'}$ each independently represent an alkyl group with 1 to 20 carbon atoms; $R^{12}$ and $R^{12'}$ each independently represent a hydrogen atom or a substituent that can be bonded to the benzene ring; L represents —S— or —CHR$^{13}$—; $R^{13}$ represents a hydrogen atom or an alkyl group with 1 to 20 carbon atoms; and $X^1$ and $X^{1'}$ each independently represent a hydrogen atom or a group that can be bonded to the benzene ring.

In the following, there will be given a detailed explanation on each substituent.

1) $R^{11}$ and $R^{11'}$ $R^{11}$ and $R^{11'}$ each independently represent a substituted or non-substituted alkyl group with 1 to 20 carbon atoms. The substituent on the alkyl group is not particularly limited, but is preferably an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group or a halogen atom.

2) $R^{12}$ and $R^{12'}$, $X^1$ and $X^{1'}$ $R^{12}$ and $R^{12'}$ each independently represent a hydrogen atom or a group that can be bonded to the benzene ring.

$X^1$ and $X^{1'}$ each independently represent a hydrogen atom or a group that can be bonded to the benzene ring. The group that can be bonded to the benzene ring is preferably an alkyl group, an aryl group, a halogen atom, an alkoxy group or an acylamino group.

3) L

L represents a —S— group or a —CHR$^{13}$— group. $R^{13}$ represents a hydrogen atom or an alkyl group with 1 to 20 carbon atoms, and the alkyl group may have a substituent.

Specific examples of the non-substituted alkyl group of $R^{13}$ include a methyl group, an ethyl group, a propyl group, a butyl group, a heptyl group, an undecyl group, an isopropyl group, a 1-ethylpentyl group, a 2,4,4-trimethylpentyl group, a cyclohexyl group, and a 2,4-dimethyl-3-cyclohexenyl group.

Examples of the substituent on the alkyl group are similar to the examples of the substituent on $R^{11}$, and include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group and a sulfamoyl group.

4) Preferred Substituent

Each of $R^{11}$ and $R^{11'}$ is preferably a primary or secondary or tertiary alkyl group with 1 to 15 carbon atoms, and can specifically be a methyl group, an isopropyl group, a t-butyl group, a t-amyl group, a t-octyl group, a cyclohexyl group, a cyclopentyl group, a 1-methylcyclohexyl group or a 1-methylcyclopropyl group. Each of $R^{11}$ and $R^{11'}$ is more preferably an alkyl group with 1 to 4 carbon atoms, among which more preferred are a methyl group, a t-butyl group, a t-amyl group and a 1-methylcyclohexyl group and most preferred are a methyl group and a t-butyl group.

Each of $R^{12}$ and $R^{12'}$ is preferably an alkyl group with 1 to 20 carbon atoms, and can specifically be a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, or a methoxyethyl group. More preferably, it can be a methyl group, an ethyl group, a propyl group, an isopropyl group or a t-butyl group. It is particularly preferably a methyl group or an ethyl group.

Each of $X^1$ and $X^{1'}$ is preferably a hydrogen atom, a halogen atom, or an alkyl group, more preferably a hydrogen atom.

L preferably represents a —CHR$^{13}$— group.

$R^{13}$ preferably represents a hydrogen atom or an alkyl group with 1 to 15 carbon atoms. The alkyl group may be a chain alkyl group or a cyclic alkyl group, and may have a C=C bond. The alkyl group is preferably a methyl group, an ethyl group, a propyl group, an isopropyl group, a 2,4,4-trimethylpentyl group, a cyclohexyl group, a 2,4-dimethyl-3-cyclohexenyl group, or a 3,5-dimethyl-3-cyclohexenyl group. $R^{13}$ is particularly preferably a hydrogen atom, a methyl group, an ethyl group, a propyl group, an isopropyl group, or a 2,4-dimethyl-3-cyclohexenyl group.

When $R^{11}$ and $R^{11'}$ are tertiary alkyl groups and $R^{12}$ and $R^{12'}$ are methyl groups, $R^{13}$ is preferably a primary or secondary alkyl group having 1 to 8 carbon atoms such as a methyl group, an ethyl group, a propyl group, an isopropyl group, and a 2,4-dimethyl-3-cyclohexenyl group.

When $R^{11}$ and $R^{11'}$ are tertiary alkyl groups and $R^{12}$ and $R^{12'}$ are alkyl groups other than methyl, $R^{13}$ is preferably a hydrogen atom.

When $R^{11}$ and $R^{11'}$ are not tertiary alkyl groups, $R^{13}$ is preferably a hydrogen atom or a secondary alkyl group, particularly preferably a secondary alkyl group. The secondary alkyl group represented by $R^{13}$ is preferably an isopropyl group or a 2,4-dimethyl-3-cyclohexenyl group.

The heat developing properties of the reducing agent, the tone of the developed silver, and the like vary depending on the combination of $R^{11}$, $R^{11'}$, $R^{12}$, $R^{12'}$ and $R^{13}$. The heat developing properties and the tone can be controlled by combining two or more reducing agents. Therefore, a plurality of reducing agents are preferably used in combination depending on the purpose.

Specific examples of the reducing agents usable in the invention including the compounds represented by the formula (R) are illustrated below. However, the scope of the invention is by no means restricted by these examples.

(R-1)

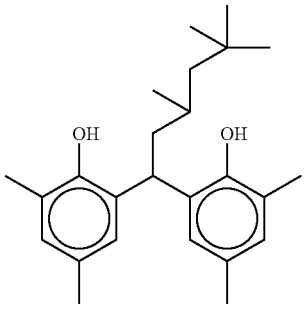

(R-2)

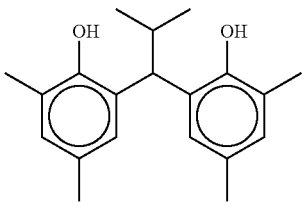

(R-3)

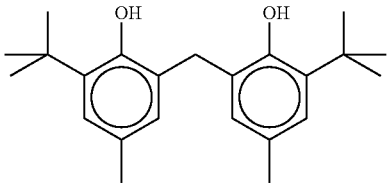

(R-4)

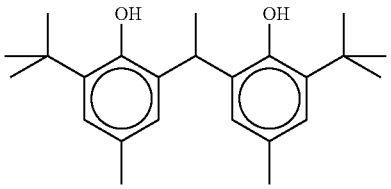

-continued (R-5)

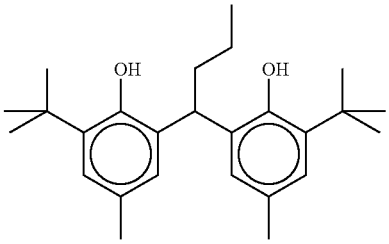

(R-6)

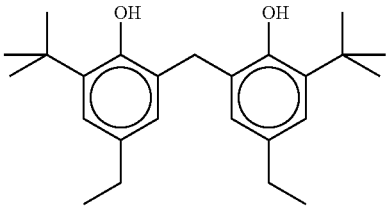

(R-7)

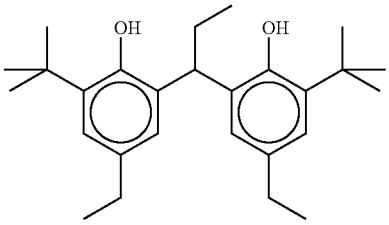

(R-8)

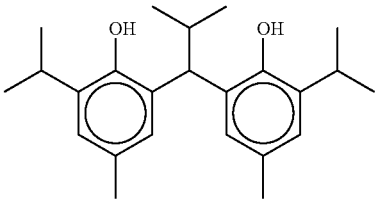

(R-9)

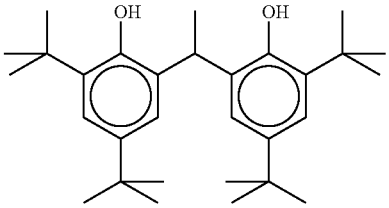

(R-10)

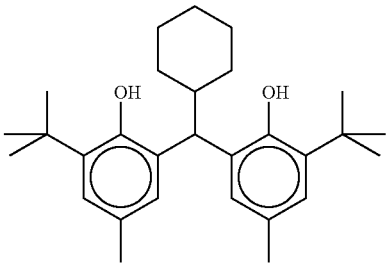

(R-11)

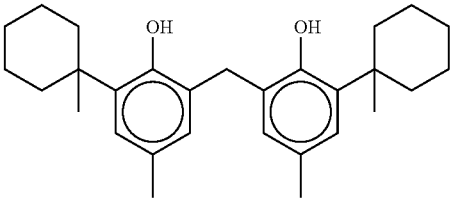

-continued (R-12)

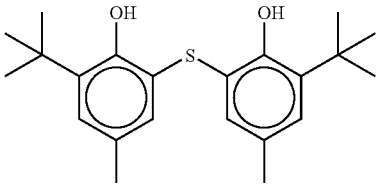

(R-13)

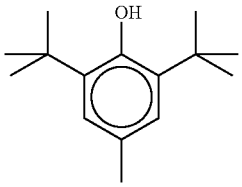

(R-14)

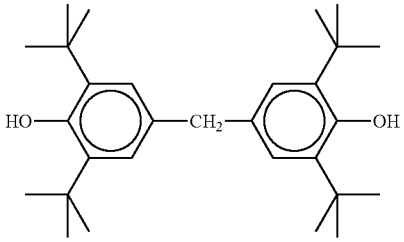

(R-15)

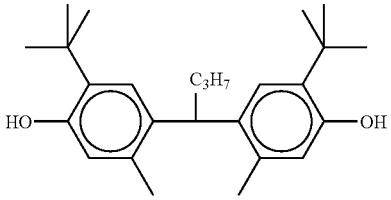

(R-16)

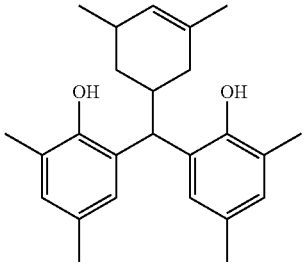

(R-17)

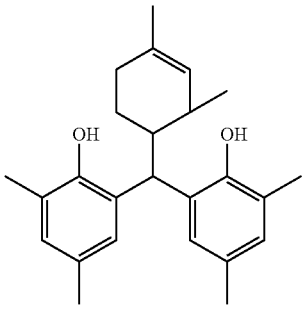

-continued (R-18)

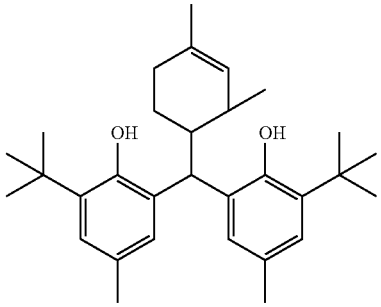

The preferable reducing agents include compounds described in JP-A Nos. 2001-188314, 2001-209145, 2001-350235, and 2002-156727, and EP 1278101A2, in addition to the above compounds.

The amount of the reducing agent is preferably 0.1 to 3.0 g/m$^2$, more preferably 0.2 to 2.0 g/m$^2$, furthermore preferably 0.3 to 1.0 g/m$^2$. Further, the mole ratio of the reducing agent to the silver in the image-forming layer side is preferably 5 to 50 mol %, more preferably 8 to 30 mol %, further preferably 10 to 20 mol %. The reducing agent is contained preferably in the image-forming layer.

The reducing agent may be added to the coating solution in any state such as a solution, an emulsified dispersion, or a solid grain dispersion.

The emulsified dispersion of the reducing agent may be prepared by a well-known emulsification and dispersion method in which the reducing agent is dissolved using an oil such as dibutyl phthalate, tricresyl phosphate, dioctyl sebacate, and tri(2-ethylhexyl)phosphate, and a cosolvent such as ethyl acetate and cyclohexanone, and mechanically emulsified and dispersed with a surfactant such as sodium dodecylbenzene sulfonate, sodium oleoyl-N-methyltaurinate, or sodium di(2-ethylhexyl)sulfosuccinate. In the method, a polymer such as α-methylstyrene oligomer or poly(t-butylacrylamide) is preferably added to the dispersion to control the viscosity or the refractive index of the oil droplets.

The solid grain dispersion may be prepared by dispersing powder of the reducing agent in an appropriate solvent such as water by a ball mill, a colloid mill, a vibration ball mill, a sand mill, a jet mill, a roll mill, or ultrasonic wave. A protective colloid (e.g. polyvinyl alcohol) or a surfactant such as an anionic surfactant (e.g. a mixture of sodium triisopropylnaphthalene sulfonates each having three isopropyl groups in different positions) may be used in the preparation. Beads made of, for example, zirconia are generally used as a dispersion medium in the above mills, and a component of the beads such as Zr is eluted from the beads and mixed with the dispersion in some cases. The amount of the eluted and mixed component depends on the dispersion conditions, and is generally within the range of 1 to 1,000 ppm. When the Zr content of the photothermographic material is 0.5 mg or less per 1 g of silver, there are no practical difficulties.

An antiseptic agent such as a benzoisothiazolinone sodium salt is preferably added to the aqueous dispersion.

The reducing agent is preferably used in the state of the solid grain dispersion. The reducing agent is preferably added as fine grains having an average grain size of 0.01 to 10 μm. The average grain size is preferably 0.05 to 5 μm, more preferably 0.1 to 2 μm. Also in the other solid dispersions used in the invention, the grains preferably have such a grain size.

(Development Accelerator)

The photothermographic material of the invention preferably includes a development accelerator, and preferred examples of the development accelerator include the sulfonamidephenol compounds represented by the formula (A) described in JP-A Nos. 2000-267222 and 2000-330234; the hindered phenol compounds represented by the formula (II) described in JP-A No. 2001-92075; the hydrazine compounds represented by the formula (I) described in JP-A Nos. 10-62895 and 11-15116, the formula (D) described in JP-A No. 2002-156727, or the formula (1) described in JP-A No. 2002-278017; and phenol compounds and the naphthol compounds represented by the formula (2) described in JP-A No. 2001-264929. The examples further include the phenol compounds described in JP-A Nos. 2002-311533 and JP-A No. 2002-341484. The development accelerator is particularly preferably a naphthol compound described in JP-A No. 2003-66558. The mole ratio of the development accelerator to the reducing agent is 0.1 to 20 mol %, preferably 0.5 to 10 mol %, more preferably 1 to 5 mol %. The development accelerator may be added to the photothermographic material in the same manner as the reducing agent. The development accelerator is particularly preferably added as a solid dispersion or an emulsified dispersion. The emulsified dispersion of the development accelerator is preferably an emulsified dispersion in a high-boiling-point solvent that is solid at the ordinary temperature with a low-boiling-point auxiliary solvent, or a so-called oilless emulsified dispersion without high-boiling-point solvents.

In the invention, the hydrazine compounds described in JP-A Nos. 2002-156727 and 2002-278017, and the naphthol compounds described in JP-A No. 2003-66558 are more preferable development accelerators.

The development accelerator used in the invention is particularly preferably represented by the following formula (A-1) or (A-2).

$$Q_1\text{-NHNH-}Q_2 \qquad \text{Formula (A-1)}$$

In the formula (A-1), $Q_1$ represents a heterocyclic group or an aromatic group having a carbon atom which is bonded to the —NHNH-$Q_2$ group, and $Q_2$ represents a carbamoyl group, an acyl group, an alkoxycarbonyl group, an aryloxycarbonyl group, a sulfonyl group, or a sulfamoyl group.

In the formula (A-1), the aromatic group and the heterocyclic group represented by $Q_1$ preferably has a 5- to 7-membered unsaturated ring. Preferred examples of the 5- to 7-membered unsaturated ring include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring, a thiophene ring, and condensed rings which comprise rings selected from the above examples condensed to each other.

These rings may have a substituent. The rings may have 2 or more substituents which may be the same as one another or different from one another. Examples of the substituent include halogen atoms, alkyl groups, aryl groups, carbonamide groups, alkylsulfonamide groups, arylsulfonamide groups, alkoxy groups, aryloxy groups, alkylthio groups, arylthio groups, carbamoyl groups, sulfamoyl groups, a cyano group, alkylsulfonyl groups, arylsulfonyl groups, alkoxycarbonyl groups, aryloxycarbonyl groups, and acyl groups. These substituents may further have a substituent, and preferred examples thereof include halogen atoms, alkyl groups, aryl groups, carbonamide groups, alkylsulfonamide groups, arylsulfonamide groups, alkoxy groups, aryloxy groups, alkylthio groups, arylthio groups, acyl groups, alkoxycarbonyl groups, aryloxycarbonyl groups, carbamoyl groups, a cyano group, sulfamoyl groups, alkylsulfonyl groups, arylsulfonyl groups, and acyloxy groups.

The carbamoyl group represented by $Q_2$ preferably has 1 to 50 carbon atoms, and more preferably has 6 to 40 carbon atoms. Examples of the carbamoyl groups include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl) carbamoyl, N-octadecylcarbamoyl, N-{3-(2,4-tert-pentylphenoxy) propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl)carbamoyl, N-naphtylcarbamoyl, N-3 -pyridylcarbamoyl, and N-benzylcarbamoyl groups.

The acyl group represented by $Q_2$ preferably has 1 to 50 carbon atoms, and more preferably has 6 to 40 carbon atoms. Examples of the acyl groups include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl groups.

The alkoxycarbonyl group represented by $Q_2$ preferably has 2 to 50 carbon atoms, and more preferably has 6 to 40 carbon atoms. Examples of the alkoxycarbonyl groups include methoxycarbonyl, ethoxycarbonyl, isobutyloxycarbonyl, cyclohexyloxycarbonyl, dodecyloxycarbonyl, and benzyloxycarbonyl groups.

The aryloxycarbonyl group represented by $Q_2$ preferably has 7 to 50 carbon atoms, and more preferably has 7 to 40 carbon atoms. Examples of the aryloxycarbonyl groups include phenoxycarbonyl, 4-octyloxyphenoxycarbonyl, 2-hydroxymethylphenoxycarbonyl, and 4-dodecyloxyphenoxycarbonyl groups.

The sulfonyl group represented by $Q_2$ preferably has 1 to 50 carbon atoms, and more preferably has 6 to 40 carbon atoms. Examples of the sulfonyl groups include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl groups.

The sulfamoyl group represented by $Q_2$ preferably has 0 to 50 carbon atoms, and more preferably has 6 to 40 carbon atoms. Examples of the sulfamoyl groups include unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy) propyl}sulfamoyl, N-(2-chloro-5-dodecyloxycarbonylphenyl) sulfamoyl, and N-(2-tetradecyloxyphenyl)sulfamoyl groups.

The group represented by $Q_2$ may have a substituent, which may be selected from the above examples of the substituents on the 5- to 7-membered unsaturated ring represented by $Q_1$. The group represented by $Q_2$ may have 2 or more substituents, which may be the same as one another or different from one another.

Preferred embodiments of the compound represented by the formula (A-1) are described below. $Q_1$ preferably has a 5- or 6-membered unsaturated ring, and more preferably has a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isoxazole ring, or a condensed ring obtained by the condensation of any of these rings with a benzene ring or an unsaturated heterocycle. $Q_2$ is preferably a carbamoyl group, particularly preferably a carbamoyl group having a hydrogen atom on the nitrogen atom.

Formula (A-2)

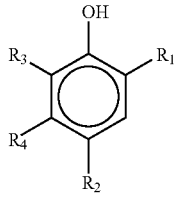

In the formula (A-2), $R_1$ represents an alkyl group, an acyl group, an acylamino group, a sulfonamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group, or a carbonic acid ester group. $R_3$ and $R_4$ each represent a substituent linkable to the benzene ring, and examples thereof may be the same as the examples of the substituent on the ring in the formula (A-1). $R_3$ and $R_4$ may be bonded to each other to form a condensed ring.

$R_1$ is preferably an alkyl group having 1 to 20 carbon atoms such as a methyl group, an ethyl group, an isopropyl group, a butyl group, a tert-octyl group, and a cyclohexyl group; an acylamino group such as an acetylamino group, a benzoylamino group, a methylureido group, and a 4-cyanophenylureido group; or a carbamoyl group such as an n-butylcarbamoyl group, an N,N-diethylcarbamoyl group, a phenylcarbamoyl group, a 2-chlorophenylcarbamoyl group, and a 2,4-dichlorophenylcarbamoyl group. More preferred as $R_1$ is an acylamino group, which may be an ureido group or an urethane group. $R_2$ is preferably a halogen atom (more preferably a chlorine atom or a bromine atom); an alkoxy group such as a methoxy group, a butoxy group, an n-hexyloxy group, an n-decyloxy group, a cyclohexyloxy group, or a benzyloxy group; or an aryloxy group such as a phenoxy group or a naphthoxy group.

$R_3$ is preferably a hydrogen atom, a halogen atom, or an alkyl group having 1 to 20 carbon atoms, most preferably a halogen atom. $R_4$ is preferably a hydrogen atom, an alkyl group, or an acylamino group, more preferably an alkyl group or an acylamino group. Preferred examples of the groups may be the same as the examples of $R_1$. When $R_4$ is an acylamino group, $R_4$ and $R_3$ are preferably bonded to each other to form a carbostyryl ring.

If $R_3$ and $R_4$ are bonded to each other to form a condensed ring in the formula (A-1), the condensed ring is particularly preferably a naphthalene ring. The naphthalene ring may have a substituent whose examples are the same as the examples of the substituent on the ring in the formula (A-1). If the compound represented by the formula (A-2) is a naphthol-based compound, $R_1$ is preferably a carbamoyl group, particularly preferably a benzoyl group. $R_2$ is preferably an alkoxy group or an aryloxy group, particularly preferably an alkoxy group.

Specific examples of the preferred development accelerators used in the invention are illustrated below without any intention of restricting the scope of the present invention.

(A-1)

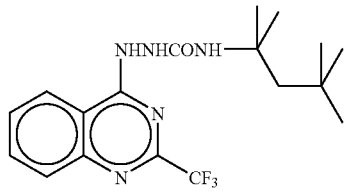

(A-2)

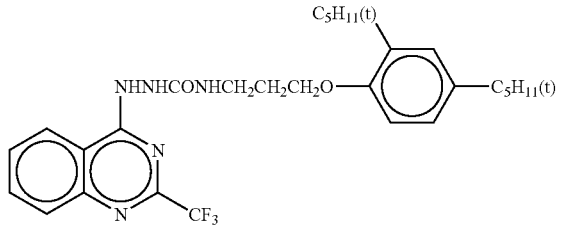

(A-3)

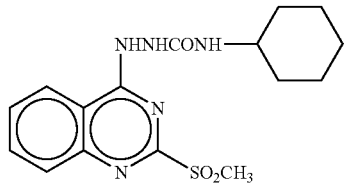

(A-4)

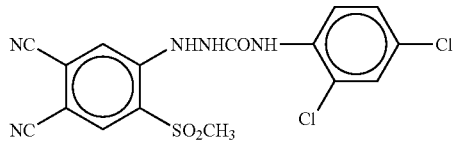

(A-5)

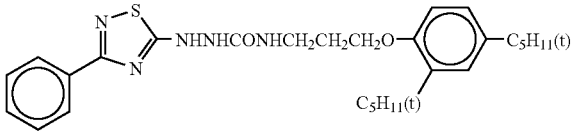

(A-6)

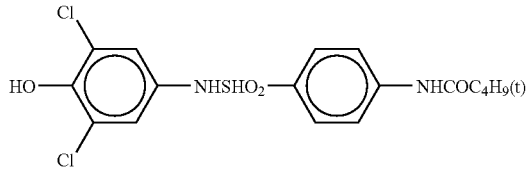

(A-7)

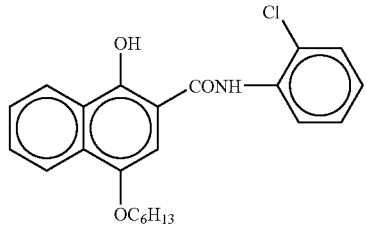

-continued (A-8)

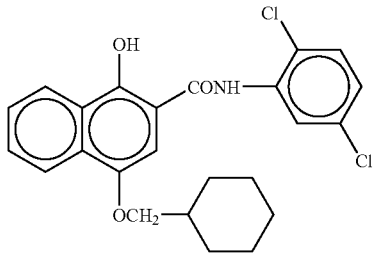

(A-9)

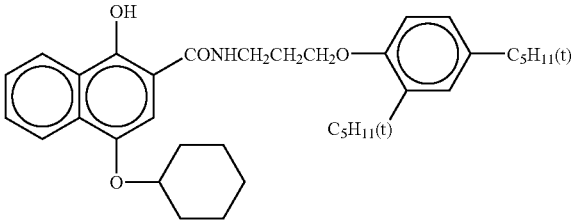

(A-10)

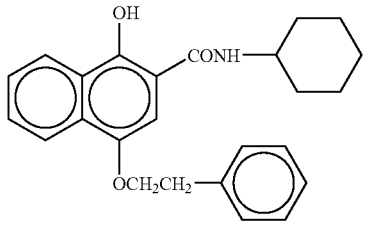

(A-11)

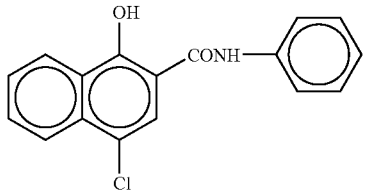

(A-12)

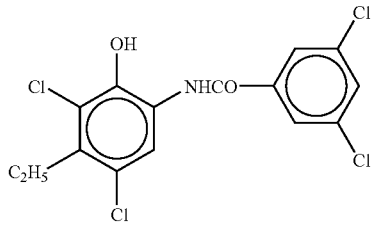

(Hydrogen Bonding Compound)

If the reducing agent has an aromatic hydroxyl group (—OH) or an amino group (—NHR in which R is a hydrogen atom or an alkyl group), particularly if the reducing agent is the above-mentioned bisphenol reducing agent, a non-reducing, hydrogen bonding compound having a group capable of forming a hydrogen bond with the hydroxyl or amino group is preferably used with the reducing agent.

Examples of the group capable of forming a hydrogen bond with the hydroxyl or amino group include phosphoryl groups, sulfoxide groups, sulfonyl groups, carbonyl groups, amide groups, ester groups, urethane groups, ureido groups, tertiary amino groups, and nitrogen-containing aromatic groups. Preferred among the groups are phosphoryl groups; sulfoxide groups; amide groups having no >N—H groups, the nitrogen atom being blocked as >N—Ra (in which Ra is a substituent other than H); urethane groups having no >N—H groups, the nitrogen atom being blocked as >N—Ra (in which Ra is a substituent other than H); and ureido group having no >N—H groups, the nitrogen atom being blocked as >N—Ra (in which Ra is a substituent other than H).

The hydrogen bonding compound used in the invention is particularly preferably represented by the following formula (D).

Formula (D)

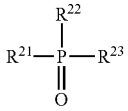

In the formula (D), $R^{21}$ to $R^{23}$ each independently represent an alkyl group, an aryl group, an alkoxy group, an aryloxy group, an amino group, or a heterocyclic group. These groups may be unsubstituted or substituted.

Examples of the substituents on the groups of $R^{21}$ to $R^{23}$ include halogen atoms, alkyl groups, aryl groups, alkoxy groups, amino groups, acyl groups, acylamino groups, alkylthio groups, arylthio groups, sulfonamide groups, acyloxy groups, oxycarbonyl groups, carbamoyl groups, sulfamoyl groups, sulfonyl groups, and phosphoryl groups. Preferred substituents are alkyl groups and aryl groups, and examples thereof include a methyl group, an ethyl group, an isopropyl group, a t-butyl group, a t-octyl group, a phenyl group, a 4-alkoxyphenyl group, and a 4-acyloxyphenyl group.

Specific examples of the alkyl groups represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, and a 2-phenoxypropyl group.

Specific examples of the aryl groups include a phenyl group, a cresyl group, a xylyl group, a naphtyl group, a 4-t-butylphenyl group, a 4-t-octylphenyl group, a 4-anisidyl group, and a 3,5-dichlorophenyl group.

Specific examples of the alkoxy groups include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, and a benzyloxy group.

Specific examples of the aryloxy groups include a phenoxy group, a cresyloxy group, an isopropylphenoxy group, a 4-t-butylphenoxy group, a naphthoxy group, and a biphenyloxy group.

Specific examples of the amino groups include a dimethylamino group, a diethylamino group, a dibutylamino group, a dioctylamino group, an N-methyl-N-hexylamino group, a dicyclohexylamino group, a diphenylamino group, and an N-methyl-N-phenylamino group.

Each of $R^{21}$ to $R^{23}$ are preferably an alkyl group, an aryl group, an alkoxy group, or an aryloxy group. In view of the effects of the invention, at least one of $R^{21}$ to $R^{23}$ is preferably an alkyl group or an aryl group, and more preferably, two or more of $R^{21}$ to $R^{23}$ are selected from alkyl groups and aryl groups. Further, $R^{21}$ to $R^{23}$ are preferably the same groups because such compounds can be obtained at lower costs.

Specific examples of the hydrogen bonding compound such as the compounds represented by the formula (D) are illustrated below. However, the scope of the present invention is by no means restricted to these examples.

(D-1)
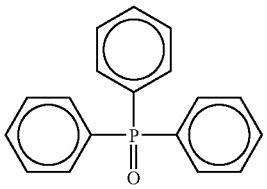
(D-2)
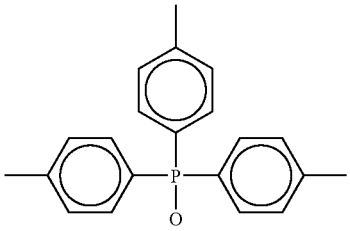
(D-3)
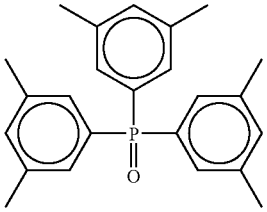
(D-4)
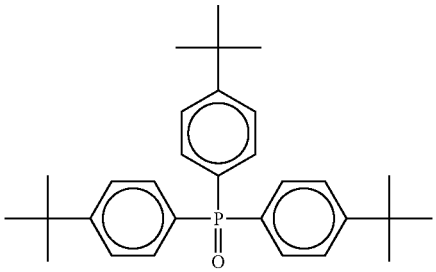
(D-5)
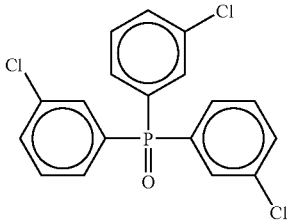
(D-6)
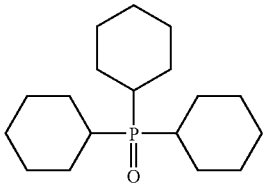
(D-7)
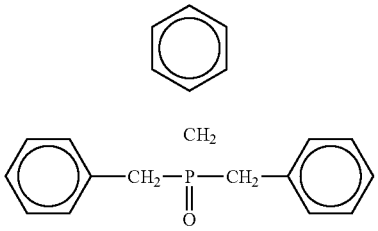
-continued
(D-8)
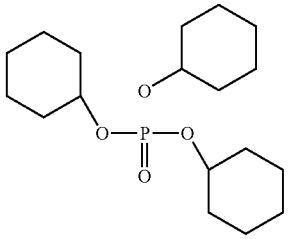
(D-9)
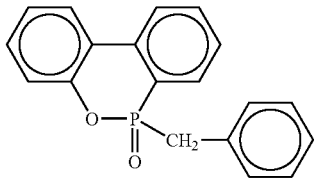
(D-10)
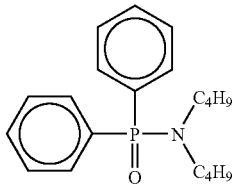
(D-11)
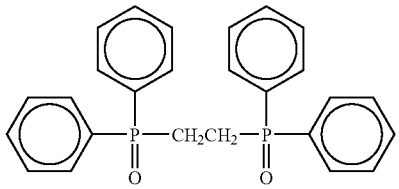
(D-12)
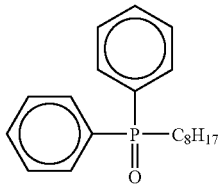
(D-13)
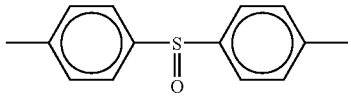
(D-14)
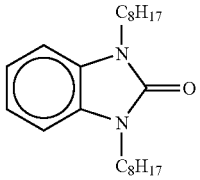
(D-15)
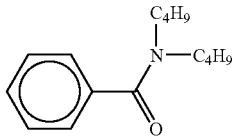
Specific examples of the hydrogen bonding compound further include the compounds described in EP No. 1096310, and JP-A Nos. 2002-156727 and 2002-318431.
The compound represented by the formula (D) may be added to the coating solution in a state of a solution, an emulsified dispersion, or a solid grain dispersion, in the same manner as the reducing agent. The compound is preferably used in a form of a solid dispersion. The hydrogen bonding compound forms a hydrogen bond complex with the reducing agent having a phenolic hydroxyl or amino group in the solution. The complex can be isolated as a crystal depending on the combination of the reducing agent and the compound represented by the formula (D).

Particularly preferably, powder of the isolated crystal is used as a solid grain dispersion to achieve the stable performances. Also preferably, powder of the reducing agent and powder of the compound of the formula (D) are mixed and dispersed with a dispersing agent by a dispersing device such as a sand grinder mill thereby forming the complex in the dispersion step.

The mole ratio of the compound represented by the formula (D) to the reducing agent is preferably 1 to 200 mol %, more preferably 10 to 150 mol %, further preferably 20 to 100 mol %.

(Binder)

The binder for the organic silver salt including layer may be any polymer. The binder is preferably transparent or translucent, and generally colorless. The binder may be a natural resin, a natural polymer, a natural copolymer, a synthetic resin, a synthetic polymer, a synthetic copolymer, or another film-forming medium. Specific examples thereof include gelatins, rubbers, poly(vinylalcohol)s, hydroxyethyl celluloses, cellulose acetates, cellulose acetate butyrates, poly(vinylpyrrolidone)s, caseins, starches, poly(acrylic acid)s, poly(methylmethacrylic acid)s, poly(vinylchloride)s, poly(methacrylic acid)s, styrene-maleic anhydride copolymers, styrene-acrylonitrile copolymers, styrene-butadiene copolymers, poly(vinylacetal)s (e.g. poly(vinylformal)s and poly(vinylbutyral)s), polyesters, polyurethanes, phenoxy resins, poly(vinylidene chloride)s, polyepoxides, polycarbonates, poly(vinylacetate)s, polyolefins, cellulose esters, and polyamides. The binder coat may be formed by using the binder in a form of an aqueous solution, a solution in an organic solvent, or an emulsion.

The glass-transition temperature (Tg) of the binder for the organic silver salt including layer is preferably 0 to 80° C. (hereinafter referred to as a high-Tg binder), more preferably 10 to 70° C., further preferably 15 to 60° C.

In the invention, Tg is calculated following the equation $1/Tg=\Sigma(Xi/Tgi)$.

Here a polymer is formed by copolymerization of n monomers of i=1 to n. Xi is the weight fraction of the ith monomer ($\Sigma Xi=1$), and Tgi is the glass-transition temperature (absolute temperature) of the homopolymer of the ith monomer. $\Sigma(Xi/Tgi)$ is the sum of Xi/Tgi for i=1 to n. The glass-transition temperature Tgi of the homopolymer of each monomer is the temperature described in J. Brandrup and E. H. Immergut, *Polymer Handbook, 3rd Edition* (Wiley-Interscience, 1989).

Two or more binders may be used if necessary. Further, a binder having a glass-transition temperature of 20° C. or higher and a binder having a glass-transition temperature of less than 20° C. may be used in combination. In the case of using a blend of a plurality of polymers having different Tg, the weight average Tg of the blend is preferably within the above range.

In the invention, the organic silver salt including layer is formed preferably by applying and drying a coating solution comprising a solvent containing 30% or more by mass of water.

If the organic silver salt including layer is formed by using the coating solution comprising a solvent containing 30% or more by mass of water, or if the binder for the layer is soluble or dispersible in an aqueous solvent, of if the binder comprises a polymer latex having an equilibrium moisture content of 2% by mass or less under the conditions of 25° C. and 60% RH, the effect of the invention is more effectively produced. According to the most preferred embodiment, the binder has an ionic conductivity of 2.5 mS/cm or lower. The binder having such an ionic conductivity may be prepared by using a separation membrane to purify a synthesized polymer.

The above aqueous solvent, in which the binder can be soluble or dispersible, is water or a mixed solvent of water and 70% by mass or less of a water-miscible organic solvent. Examples of the water-miscible organic solvent include alcohol solvents such as methyl alcohol, ethyl alcohol, and propyl alcohol; cellosolve solvents such as methyl cellosolve, ethyl cellosolve, and butyl cellosolve; ethyl acetate; and dimethylformamide.

It should be noted that the term "aqueous solvent" is used also in the case where the polymer is thermodynamically not dissolved and present in a so-called dispersed state.

The equilibrium moisture content under the conditions of 25° C. and 60% RH can be represented by the following equation:

$$\text{Equilibrium moisture content under the conditions of } 25^\circ C. \text{ and } 60\% RH=\{(W1-W0)/W0\}\times 100(\%\text{ by mass}),$$

in which W1 is a weight of a polymer in equilibrium under the humidity controlled atmosphere of 25° C. and 60% RH, and W0 is a weight of the polymer in the absolute dry state at 25° C.

The definition and measuring methods of the moisture content is described, for example, in *Kobunshi Kogaku Koza 14, Kobunshi Zairyo Shikenho*, edited by The Society of Polymer Science, Japan, Chijin Shokan Co., Ltd.

The equilibrium moisture content under the conditions of 25° C. and 60% RH of the binder polymer used in the invention is preferably 2% by mass or less, more preferably 0.01 to 1.5% by mass, further preferably 0.02 to 1% by mass.

In the invention, the polymer dispersible in the aqueous solvent is particularly preferably used for the binder. The dispersion state of the polymer may the state in which fine grains of a water-insoluble hydrophobic polymer are dispersed to form a latex, or the state in which polymer molecules in molecular or micell state are dispersed. The latex dispersion is more preferably used in the invention. The average grain diameter of the dispersed grains is 1 to 50,000 nm, preferably 5 to 1,000 nm, more preferably 10 to 500 nm, and furthermore preferably 50 to 200 nm. The grain size distribution of the dispersed grains is not particularly limited, and may be a wide or monodispersed distribution. It is preferable that two or more kinds of grains having monodisperse distributions are mixed and used to control the physical properties of the coating solution.

Preferred examples of the polymers that can be dispersed in the aqueous solvent include hydrophobic polymers such as acrylic polymers, polyesters, rubbers (e.g. SBR resins), polyurethanes, poly(vinylchloride)s, poly(vinylacetate)s, poly(vinylidenechloride)s, and polyolefins. The polymer may be a linear, branched or cross-linked polymer. The polymer may be a homopolymer comprising only one monomer or a copolymer comprising plural types of monomers. The copolymer may be a random copolymer or a block copolymer. The number-average molecular weight of the polymer is preferably 5,000 to 1,000,000, more preferably 10,000 to 200,000. When the number-average molecular weight is too low, the image-forming layer tends to have insufficient strength. On the other hand, when it is too high, the film-forming properties are poor. Cross-linked polymer latexes are particularly preferably used.

<Specific Examples of Latex>

Specific examples of the polymer latexes preferable in the invention are described below. In the examples, the polymers are represented by the starting monomers, the numerals in parentheses represent the mass ratios (% by mass) of the monomers, and the molecular weights represent number-average molecular weights. The polymers including multifunctional monomers have cross-linked structures and the concept of the molecular weight cannot be applied, whereby such polymers are referred to as cross-linked polymers and explanation of the molecular weight is omitted. Tg's represent the glass-transition temperatures.

P-1: Latex of -MMA(70)-EA(27)-MAA(3)- (molecular weight 37,000, Tg 61° C.)

P-2: Latex of -MMA(70)-2EHA(20)-St(5)-AA(5)- (molecular weight 40,000, Tg 59° C.)

P-3: Latex of -St(50)-Bu(47)-MAA(3)- (cross-linked polymer, Tg −17° C.)

P-4: Latex of -St(68)-Bu(29)-AA(3)- (cross-linked polymer, Tg 17° C.)

P-5: Latex of -St(71)-Bu(26)-AA(3)- (cross-linked polymer, Tg 24° C.)

P-6: Latex of -St(70)-Bu(27)-IA(3)- (cross-linked polymer)

P-7: Latex of -St(75)-Bu(24)-AA(1)- (cross-linked polymer, Tg 29° C.)

P-8: Latex of -St(60)-Bu(35)-DVB(3)-MAA(2)- (cross-linked polymer)

P-9: Latex of -St(70)-Bu(25)-DVB(2)-AA(3)- (cross-linked polymer)

P-10: Latex of -VC(50)-MMA(20)-EA(20)-AN(5)-AA(5)- (molecular weight 80,000)

P-11: Latex of -VDC(85)-MMA(5)-EA(5)-MAA(5)- (molecular weight 67,000)

P-12: Latex of -Et(90)-MAA(10)- (molecular weight 12,000)

P-13: Latex of -St(70)-2EHA(27)-AA(3)- (molecular weight 130,000, Tg 43° C.)

P-14: Latex of -MMA(63)-EA(35)-AA(2)- (molecular weight 33,000, Tg 47° C.)

P-15: Latex of -St(70.5)-Bu(26.5)-AA(3)- (cross-linked polymer, Tg 23° C.)

P-16: Latex of -St(69.5)-Bu(27.5)-AA(3)- (cross-linked polymer, Tg 20.5° C.)

Abbreviations in the above examples are as follows.

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid Commercially-available polymers may be used for the polymer latex, and examples thereof include acrylic polymers such as CEBIAN A-4635, 4718, and 4601 (available from Daicel Chemical Industries, Ltd.) and Nipol Lx811, 814, 821, 820, and 857 (available from Nippon Zeon Co., Ltd.); polyesters such as FINETEX ES650, 611, 675, and 850 (available from Dainippon Ink and Chemicals, Inc.) and WD-size and WMS (available from Eastman Chemical Co.); polyurethanes such as HYDRAN AP10, 20, 30, and 40 (available from Dainippon Ink and Chemicals, Inc.); rubbers such as LACSTAR 7310K, 3307B, 4700H, and 7132C (available from Dainippon Ink and Chemicals, Inc.) and Nipol Lx416, 410, 438C, and 2507 (available from Nippon Zeon Co., Ltd.); poly(vinylchloride)s such as G351 and G576 (available from Nippon Zeon Co., Ltd.); polyvinylidene chlorides such as L502 and L513 (available from Asahi Kasei Kogyo K. K.); and polyolefins such as CHEMIPEARL S120 and SA100 (available from Mitsui Petrochemical Industries, Ltd.).

These polymer latexes may be used alone or blended with each other in accordance with necessity.

<Preferable Latex>

The polymer latex used in the invention is particularly preferably a latex of a styrene-butadiene copolymer. In the styrene-butadiene copolymer, the weight ratio of the styrene monomer units to the butadiene monomer units is preferably 40/60 to 95/5. The total proportion of the styrene monomer units and the butadiene monomer units in the copolymer is preferably 60 to 99% by mass. The polymer latex preferably contains acrylic or methacrylic acid, and the mass ratio of the acrylic or methacrylic acid to the total of styrene and butadiene is preferably 1 to 6% by mass, more preferably 2 to 5% by mass. The polymer latex used in the invention preferably contains acrylic acid. The preferred range of the molecular weight of the copolymer is equal to that mentioned above.

Examples of the latexes of the styrene-butadiene copolymers preferably used in the invention include the above-described P-3 to P-8, P-15, commercially-available LACSTAR-3307B, 7132C, and Nipol Lx416.

A hydrophilic polymer such as gelatin, polyvinyl alcohol, methylcellulose, hydroxypropylcellulose, and carboxymethylcellulose may be added to the organic silver salt including layer of the photosensitive material of the invention if necessary. The mass ratio of the hydrophilic polymer to the total of the binders contained in the organic silver salt including layer is preferably 30% by mass or less, more preferably 20% by mass or less.

The organic silver salt including layer (the image-forming layer) according to the invention is preferably provided by using the polymer latex. In the organic silver salt including layer, the weight ratio of (the binders/the organic silver salt) is preferably 1/10 to 10/1, more preferably 1/3 to 5/1, further preferably 1/1 to 3/1.

The organic silver salt including layer may act as a photosensitive layer (an emulsion layer) including the photosensitive silver halide as the photosensitive silver salt, and in this case, the weight ratio of the binders/the photosensitive silver halide is 5 to 400, more preferably 10 to 200.

The total amount of the binders in the image-forming layer is preferably 0.2 to 30 g/m$^2$, more preferably 1 to 15 g/m$^2$, furthermore preferably 2 to 10 g/m$^2$. A cross-linking agent, a surfactant for improving the coating properties, etc. may be added to the image-forming layer.

<Preferable Solvent of Coating Solution>

The solvent of the coating solution for the organic silver salt including layer of the photosensitive material of the invention is preferably an aqueous solvent containing at least 30% by mass of water. The term "a solvent" used herein means a solvent or a dispersion medium or both. The aqueous solvent may include any water-miscible organic solvent such as methyl alcohol, ethyl alcohol, isopropyl alcohol, methyl cellosolve, ethyl cellosolve, dimethylformamide, and ethyl acetate. The water content of the solvent for the coating solution is preferably at least 50% by mass, more preferably at least 70% by mass. Preferable examples of the solvent composition include water, water/methyl alcohol with a ratio of 90/10, water/methyl alcohol with a ratio of 70/30, water/methyl alcohol/dimethylformamide with a ratio of 80/15/5, water/methyl alcohol/ethyl cellosolve with a ratio of 85/10/5, water/methyl alcohol/isopropyl alcohol with a ratio of 85/10/5, the numerals representing the mass ratios (% by mass).

(Antifoggant)

Examples of antifoggants, stabilizers, and stabilizer precursors usable in the invention include the compounds described in JP-A No. 10-62899, paragraph 0070 and EP 0803764A1, page 20, line 57 to page 21, line 7; the compounds described in JP-A Nos. 9-281637 and 9-329864; the compounds described in U.S. Pat. No. 6,083,681 and EP No. 1048975.

1) Polyhalogen Compound

Preferred organic polyhalogen compounds usable as the antifoggant in the invention are described below. The preferred polyhalogen compounds are represented by the following formula (H):

$$Q\text{-}(Y)_n\text{—}C(Z_1)(Z_2)X.$$

In the formula (H), Q represents an alkyl group, an aryl group, or a heterocyclic group, Y represents a divalent linking group, n represents 0 or 1, $Z_1$ and $Z_2$ each independently represent a halogen atom, and X represents a hydrogen atom or an electron-withdrawing group.

In the formula (H), Q is preferably an alkyl group having 1 to 6 carbon atoms, an aryl group having 6 to 12 carbon atoms, or a nitrogen-containing heterocyclic group containing at least one nitrogen atom such as a pyridyl group or a quinolyl group.

The aryl group represented by Q is preferably a phenyl group having an electron-withdrawing group with a positive Hammett's substituent constant σp as a substituent. The Hammett's substituent constant can be obtained with reference to *Journal of Medicinal Chemistry,* 1973, Vol. 16, No. 11, 1207–1216, etc. Examples of such electron-withdrawing groups include halogen atoms, alkyl groups having electron-withdrawing groups as substituents, aryl groups having electron-withdrawing groups as substituents, heterocyclic groups, alkyl or aryl sulfonyl group, acyl groups, alkoxycarbonyl groups, carbamoyl groups, and sulfamoyl groups. The electron-withdrawing group on the phenyl group is preferably a halogen atom, a carbamoyl group, or an arylsulfonyl group, particularly preferably a carbamoyl group.

X is preferably an electron-withdrawing group. The electron-withdrawing group of X is preferably a halogen atom, an aliphatic, aryl, or heterocyclyl sulfonyl group, an aliphatic, aryl, or heterocyclyl acyl group, an aliphatic, aryl, or heterocyclyl oxycarbonyl group, a carbamoyl group, or a sulfamoyl group, more preferably a halogen atom or a carbamoyl group, particularly preferably a bromine atom.

Each of $Z_1$ and $Z_2$ is preferably a bromine atom or an iodine atom, more preferably a bromine atom.

Y is preferably —C(═O)—, —SO—, —$SO_2$—, —C(═O)N(R)—, or —$SO_2$N(R)—, more preferably —C(═O)—, —$SO_2$—, or —C(═O)N(R)—, particularly preferably —$SO_2$— or —C(═O)N(R)—, in which R represents a hydrogen atom, an aryl group or an alkyl group. R is preferably a hydrogen atom or an alkyl group, particularly preferably a hydrogen atom.

n is 0 or 1, preferably 1.

In the formula (H), Y is preferably —C(═O)N(R)— when Q is an alkyl group, and Y is preferably —$SO_2$— when Q is an aryl group or a heterocyclic group.

A compound comprising residues bonded to one another may be preferably used if each residue is obtained by removing a hydrogen atom from a compound represented by the formula (H). The compound is generally referred to as a bis-, tris-, or tetrakis-type compound.

It is also a preferred embodiment that the compound represented by the formula (H) has, as a substituent, a dissociative group such as a COOH group or a salt thereof, an $SO_3H$ group or a salt thereof, or a $PO_3H$ group or a salt thereof; a group containing a quaternary nitrogen cation such as an ammonium group or a pyridinium group; a polyethyleneoxy group; or a hydroxyl group.

Specific examples of the compounds represented by the formula (H) are illustrated below.

(H-1)

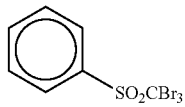

(H-2)

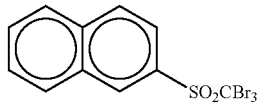

(H-3)

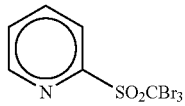

(H-4)

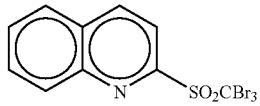

(H-5)

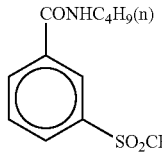

(H-6)

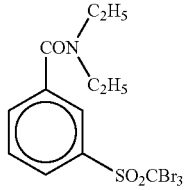

(H-7)

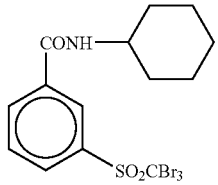

-continued (H-8)

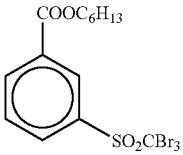

(H-9)

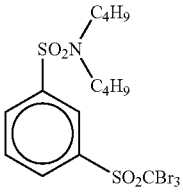

(H-10)

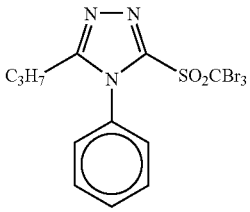

(H-11)

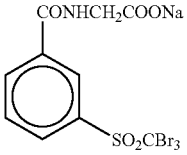

(H-12)

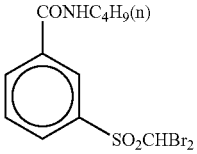

(H-13)

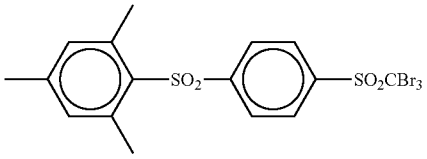

(H-14)

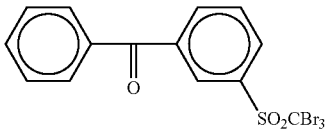

(H-15)

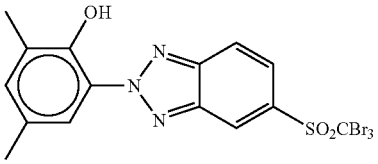

(H-16)

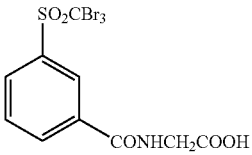

-continued (H-17)

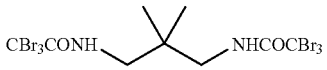

(H-18)

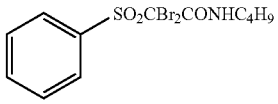

(H19)

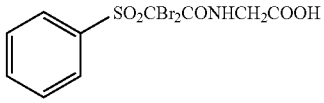

Preferable examples of the polyhalogen compounds used in the invention include the compounds described in U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178,9-160167, 9-319022,9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441, in addition to the above compounds. The compounds described in JP-A Nos. 7-2781, 2001-33911, and 2001-312027 are particularly preferred.

The amount of the compound represented by the formula (H) is preferably, per 1 mol of the non-photosensitive silver salt in the image-forming layer, $10^{-4}$ to 1 mol, more preferably $10^{-3}$ to 0.5 mol, further preferably $1\times10^{-2}$ to 0.2 mol.

The antifoggant may be added to the photosensitive material in the same manner as the reducing agent. The organic polyhalogen compound is preferably added as a solid grain dispersion.

2) Other Antifoggants

Other examples of the antifoggants include the mercury (II) salt described in JP-A No.11-65021, paragraph 0113, the benzoic acid compounds described in ibid, paragraph 0114, the salicylic acid derivatives described in JP-A No. 2000-206642, the formalin scavenger compounds represented by the formula (S) described in JP-A No. 2000-221634, the triazine compounds according to claim 9 of JP-A No.11-352624, the compounds represented by the formula (III) described in JP-A No.6-11791, and 4-hydroxy-6-methyl-1,3,3a,7-tetrazainden.

The photothermographic materials of the invention may include an azolium salt to prevent the fogging. Examples of the azolium salts include the compounds represented by the formula (XI) described in JP-A No. 59-193447; the compounds described in JP-B No. 55-12581; and the compounds represented by the formula (II) described in JP-A No. 60-153039. The azolium salt is preferably added to a layer on the photosensitive layer side of the photosensitive material, more preferably added to the organic silver salt including layer, though it may be added to any portion of the photosensitive material. The azolium salt may be added in any step of preparing the coating solution. In the case of adding the azolium salt to the organic silver salt including layer, the azolium salt may be added in any step between the preparation of the organic silver salt and the preparation of the coating solution, and is preferably added during the period from the completion of the preparation of the organic silver salt to immediately before applying the coating solution. The azolium salt may be added in any form such as powder, a solution, or a fine grain dispersion. The salt may be added also as a solution including the azolium salt as well as other additives such as the sensitizing dye, the reducing agent, and the toning agent. The amount of the azolium salt added per 1 mol of silver is preferably $1\times10^{-6}$ to 2 mol, more preferably $1\times10^{-3}$ to 0.5 mol, though it is not restricted.

(Other Additives)

1) Mercapto Compound, Disulfide Compound, and Thione Compound

The photosensitive material of the invention may contain a mercapto compound, a disulfide compound, or a thione compound, to control (inhibit or accelerate) the development, to increase the spectral sensitization efficiency, or to increase the storability before and after the development, etc. Examples of the compounds are described in JP-A No. 10-62899, paragraphs 0067 to 0069; JP-A No. 10-186572, paragraphs 0033 to 0052 (the compounds represented by the formula (I) and specific examples thereof); and EP 0803764A1, page 20, lines 36 to 56. The mercapto-substituted aromatic heterocyclic compounds such as the compounds described in JP-A Nos. 9-297367, 9-304875, 2001-100358, 2002-303954, and 2002-303951 are preferably used in the invention.

2) Toning Agent

Preferably, a toning agent is added to the photothermographic materials of the invention. Examples of the toning agent are described in JP-A No. 10-62899, paragraphs 0054 and 0055, EP 0803764A1, page 21, lines 23 to 48, and JP-A Nos. 2000-356317 and 2000-187298. Preferable examples of the toning agent include phthalazinone compounds including phthalazinone, phthalazinone derivatives, and phthalazinone metal salts, such as 4-(1-naphtyl)phthalazinone, 6-chlorophthalazinone, 5,7-dimethoxyphthalazinedione, and 2,3-dihydro-1,4-phthalazinone; combinations of phthalazinone compounds and phthalic acid compounds such as phthalic acid, 4-methylphthalic acid, 4-nitrophthalic acid, diammonium phthalate, sodium phthalate, potassium phthalate, and tetrachlorophthalic anhydride; phthalazine compounds including phthalazine, phthalazine derivatives, and phthalazine metal salts, such as 4-(1-naphtyl)phthalazine, 6-isopropylphthalazine, 6-t-butylphthalazine, 6-chlorophthalazine, 5,7-dimethoxyphthalazine, and 2,3-dihydrophthalazine; and combinations of phthalazine compounds and phthalic acid compounds. Particularly preferred are the combinations of phthalazine compounds and phthalic acid compounds, and preferred combinations include combinations of 6-isopropylphthalazine with phthalic acid or 4-methylphthalic acid.

3) Plasticizer and Lubricant

A plasticizer or a lubricant may be used in the invention to improve the physical properties of the film. It is particularly preferred that a lubricant such as a liquid paraffin, a long-chain fatty acid, a fatty acid amide, and a fatty acid ester is used to improve the handling in the production and the scratch resistance in the heat development. Particularly preferred lubricants include liquid paraffins from which low-boiling-point components are removed, and branched fatty acid esters having a molecular weight of 1,000 or more.

The plasticizers and the lubricants that can be preferably used in the photosensitive layer or the non-photosensitive layer according to the invention include the compounds described in JP-A No. 11-65021, paragraph 0117, JP-A No. 2000-5137, Japanese Patent Application Nos. 2003-8015, 2003-8071, and 2003-132815.

4) Dye and Pigment

Various kinds of dyes and pigments such as C.I. Pigment Blues 60, 64, and 15:6 may be used in the photosensitive layer in order to improve the color tone, to prevent the generation of interference fringe owing to laser exposure, and to prevent irradiation. They are described in detail in WO 98/36322, JP-A Nos. 10-268465 and 11-338098, etc.

5) Nucleating Agent

The image-forming layer of the photothermographic material of the invention preferably includes a nucleating agent (or a nucleating accelerator). The nucleating agents, the methods for adding them, and the amount of the agents are described in JP-A No. 11-223898, paragraphs 0136 to 0193; JP-A No. 2000-284399 (compounds of the formulae (H), (1) to (3), (A), and (B); and JP-A No. 2000-347345 (compounds of the formulae (III) to (V) with specific examples including Chemical Formulae 21 to 24). The nucleating accelerators are described in JP-A No. 11-65021, paragraph 0102, and JP-A No. 11-223898, paragraphs 0194 to 0195.

Formic acid or a formate salt may be used as a strong fogging agent. The formic acid or the formate salt is preferably contained on the side of the image-forming layer which includes the photosensitive silver halide, and the amount thereof is preferably 5 mmol or less, more preferably 1 mmol or less, per 1 mol of silver.

In the invention, the nucleating agent is preferably used with an acid generated by hydration of diphosphorus pentaoxide or a salt thereof. Examples of the acids generated by hydration of diphosphorus pentaoxide and the salts thereof include metaphosphoric acid, pyrophosphoric acid, orthophosphoric acid, triphosphoric acid, tetraphosphoric acid, hexametaphosphoric acid, and salts thereof. Particularly preferred are orthophosphoric acid, hexametaphosphoric acid, and salts thereof. Specific examples of the salts include sodium orthophosphate, sodium dihydrogen orthophospate, sodium hexametaphosphate, and ammonium hexametaphosphate.

The coating amount of the acid generated by hydration of diphosphorus pentaoxide or the salt thereof per 1 $m^2$ of the photosensitive material may be selected depending on the sensitivity, the fogging properties, etc., and is preferably 0.1 to 500 $mg/m^2$, more preferably 0.5 to 100 $mg/m^2$.

The reducing agent, the hydrogen bonding compound, the development accelerator, the nucleating agent, and the polyhalogen compound are preferably used in the state of a solid dispersion. The preferred methods for preparing the solid dispersions are described in JP-A No. 2002-55405.

(Preparation and Application of Coating Solution)

The coating solution for the image-forming layer is preferably prepared at a preparation temperature of 30 to 65° C. The preparation temperature is more preferably 35 to 60° C., furthermore preferably 35 to 55° C. The temperature of the coating solution for the image-forming layer is preferably kept at 30 to 65° C. immediately after the polymer latex is added.

(Layer Structure and Components)

In the invention, one or more image-forming layers are provided on the support. If one image-forming layer is provided on the support, the image-forming layer comprises the organic silver salt, the photosensitive silver halide, the reducing agent, and the binder, and optionally comprises additives such as the toning agent, the coating auxiliary, and another auxiliary agent. If two image-forming layers are provided on the support, the first image-forming layer, which is generally adjacent to the support, includes the organic silver salt and the photosensitive silver halide, and the other components are each independently included in the second image-forming layer or the both image-forming layers. In the case of using the photothermographic material of the invention as a multicolor photothermographic material, it may comprise the two layers for each color or comprise a single layer containing all the components as described in U.S. Pat. No. 4,708,928. In the multicolor photothermographic material, the emulsion layers are generally separated from one another by providing functional or non-functional barrier layers between the photosensitive layers as described in U.S. Pat. No. 4,460,681.

The photothermographic material of the invention may comprise non-photosensitive layers in addition to the image-forming layer. These non-photosensitive layers can be classified depending on the position into (a) surface protective layers disposed on the image-forming layer (on the opposite side of the support side), (b) intermediate layers disposed between a plurality of the image-forming layers or between the image-forming layer and the protective layer, (c) undercoat layers disposed between the image-forming layer and the support, and (d) back layers disposed on the opposite side of the image-forming layer side.

Further, a filter layer, which acts as an optical filter, may be formed as the layer of (a) or (b). An antihalation layer may be provided as the layer of (c) or (d) in the photosensitive material.

1) Surface Protective Layer

The photothermographic material of the invention may comprise a surface protective layer, for example in order to prevent the adhesion of the image-forming layer. The surface protective layer may have a single- or multi-layer structure.

The surface protective layer is described in JP-A No. 11-65021, paragraphs 0119 to 0120, and JP-A No. 2000-171936.

A binder in the surface protective layer is preferably a gelatin, a polyvinyl alcohol (PVA), or a combination thereof. Examples of the gelatin include inert gelatins such as Nitta Gelatin 750, and phthalated gelatins such as Nitta Gelatin 801. Examples of the PVA include ones described in JP-A No. 2000-171936, paragraphs 0009 to 0020, and preferred are completely saponified PVA-105, partially saponified PVA-205 and PVA-335, and modified polyvinyl alcohol MP-203 (trade names, Kuraray Co., Ltd.), etc. The amount of the polyvinyl alcohol added to one protective layer is preferably 0.3 to 4.0 g, more preferably 0.3 to 2.0 g, per 1 $m^2$ of the support.

The total amount of the binders including water-soluble polymers and latex polymers provided to one surface protective layer is preferably 0.3 to 5.0 g, more preferably 0.3 to 2.0 g, per 1 $m^2$ of the support.

A lubricant such as a liquid paraffin and an aliphatic ester is preferably used in the surface protective layer. The amount of the lubricant may be 1 to 200 $mg/m^2$, preferably 10 to 150 $mg/m^2$, more preferably 20 to 100 $mg/m^2$.

2) Antihalation Layer

In the photothermographic material of the invention, the antihalation layer may be provided farther from the exposure light source than the photosensitive layer.

The antihalation layer is described in JP-A No. 11-65021, paragraphs 0123 to 0124, JP-A Nos. 11-223898, 9-230531, 10-36695, 10-104779, 11-231457, 11-352625, and 11-352626, etc.

The antihalation layer includes an antihalation dye having absorption in the exposure wavelength range. If the exposure wavelength is within the infrared range, an infrared-absorbing dye may be used as the antihalation dye and preferably, the infrared-absorbing dye has no absorption in the visible light range.

In the case of using a dye having absorption in the visible light range to prevent the halation, the color of the dye should not substantially remain after the image formation. The color is preferably faded by heat during the heat development. In particular, it is preferred that a heat color fading dye and a base precursor are added to a non-photosensitive layer to form the antihalation layer. These techniques are described in JP-A No. 11-231457, etc.

The amount of the color fading dye may be determined depending on the purpose. The color fading dye is generally used so that the optical density (the absorbancy) at a desired wavelength exceeds 0.1. The optical density is preferably 0.15 to 2, more preferably 0.2 to 1. To obtain such an optical density, the amount of the color fading dye is generally 0.001 to 1 $g/m^2$.

If the dye is thus faded, the optical density can be lowered to 0.1 or less after the heat development. Two or more color fading dyes may be used in combination in a heat fading type recording material or the photothermographic material. Two or more base precursors may be used in combination similarly.

In the heat color fading, as described in JP-A No. 11-352626, the heat color fading properties are preferably improved by using the color fading dye and the base precursor with a substance that decreases the melting point of the base precursor by 3° C. or more when mixed with the base precursor. Examples of the substance include diphenylsulfone, 4-chlorophenyl(phenyl)sulfone, and 2-naphtyl benzoate.

3) Back Layer

The back layers usable in the invention are described in JP-A No. 11-65021, paragraphs 0128 to 0130.

In the invention, a coloring agent having absorption maximum within the range of 300 to 450 nm may be added to the photosensitive material to improve the color tone of silver and the image deterioration with time. The coloring agents are described in JP-A Nos. 62-210458, 63-104046, 63-103235, 63-208846, 63-306436, 63-314535, 01-61745, and 2001-100363, etc.

The amount of the coloring agent added is generally 0.1 $mg/m^2$ to 1 $g/m^2$. The coloring agent is preferably added to the back layer disposed on the opposite side of the photosensitive layer side.

A dye having an absorption peak within the range of 580 to 680 nm is preferably used to control the base color tone. Preferred examples of the dyes include the azomethine-based oil-soluble dyes having s small shorter wavelength absorption intensity described in JP-A Nos. 4-359967 and 4-359968, and the phthalocyanine-based water-soluble dyes described JP-A No. 2003-295388. The dye may be added to any layer, and is preferably added to the non-photosensitive layer on the emulsion layer side or the back layer.

The photothermographic material of the invention is preferably a so-called single-sided photosensitive material comprising at least one photosensitive layer containing the silver halide emulsion formed on one side of the support, and the back layer on the other side.

4) Matting Agent

In the invention, a matting agent is preferably added to improve the conveyability. The matting agent is described in JP-A No. 11-65021, paragraphs 0126 and 0127. The coating amount of the matting agent per 1 $m^2$ of the photosensitive material is preferably 1 to 400 mg/$m^2$, more preferably 5 to 300 mg/$m^2$.

The matting agent may be delomorphous or amorphous, and is preferably delomorphous. The matting agent is preferably in a sphere shape.

The volume-weighted average of the sphere-equivalent diameter of the matting agent provided on the emulsion surface is preferably 0.3 to 10 μm, more preferably 0.5 to 7 μm. The variation coefficient of the grain size distribution of the matting agent is preferably 5 to 80%, more preferably 20 to 80%. The variation coefficient is obtained using the equation: (standard deviation of grain diameter)/(average grain diameter)×100. Further, two or more types of the matting agent grains having different average grain sizes may be provided on the emulsion surface. In this case, the difference of the average grain sizes between the smallest matting agent grains and the largest matting agent grains is preferably 2 to 8 μm, more preferably 2 to 6 μm.

The volume-weighted average equivalent sphere diameter of the matting agent grains provided on the back surface is preferably 1 to 15 μm, more preferably 3 to 10 μm. The variation coefficient of the grain size distribution of the matting agent is preferably 3 to 50%, more preferably 5 to 30%. Further, two or more types of the matting agent grains having different average grain sizes may be provided on the back surface. In this case, the difference of the average grain sizes between the smallest matting agent grains and the largest matting agent grains is preferably 2 to 14 μm, more preferably 2 to 9 μm.

The matt degree of the emulsion surface is not limited as long as so-called star defects are not caused. The Beck smoothness of the surface is preferably 30 to 2,000 seconds, particularly preferably 40 to 1,500 seconds. The Beck smoothness can be easily obtained by *Method for testing smoothness of paper and paperboard by Beck tester* according to JIS P8119, or TAPPI standard method T479.

With respect to the matt degree of the back layer, the Beck smoothness is preferably 10 to 1,200 seconds. The Beck smoothness is more preferably 20 to 800 seconds, more preferably 40 to 500 seconds.

In the invention, the matting agent is preferably included in the outermost layer, a layer acting as the outermost layer, or a layer near the outer surface. The layer including the matting agent is preferably a protective layer of the photosensitive material.

5) Polymer Latex

When the photothermographic material of the invention is used for printing with requiring dimensional accuracy, the surface protective layer and the back layer preferably include a polymer latex. The polymer latex is described in *Gosei Jushi Emarujon*, edited by Taira Okuda and Hiroshi Inagaki, Kobunshi Kanko Kai (1978); *Gosei Ratekkusu no Oyo*, edited by Takaaki Sugimura, Yasuo Kataoka, Souichi Suzuki and Keishi Kasahara, Kobunshi Kanko Kai (1993); Soichi Muroi, *Gosei Ratekkusu no Kagaku*, Kobunshi Kanko Kai (1970); etc. Specific examples of the polymer latexes include a latex of a methyl methacrylate (33.5% by mass)/ethyl acrylate (50% by mass)/methacrylic acid (16.5% by mass) copolymer; a latex of methyl methacrylate (47.5% by mass)/butadiene (47.5% by mass)/itaconic acid (5% by mass) copolymer; a latex of an ethyl acrylate/methacrylic acid copolymer; a latex of a methyl methacrylate (58.9% by mass)/2-ethylhexyl acrylate (25.4% by mass)/styrene (8.6% by mass)/2-hydroxyethyl methacrylate (5.1% by mass)/acrylic acid (2.0% by mass) copolymer; and a latex of a methyl methacrylate (64.0% by mass)/styrene (9.0% by mass)/butyl acrylate (20.0% by mass)/2 -hydroxyethyl methacrylate (5.0% by mass)/acrylic acid (2.0% by mass) copolymer. In the invention, the combinations of the polymer latexes described in JP-A No. 2000-267226, and the technologies described in JP-A No. 2000-267226, paragraphs 0021 to 0025, JP-A No. 2000-267226, paragraphs 0027 and 0028, and JP-A No. 2000-19678, paragraphs 0023 to 0041 may be used for the binder for the surface protective layer. The mass ratio of the polymer latex to the total of the binders in the surface protective layer is preferably 10 to 90% by mass, particularly preferably 20 to 80% by mass.

6) Surface pH

The photothermographic material of the invention preferably has a surface pH of 7.0 or lower before the heat development. The surface pH is more preferably 6.6 or lower. The lower limit of the surface pH is approximately 3, though it is not particularly restricted. The surface pH is most preferably 4 to 6.2. The surface pH is preferably controlled by using a non-volatile acid such as an organic acid (e.g. a phthalic acid derivative) and sulfuric acid, or a volatile base such as ammonia, from the viewpoint of reducing the surface pH. Ammonia is particularly preferably used to obtain the low surface pH because ammonia can be easily volatilized and removed in the application step or before the heat development. Also preferably, ammonia may be used with a non-volatile base such as sodium hydroxide, potassium hydroxide, or lithium hydroxide. The methods for measuring the surface pH are described in JP-A No. 2000-284399, paragraph 0123.

7) Hardening Agent

A hardening agent may be included in the layers such as the photosensitive layer, the protective layer, and the back layers. Examples of the hardening agents are described in T. H. James, *The Theory of the Photographic Process, Fourth Edition*, pages 77 to 87, Macmillan Publishing Co., Inc., 1977. Specific examples of preferred hardening agents include chromium alum; 2,4-dichloro-6-hydroxy-s-triazine sodium salt; N,N-ethylenebis(vinylsulfonacetamide); N,N-propylene bis(vinylsulfonacetamide); the polyvalent metal ions described in page 78 of the above reference; the polyisocyanates described in U.S. Pat. No. 4,281,060, JP-A No. 6-208193; the epoxy compounds described in U.S. Pat. No. 4,791,042; and the vinylsulfone compounds described in JP-A No. 62-89048.

The hardening agent is added in a form of a solution, and the solution is added to the coating solution for the protective layer preferably during the period of from 180 minutes before the application of the coating solution to immediately before the application of the coating solution, more preferably during the period of from 60 minutes before the application to 10 seconds before the application. The method and conditions of mixing the hardening agent are not particularly limited as long as the advantageous effects of the invention can be sufficiently obtained. Specific examples of the mixing methods include methods of mixing the hardening agent in a tank so that the average residence time calculated from the addition flow rate and the feeding amount to a coater is a desired time, methods using a static mixer and the like described in N. Harnby, M. F. Edwards, and A. W. Nienow, translated by Koji Takahashi, *Ekitai Kongo Gijutsu*, Chapter 8, Nikkan Kogyo Shimbun, Ltd., 1989, etc.

8) Surfactant

Surfactants usable in the invention are described in JP-A No.11-65021, paragraph 0132, solvents are described in ibid, paragraph 0133, supports are described in ibid, paragraph 0134, antistatic layers and electrically conducting layers are described in ibid, paragraph 0135, methods for forming color images are described in ibid, paragraph 0136, and sliding agents are described in JP-A No. 11-84573, paragraphs 0061 to 0064 and JP-A No. 2001-083679, paragraphs 0053 to 0065.

Fluorine-containing surfactants are preferably used in the invention. Specific examples of the fluorine-containing surfactants include compounds described in JP-A Nos. 10-197985, 2000-19680, and 2000-214554. Further, fluorine-containing polymer surfactants described in JP-A No. 9-281636 are also preferably used in the invention. The fluorine-containing surfactants described in JP-A No. 2002-82411, 2003-057780, and 2003-149766 are preferably used in the photothermographic materials of the invention. In the case of using an aqueous coating solution, the fluorine-containing surfactants described in JP-A Nos. 2003-057780 and 2003-149766 are particularly preferred from the viewpoints of the electrification control, the stability of the applied surface, and the sliding properties. The fluorine-containing surfactants described in JP-A No. 2003-149766 are the most preferred because they are excellent in the high electrification control ability and can be used in a smaller amount.

In the invention, the fluorine-containing surfactant may be used in the emulsion layer or the back layer, preferably in both. The fluorine-containing surfactant is particularly preferably used in combination with the electrically conducting layer containing a metal oxide. In this case, sufficient performance can be achieved even if the amount of the fluorine-containing surfactant on the electrically conducting layer side is reduced or even if the fluorine-containing surfactant is not used on the electrically conducting layer side.

The amount of the fluorine-containing surfactant added onto each of the emulsion layer side and the back layer side is preferably 0.1 to 100 mg/m$^2$, more preferably 0.3 to 30 mg/m$^2$, further preferably 1 to 10 mg/m$^2$. In particular, since the fluorine-containing surfactants described in JP-A No. 2003-149766 exerts an excellent effect, its amount is preferably 0.01 to 10 mg/m$^2$, more preferably 0.1 to 5 mg/m$^2$.

9) Antistatic Agent

The photosensitive material of the invention preferably comprises an antistatic (electrically conducting) layer containing an electrically conductive material such as a metal oxide and an electrically conductive polymer. The antistatic layer may act also as the undercoat layer, the back layer, the surface protective layer, etc., or may be formed separately therefrom. The electrically conductive material for the antistatic layer is preferably a metal oxide with a high conductivity increased by introducing an oxygen defect and a different metal atom. Examples of the preferred metal oxide include ZnO, $TiO_2$, and $SnO_2$. Al or In is preferably added to ZnO. Sb, Nb, P, or a halogen atom is preferably added to $SnO_2$. Nb or Ta is preferably added to $TiO_2$. $SnO_2$ containing Sb is particularly preferred. The amount of the different atom added is preferably 0.01 to 30 mol %, more preferably 0.1 to 10 mol %. The grains of the metal oxide may be in a spherical shape, a needle shape, or a plate shape. It is preferred that the metal oxide grains are needle-shaped grains with the ratio of the major axis/the minor axis of 2.0 or more, preferably 3.0 to 50 because such grains better impart conductivity to the layer. The amount of the metal oxide is preferably 1 to 1,000 mg/m$^2$, more preferably 10 to 500 mg/m$^2$, further preferably 20 to 200 mg/m$^2$. The antistatic layer used in the invention may be provided on the emulsion surface side or the back surface side, and is preferably provided between the support and the back layer. Specific examples of the antistatic layers usable in the invention are described in JP-A No. 11-65021, paragraph 0135; JP-A Nos. 56-143430, 56-143431, 58-62646, and 56-120519; JP-A No. 11-84573, paragraphs 0040 to 0051; U.S. Pat. No. 5,575,957; and JP-A No. 11-223898, paragraphs 0078 to 0084.

10) Support

The transparent support preferably comprises a heat-treated polyester, particularly a polyethylene terephthalate each of which is subjected to a heat treatment at 130 to 185° C. to relax the internal strains remaining in the film during biaxial stretching and to eliminate the heat shrinkage strains generated during the heat development. If the photothermographic material of the invention is for medical use, the transparent support may be colored by a blue dye (e.g., Dye-1 described in Examples of JP-A No. 8-240877) or uncolored. The support preferably comprises an undercoating of, for example a water-soluble polyester described in JP-A No. 11-84574, a styrene-butadiene copolymer described in JP-A No. 10-186565, a vinylidene chloride copolymer described in JP-A No. 2000-39684 and JP-A No. 2001-083679, paragraphs 0063 to 0080. When the support is coated with the emulsion layer or the back layer, the support preferably has a moisture content of 0.5% by mass or less.

11) Other Additives

An antioxidant, a stabilizing agent, a plasticizer, a UV absorbent, or a coating auxiliary may be added to the photothermographic material of the invention. The additives may be added to the photosensitive layer or the non-photosensitive layer. The additives may be added with reference to WO 98/36322, EP 803764A1, JP-A Nos. 10-186567 and 10-18568.

12) Application Method

The photothermographic material of the invention may be formed by any application method. Specific examples of the application methods include extrusion coating methods, slide coating methods, curtain coating methods, dip coating methods, knife coating methods, flow coating methods, and the extrusion coating methods using a hopper described in U.S. Pat. No. 2,681,294. The application method is preferably the extrusion coating method described in Stephen F. Kistler and Petert M. Schweizer, *Liquid Film Coating*, CHAPMAN & HALL, 1997, pages 399 to 536, or a slide coating method. Particularly preferred application method is the slide coating method. Examples of slide coaters for the slide coating methods are described in the above reference, page 427, FIG. 11b. 1. Two or more layers may be simultaneously provided by the method described in the above reference, pages 399 to 536 or the method described in U.S. Pat. No. 2,761,791 or the method described in British Patent No. 837,095. Particularly preferred application methods used in the invention include the methods described in JP-A Nos. 2001-194748, 2002-153808, 2002-153803, and 2002-182333.

In the invention, the coating solution for the organic silver salt including layer is preferably a so-called thixotropy fluid. The thixotropy fluid may be used with reference to JP-A No. 11-52509. The viscosity of the coating solution for the organic silver salt including layer is preferably 400 to 100,000 mPa·s, more preferably 500 to 20,000 mPa·s, at a shear rate of 0.1 $S^{-1}$. Further, the viscosity of the coating solution is preferably 1 to 200 mPa·s, more preferably 5 to 80 mPa·s, at a shear rate of 1,000 $S^{-1}$.

In the preparation of the coating solution, if two or more liquids are mixed, they are preferably mixed by a known in-line mixing apparatus or an in-plant mixing apparatus. The in-line mixing apparatus described in JP-A No. 2002-85948 and the in-plant mixing apparatus described in JP-A No. 2002-90940 can be preferably used in the invention.

The coating solution is preferably subjected to a defoaming treatment to obtain the excellent coating surface. The defoaming treatments described in JP-A No. 2002-66431 can be preferably used in the invention.

In or before the step of applying the coating solution, the charge of the support is preferably removed to prevent adhesion of dusts owing to the electrification of the support. Examples of the destaticizing method preferably used in the invention are described in JP-A No. 2002-143747.

When a non-setting type coating solution for the image-forming layer is dried, it is important to precisely control the drying air and the drying temperature. The drying methods described in detail in JP-A Nos. 2001-194749 and 2002-139814 can be preferably used in the invention.

The photothermographic material of the invention is preferably heat-treated immediately after the application and drying in order to improve the film properties. The heating temperature of the heat treatment (the film surface temperature) is preferably 60 to 100° C. The heating time is preferably 1 to 60 seconds. The film surface temperature in the heat treatment is more preferably 70 to 90° C., and the heating time is more preferably 2 to 10 seconds. Examples of the heat treatments preferably used in the invention are described in JP-A No. 2002-107872.

Further, the production methods described in JP-A Nos. 2002-156728 and 2002-182333 can be preferably used to stably produce continuously the photothermographic materials of the invention.

The photothermographic material of the invention is preferably a monosheet type material, on which an image can be formed without using another sheet such as an image-receiving material.

13) Packaging Material

The photosensitive material of the invention is preferably sealed by a packaging material having a low oxygen permeability or a low water permeability or both to prevent deterioration of the photographic properties during the storage or to improve the curling. The oxygen permeability is preferably 50 ml/atm·$m^2$·day or less at 25° C., more preferably 10 ml/atm·$m^2$·day or less, further preferably 1.0 ml/atm·$m^2$·day or less. The water permeability is preferably 10 g/atm·$m^2$·day or less, more preferably 5 g/atm·$m^2$·day or less, further preferably 1 g/atm·$m^2$·day or less.

Specific examples of the packaging materials having a low oxygen permeability or a low water transmittance or both include the materials described in JP-A Nos. 8-254793 and 2000-206653.

14) Other Usable Technologies

Other technologies usable for the photothermographic material of the invention are described in EP 803764A1, EP 883022A1, WO 98/36322, and JP-A Nos. 56-62648, 58-62644, 9-43766, 9-281637, 9-297367,9-304869,9-311405,9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2000-187298, 2000-10229, 2000-47345, 2000-206642, 2000-98530, 2000-98531, 2000-112059, 2000-112060, 2000-112104, 2000-112064, and 2000-171936.

In the multicolor photothermographic material according to the invention, each emulsion layer is generally separated from other emulsion layers by a functional or non-functional barrier layer between the photosensitive layers as described in U.S. Pat. No. 4,460,681.

The multicolor photothermographic material may comprise a combination of two layers for each color or a single layer containing all the components as described in U.S. Pat. No. 4,708,928.

2. Image Forming Method 2-1. Exposure

The photothermographic material of the invention may be a single-sided material having the image-forming layer on only one surface of the support, or a double-sided material having the image-forming layers on both surfaces of the support.

(Double-sided Photothermographic Material)

The photothermographic material of the invention may be preferably used in an image forming method in which an X-ray intensifying screen is used to record an X-ray image.

The image forming method comprises (a) disposing the photothermographic material between a couple of X-ray intensifying screens to obtain an image forming assembly, (b) placing a sample between the assembly and an X-ray source, (c) irradiating the sample with an X-ray having the energy level of 25 to 125 kVp, (d) isolating the photothermographic material from the assembly, and (e) heating the photothermographic material to 90 to 180° C.

It is preferred that, when stepwise irradiated with X-ray and heat-developed, the photothermographic material of the assembly forms an image showing a particular characteristic curve on a graph whose rectangular coordinates represent the optical density (D) and the exposure logarithm (log E) with the same unit lengths; on the particular characteristic curve, the average gamma (γ) calculated from the points at Dmin+0.1 and Dmin+0.5 is 0.5 to 0.9 and the average gamma (γ) calculated from the points at Dmin+1.2 and Dmin+1.6 is 3.2 to 4.0, Dmin representing the minimum density. By using the photothermographic material having the particular characteristic curve in X-ray photographing systems, X-ray images with excellent photographic properties can be formed; for example, the images have a wide toe portion and have high-gamma values at middle-density areas. Thus-formed images can depict the low-density portions with low X-ray transmission such as mediastinal portions and cardiac shadow, have a density suitable for visual observation at the image of lung field with high X-ray transmission, and have a good contrast.

For example, the photothermographic material capable of showing the particular characteristic curve can be easily produced by providing on each side two or more silver halide emulsion layers having different sensitivities. In particular, the upper image-forming layer preferably includes a highly sensitive emulsion and the lower layer preferably includes an emulsion with a low sensitivity and high contrast. In the case of using the image-forming layer composed of the two layers, the highly sensitive emulsion is preferably 1.5 to 20 times, more preferably 2 to 15 times, as sensitive as the emulsion with a low sensitivity. The ratio between the amounts of the emulsions may be selected depending on the sensitivities and the covering powers. In general, the ratio of the amount of the highly sensitive emulsion to the emulsion with a low sensitivity is reduced as the sensitivity difference between the emulsions increases. For example, if the emulsions have approximately the same covering power and the highly sensitive emulsion is 2 times as sensitive as the emulsion with a low sensitivity, the amount ratio of the silver in the highly sensitive emulsion to the silver in the emulsion with a low sensitivity is preferably 1/20 to 1/50.

The dyes or the combinations of dyes and mordants described in JP-A No. 2-68539, page 13, Lower left column, line 1 to page 14, Lower left column, line 9 may be used for crossover cut (the double-sided photosensitive material) or antihalation (the single-sided photosensitive material).

Fluorescent screens (radiation intensifying screens) usable in the invention are described below. The radiation intensifying screen has a basic structure comprising a support and a fluorescent layer formed on a surface of the support. In the fluorescent layer, a fluorescent material is dispersed in a binder. A transparent protection film is generally provided on the surface of the fluorescent layer in the opposite side of the support side (the surface not facing the support) to protect the fluorescent layer from chemical changes and physical impacts.

Preferable examples of the fluorescent material used in the invention include tungstate fluorescent materials such as $CaWO_4$, $MgWO_4$, and $CaWO_4$:Pb; fluorescent materials of terbium-activated sulfide of rare earth elements such as $Y_2O_2S$:Tb, $Gd_2O_2S$:Tb, $La_2O_2S$:Tb, $(Y,Gd)_2O_2S$:Tb, and $(Y,Gd)O_2S$:Tb,Tm; fluorescent materials of terbium-activated phosphate of rare earth elements such as $YPO_4$:Tb, $GdPO_4$:Tb, and $LaPO_4$:Tb; fluorescent materials of terbium-activated oxyhalide of rare earth elements such as LaOBr:Tb, LaOBr:Tb,Tm, LaOCl:Tb, LaOCl:Tb,Tm, LaOBr:Tb, GdOBr:Tb, and GdOCl:Tb; fluorecent materials of oxyhalide of thulium-activated rare earth elements such as LaOBr:Tm and LaOCl:Tm; barium sulfate fluorescent materials such as $BaSO_4$:Pb, $BaSO_4$:$Eu^{2+}$, and $(Ba,Sr)SO_4$:$Eu^{2+}$; divalent europium-activated alkaline earth metal phosphate fluorescent materials such as $(Ba_2PO_4)_2$:$Eu^{2+}$ and $(Ba_2PO_4)_2$:$Eu^{2+}$; divalent europium-activated alkaline earth metal fluorohalide fluorescent materials such as BaFCl:$Eu^{2+}$, BaFBr:$Eu^{2+}$, BaFCl:$Eu^{2+}$,Tb, BaFBr:$Eu^{2+}$,Tb, $BaF_2$.BaCl.KCl:$Eu^{2+}$, and $(Ba,Mg)F_2$.BaCl.KCl:$Eu^{2+}$; iodide fluorescent materials such as CsI:Na, CsI:Tl, NaI, and KI:Tl; sulfide fluorescent materials such as ZnS:Ag(Zn,Cd)S:Ag, (Zn,Cd)S:Cu, and (Zn,Cd)S:Cu,Al; hafnium phosphate fluorescent materials such as $HfP_2O_7$:Cu; $YTaO_4$; and fluorescent materials prepared by adding activators as fluorescent center thereto. The fluorescent material used in the invention is not limited to the examples, and may be any material that can emit a visible or near ultra violet light under irradiation.

The fluorescent screen used in the invention is preferably composed of fluorescent material grains with a gradient grain diameter structure. Particularly preferably, the fluorescent material grains having a larger grain diameter are applied to the surface protective layer side and the fluorescent material grains having a smaller grain diameter are applied to the support side. The smaller grain diameter is preferably 0.5 to 2.0 μm, and the larger grain diameter is preferably 10 to 30 μm.

(Single-sided Photothermographic Material)

The single-sided photothermographic material of the invention is particularly preferably used as an X-ray photosensitive material for mammogram.

In the single-sided photothermographic material for mammogram, it is important to control the contrast of the image within an appropriate range.

Preferred constitutions of the X-ray photosensitive materials for mammogram may be selected with reference to JP-A Nos. 5-45807, 10-62881, 10-54900, and 11-109564.

(Combination with Ultraviolet Fluorescent Screen)

The photothermographic material of the invention is preferably used to form an image in combination with a fluorescent material having a main peak at 400 nm or less, more preferably 380 nm at less. Both of the double-sided material and the single-sided material can be combined with the fluorescent material to form an assembly. Examples of the screens with a main peak of 400 nm or less include the screens described in JP-A No. 6-11804 and WO 93/01521. Of course, screens other than those screens can also be used. Technologies described in JP-A No. 8-76307 can be used for crossover cut (the double-sided photosensitive material) and antihalation (the single-sided photosensitive material) of ultraviolet ray. The ultraviolet-absorbing dye is particularly preferably selected from the dyes described in JP-A No. 2001-144030.

2-2. Heat Development

The photothermographic material of the invention may be developed in any way. Generally, the photothermographic material is exposed imagewise and then heat-developed. The development temperature is preferably 80 to 250° C., more preferably 100 to 140° C.

The development time is preferably 1 to 60 seconds, more preferably 5 to 30 seconds, further preferably 5 to 20 seconds.

The heat development is preferably carried out with a plate heater. The heat development method of using a heat development apparatus with a plate heater described in JP-A No. 11-133572 is preferably used in the invention. The heat development apparatus comprises a heat development portion. The visible image is obtained by contacting a photothermographic material which carries a latent image thereon with a heating unit in the heat development portion. In the heat development apparatus, the heating unit comprises a plate heater, a plurality of press rollers facing each other which are arranged along one surface of the plate heater. The photothermographic material is heat-developed by being passed between the press rollers and the plate heater. Preferably, the plate heater is divided into two to six stages and the temperature of the tip portion is lowered by approximately 1 to 10° C.

Such a method is described also in JP-A No. 54-30032. In the method, moisture and an organic solvent contained in the photothermographic material can be removed, and deformation of the support due to rapid heating can be prevented.

2-3. System

Fuji Medical Dry Imager FM-DPL is a laser imager for medical use comprising an exposure portion and a heat development portion. FM-DPL is described in *Fuji Medical Review*, No. 8, pages 39 to 55, and the technologies thereof can be applied to the invention. The photothermographic material of the invention can be used for the laser imager in AD Network proposed by Fuji Medical as a network system according to DICOM Standards.

3. Use of Photothermographic Material

The photothermographic material using a high silver iodide emulsion according to the invention preferably forms a black and white image of silver, and is preferably used for medical diagnoses, industrial photographs, printings, or COM.

EXAMPLES

The present invention will be described below with reference to Examples. However, the scope of the invention is by no means limited to the examples.

Example 1

1. Preparation of PET Support and Undercoating 1-1. Film Formation

A PET having the intrinsic viscosity IV of 0.66 (measured in a mixture of phenol/tetrachloroethane=6/4 (weight ratio) at 25° C.) was prepared from terephthalic acid and ethylene glycol by a common procedure. The PET was converted into a pellet, dried at 130° C. for 4 hours, and colored blue with a blue dye 1,4-bis(2,6-diethylanilinoanthraquinone. The colored PET was extruded from a T-die and rapidly cooled to prepare an unstretched film.

The film was stretched 3.3 times in the longitudinal direction at 110° C. by rollers with different peripheral speeds, and then stretched 4.5 times in the horizontal direction at 130° C. by a tenter. The film was subjected to thermal fixation at 240° C. for 20 seconds, and relaxed by 4% in the horizontal direction at 240° C. Then, the chuck of the tenter was slit, the both ends of the film were knurled, and the film was rolled up into 4 kg/cm$^2$, to obtain a roll having the thickness of 175 μm.

1-2. Surface Corona Treatment

Both surfaces of the support were treated at the room temperature at 20 m/minute with a solid state corona treatment machine Model 6 KVA manufactured by Piller Inc. The electric current and voltage were read during the treatment, whereby it was found that the support was treated under the condition of 0.375 kV·A·minute/m$^2$. The discharging frequency of the treatment was 9.6 kHz, and the gap clearance between the electrode and the dielectric roll was 1.6 mm.

1-3. Preparation of Undercoated Support

1) Preparation of Coating Solution for Undercoat Layer

| | |
|---|---|
| 30% by mass solution of Pesresin A-520 available from Takamatsu Oil & Fat Co., Ltd. | 46.8 g |
| Vylonal MD-1200 available from Toyobo Co., Ltd. | 10.4 g |
| 1% by mass solution of polyethylene glycol monononyl phenyl ether having the average ethylene oxide number of 8.5 | 11.0 g |
| MP-1000 (fine PMMA polymer grains, average grain diameter 0.4 μm) available from Soken Chemical & Engineering Co., Ltd. | 0.91 g |
| Distilled water | 931 ml |

After subjecting the both surfaces of the biaxially stretched polyethylene terephthalate support having the thickness of 175 μm to the corona treatment, the coating solution having the above composition (1) was applied to the support by a wire bar in the wet amount of 6.6 ml/m$^2$ per one surface. The coating solution applied to the both surfaces was dried at 180° C. for 5 minutes to prepare an undercoated support.

2. Preparation of Coating Materials

1) Silver Halide Emulsion (Preparation of Silver Halide Emulsion A)

7.5 ml of a 1% by mass potassium iodide solution was added to 1421 ml of distilled water, and 36.5 g of phthalated gelatin and 150 ml of a 5% by mass methanol solution of 2,2'-(ethylenedithio)diethanol were further added thereto. The resulting solution was stirred in a stainless reaction pot while keeping the solution temperature at 78° C., and to the solution was added a solution A prepared by diluting 22.22 g of silver nitrate with distilled water into 218 ml and a solution B prepared by diluting 36.6 g of potassium iodide with distilled water into 366 ml. The solution A was added over 20 minutes at a constant flow rate, and the solution B was added by a controlled double jet method while adjusting the pAg value to 10.2. Then, 10 ml of a 3.5% by mass aqueous hydrogen peroxide solution was added to the resultant mixture, and 8.8 ml of a 10% by mass aqueous benzimidazole solution was further added. Further, a solution C prepared by diluting 51.86 g of silver nitrate with distilled water into 508.2 ml and a solution D prepared by diluting 63.9 g of potassium iodide with distilled water into 639 ml were added to the mixture. The solution C was added over 80 minutes at a constant flow rate, and the solution D was added by a controlled double jet method while adjusting the pAg value to 10.2. 10 minutes after starting the addition of the solutions C and D, potassium hexachloroiridate (III) was added to the mixture so that the amount thereof was $1\times10^{-4}$ mol per 1 mol of silver. Further, 5 seconds after completing the addition of the solution C, an aqueous solution of potassium iron (II) hexacyanide was added to the mixture so that the amount of potassium iron (II) hexacyanide was $3\times10^{-4}$ mol per 1 mol of silver. The pH value of the resulting mixture was adjusted to 3.8 with a 0.5 mol/L sulfuric acid, the stirring was stopped, and the mixture was subjected to precipitation, desalination, and water-rinsing. The pH value of the mixture was adjusted to 5.9 with 1 mol/L sodium hydroxide to prepare a silver halide dispersion with the pAg of 11.0.

The silver halide emulsion A was a pure silver iodide emulsion, and 80% or more of the projected area of the silver halide grains was occupied by tabular grains having the average projected area diameter of 0.79 μm, the variation coefficient of the average projected area diameter of 14.7%, the average thickness of 0.080 μm, and the average aspect ratio of 9.9. The average sphere-equivalent diameter was 0.42 μm. As a result of analyzing the emulsion by powder X-ray diffraction, it was clear that 90% or more of the silver iodide grains were present in γ-phase.

(Preparation of Silver Halide Emulsion B)

1 mol of the tabular AgI grain emulsion of the silver halide emulsion A prepared above was added to a reaction vessel. The pAg value of the emulsion was 10.2 at 38° C. Then, a 0.5 mol/L KBr solution and a 0.5 mol/L $AgNO_3$ solution were added to the emulsion at 10 ml/minute over 20 minutes by a double jet method, whereby substantially 10 mol % of silver bromide was epitaxially precipitated on the AgI host emulsion. In the procedures, the pAg value of the emulsion was kept at 10.2.

The pH value of the resulting mixture was adjusted to 3.8 with 0.5 mol/L sulfuric acid, the stirring was stopped, and the mixture was subjected to precipitation, desalination, and water-rinsing. The pH value of the mixture was adjusted to 5.9 with 1 mol/L sodium hydroxide to prepare a silver halide dispersion with a pAg of 11.0.

The silver halide dispersion was stirred while keeping the temperature at 38° C., 5 ml of a 0.34% by mass methanol solution of 1,2-benzoisothiazoline-3-one was added to the dispersion, and the resulting mixture was heated to 47° C. at 40 minutes after the addition. 20 minutes after the heating, a methanol solution of sodium benzenethiosulfonate was added to the mixture so that the amount of sodium benzenethiosulfonate was $7.6\times10^{-5}$ mol per 1 mol of silver. Further, 5 minutes after the addition of sodium benzenethiosulfonate, a methanol solution of a tellurium sensitizer C was added to the mixture so that the amount of the tellurium sensitizer C was $2.9\times10^{-5}$ mol per 1 mol of silver, and the mixture was ripened for 91 minutes. Then, 1.3 ml of a 0.8% by mass methanol solution of N,N'-dihydroxy-N",N"-diethylmelamine was added to the mixture, and 4 minutes after the addition, a methanol solution of 5-methyl-2-mercaptobenzimidazole, a methanol solution of 1-phenyl-2-heptyl-5-mercapto-1,3,4-triazole, and an aqueous solution of 1-(3-methylureidophenyl)-5-mercaptotetrazole were added to the mixture to prepare a silver halide emulsion B. The amounts of 5-methyl-2-mercaptobenzimidazole, 1-phenyl-2-heptyl-5-mercapto-1,3,4-triazole, and 1-(3-methylureidophenyl)-5-mercaptotetrazole were $4.8\times10^{-3}$ mol, $5.4\times10^{-3}$ mol, and $8.5\times10^{-3}$ mol per 1 mol of silver, respectively.

(Preparation of Silver Halide Emulsion C)

A silver halide emulsion C was prepared in the same manner as the silver halide emulsion A except for changing the amount of the 5% by mass methanol solution of 2,2'-(ethylenedithio)diethanol, the temperature in the grain formation step, and the time for adding the solution A. The silver halide emulsion C was a pure silver iodide emulsion, and 80% or more of the projected area of the silver halide grains was occupied by tabular grains having the average projected area diameter of 1.55 μm, the variation coefficient of the average projected area diameter of 19.9%, the average thickness of 0.103 μm, and the average aspect ratio of 15.4. The sphere-equivalent diameter was 0.71 μm. As a result of analyzing the emulsion by powder X-ray diffraction, it was clear that 90% or more of the silver iodide grains were present in γ-phase.

(Preparation of Silver Halide Emulsion D)

A silver halide emulsion D having 10 mol % of the silver bromide epitaxial portions was prepared in the same manner as the silver halide emulsion B except for using the silver halide emulsion C.

<<Preparation of Mixed Emulsion for Coating Solution>>

The silver halide emulsion B and the silver halide emulsion D were mixed at 40° C. so that the silver mol ratio of the emulsion B to the emulsion D was 5/1, and a 1% by mass aqueous solution of benzothiazolium iodide was added to the mixed emulsion so that the amount of benzothiazolium iodide was $7\times10^{-3}$ mol per 1 mol of silver.

The mixed emulsion was divided into 12 parts, and Comparative compound 1, Comparative compound 2, Comparative compound 3, or a compound according to the invention was added to each mixed emulsion and stirred for 20 minutes. The amount of each added compound was $1\times10^{-3}$ mol per 1 mol of silver. The compounds added to 12 mixed emulsions were shown in Table 1.

Then, water was added to each of the mixed emulsions so that the silver content of the silver halide was 15.6 g per 1 L of the resulting mixed emulsion for coating solution.

2) Preparation of Fatty Acid Silver Salt Dispersion

<Preparation of Recrystallized Behenic Acid>

100 kg of behenic acid Edenor C22–85R (trade name, available from Henkel) was mixed with 1200 kg of isopropyl alcohol, dissolved therein at 50° C., filtered by using a 10 μm filter, and cooled to 30° C. to recrystallize the behenic acid. The cooling rate for the recrystallization was controlled at 3° C./hour. The prepared crystal was subjected to centrifugal filtration, washed by pouring 100 kg of isopropyl alcohol, and dried. The crystal was esterified and subjected to a GC-FID measurement, and as a result, the crystal contained 96 mol % of the behenic acid, 2 mol % of lignoceric acid, 2 mol % of arachidic acid, and 0.001 mol % of erucic acid.

<Preparation of Fatty Acid Silver Salt Dispersion>

88 kg of the recrystallized behenic acid, 422 L of distilled water, 49.2 L of a 5 mol/L aqueous NaOH solution, and 120 L of t-butyl alcohol were mixed and reacted at 75° C. for 1 hour while stirring to obtain a sodium behenate solution B. 206.2 L of an aqueous solution containing 40.4 kg of silver nitrate (pH 4.0) was separately prepared and maintained at 10° C. 635 L of distilled water and 30 L of t-butyl alcohol were mixed in a reaction vessel and kept at 30° C., and to the mixture were added the total amount of the sodium behenate solution and the total amount of the aqueous silver nitrate solution at a constant flow rate while sufficiently stirring respectively. The sodium behenate solution was added to the mixture over 93 minutes 15 seconds, and the aqueous silver nitrate solution was added over 90 minutes. Only the aqueous silver nitrate solution was added for 11 minutes, then the addition of the sodium behenate solution was started, and only the sodium behenate solution was added for 14 minutes 15 seconds after completing the addition of the aqueous silver nitrate solution. The interior temperature of the reaction vessel was controlled at 30° C. during the addition of the solutions. The adding system for the sodium behenate solution had double pipes and a nozzle, and the temperature of the solution was maintained by circulating hot water in the space between the double pipes so that the temperature of the solution is controlled at 75° C. at the opening of the nozzle. The adding system for the aqueous silver nitrate solution had double pipes, and the temperature of the solution was maintained by circulating cold water in the space between the double pipes. The nozzle for the silver behenate solution and the nozzle for the aqueous silver nitrate solution were symmetrically positioned with respect to the stirring shaft so that the nozzles did not come into contact with the reaction mixture.

After adding the silver behenate solution, the resulting mixture was stirred at the temperature for 20 minutes, heated to 35° C. over 30 minutes, and ripened for 210 minutes. Immediately after the ripening, the solid contents were isolated by centrifugal filtration and water-rinsed until the electric conductivity of the filtrate water became 30 μS/cm to prepare a fatty acid silver salt. Thus-obtained fatty acid silver salt was stored in the form of a wet cake without drying.

The shape of the resultant silver behenate grains was evaluated by electron microphotography. As a result, the silver behenate grains were crystals having the average a of 0.21 μm, the average b of 0.4 μm, the average c of 0.4 μm, the average aspect ratio of 2.1, and the equivalent sphere diameter variation coefficient of 11%. The values a, b, and c had the same meanings as described above.

19.3 kg of polyvinyl alcohol PVA-217 (trade name) and water were added to the wet cake so that the total amount of the mixture became 1000 kg, the amount of the wet cake corresponding to a dry solid content of 260 kg. The resultant mixture was converted into a slurry by a dissolver, and pre-dispersed by a pipeline mixer PM-10 available from Mizuho Industrial Co., Ltd.

Then, the pre-dispersed liquid was subjected to a dispersing treatment three times to obtain a silver behenate dispersion. In the dispersing treatment, Microfluidizer M-610 (trade name, available from Microfluidex International Corporation) using a Z-type interaction chamber was used as a dispersion apparatus and the dispersing pressure was controlled at 1150 kg/cm$^2$. Coiled heat exchangers were disposed in front and rear of the interaction chamber to control the temperature of the refrigerant, whereby the dispersing temperature was adjusted at 18° C.

3) Preparation of Reducing Agent Dispersion

<<Preparation of Reducing Agent-1 Dispersion>>

10 kg of water was added to 10 kg of the reducing agent-1 (2,2'-methylene bis(4-ethyl-6-tert-butylphenol)) and 16 kg of a 10% by mass aqueous solution of a modified polyvinyl alcohol POVAL MP203 available from Kuraray Co., Ltd., and sufficiently mixed to obtain a slurry. The slurry was transported by a diaphragm pump to a horizontal-type sand mill UVM-2 manufactured by Imex Co. which was packed with zirconia beads having the average diameter of 0.5 mm, and dispersed therein for 3 hours. Then, 0.2 g of benzoisothiazolinone sodium salt and water were added to the dispersed slurry so that the content of the reducing agent was 25% by mass. Thus-obtained dispersion liquid was heat-treated at 60° C. for 5 hours to obtain a reducing agent-1 dispersion. The reducing agent-1 dispersion contained reducing agent grains having the median size of 0.40 μm and the maximum grain size of 1.4 μm or less. The reducing agent-1 dispersion was filtrated by a polypropylene filter having the pore diameter of 3.0 μm to remove extraneous substances such as dust, and then stored.

<<Preparation of Reducing Agent-2 Dispersion>>

10 kg of water was added to 10 kg of the reducing agent-2 (6,6'-di-t-butyl-4,4'-dimethyl-2,2'-butylidenediphenol) and 16 kg of a 10% by mass aqueous solution of a modified polyvinyl alcohol POVAL MP203 available from Kuraray Co., Ltd., and sufficiently mixed to obtain a slurry. The slurry was transported by a diaphragm pump to a horizontal-type sand mill UVM-2 manufactured by Imex Co. which was packed with zirconia beads having the average diameter of 0.5 mm, and dispersed therein for 3 hours 30 minutes. Then, 0.2 g of benzoisothiazolinone sodium salt and water were added to the dispersed slurry so that the content of the reducing agent was 25% by mass. Thus-obtained dispersion liquid was heated at 40° C. for 1 hour, and heat-treated at 80° C. for 1 hour to obtain a reducing agent-2 dispersion. The reducing agent-2 dispersion contained reducing agent grains having the median size of 0.50 μm and the maximum grain size of 1.6 μm or less. The reducing agent-2 dispersion was filtrated by a polypropylene filter having the pore diameter of 3.0 μm to remove extraneous substances such as dust, and then stored.

4) Preparation of Hydrogen Bonding Compound Dispersion 10 kg of water was added to 10 kg of the hydrogen bonding compound-1 (tri(4-t-butylphenyl)phosphine oxide) and 16 kg of a 10% by mass aqueous solution of a modified polyvinyl alcohol POVAL MP203 available from Kuraray Co., Ltd., and sufficiently mixed to obtain a slurry. The slurry was transported by a diaphragm pump to a horizontal-type sand mill UVM-2 manufactured by Imex Co. which was packed with zirconia beads having the average diameter of 0.5 mm, and dispersed therein for 4 hours. Then, 0.2 g of benzoisothiazolinone sodium salt and water were added to the dispersed slurry so that the content of the hydrogen bonding compound was 25% by mass. Thus-obtained dispersion liquid was heated at 40° C. for 1 hour, and further heated at 80° C. for 1 hour to obtain a hydrogen bonding compound-1 dispersion. The hydrogen bonding compound-1 dispersion contained hydrogen bonding compound grains having the median size of 0.45 μm and the maximum grain size of 1.3 μm or less. The hydrogen bonding compound-1 dispersion was filtrated by a polypropylene filter having the pore diameter of 3.0 μm to remove extraneous substances such as dust, and then stored.

5) Preparation of Development Accelerator Dispersion and Color-controlling Agent Dispersion (Preparation of Development Accelerator-1 Dispersion)

10 kg of water was added to 10 kg of the development accelerator-1 and 20 kg of a 10% by mass aqueous solution of a modified polyvinyl alcohol POVAL MP203 available from Kuraray Co., Ltd., and sufficiently mixed to obtain a slurry. The slurry was transported by a diaphragm pump to a horizontal-type sand mill UVM-2 manufactured by Imex Co. which was packed with zirconia beads having the average diameter of 0.5 mm, and dispersed therein for 3 hours 30 minutes. Then, 0.2 g of benzoisothiazolinone sodium salt and water were added to the dispersed slurry so that the content of the development accelerator was 20% by mass, to obtain a development accelerator-1 dispersion. The development accelerator-1 dispersion contained development accelerator grains having the median size of 0.48 μm and the maximum grain size of 1.4 μm or less. The development accelerator-1 dispersion was filtrated by a polypropylene filter having the pore diameter of 3.0 μm to remove extraneous substances such as dust, and then stored.

(Preparation of Solid Development Accelerator-2 Dispersion and Solid Color-controlling Agent-1 Dispersion)

A 20% by mass solid development accelerator-2 dispersion and a 15% by mass solid color-controlling agent-1 dispersion were prepared in the manner as the development accelerator-1 dispersion.

6) Preparation of Polyhalogen Compound Dispersion

<<Preparation of Organic Polyhalogen Compound-1 Dispersion>>

10 kg of the organic polyhalogen compound-1 (tribromomethanesulfonylbenzene), 10 kg of a 20% by mass aqueous solution of a modified polyvinyl alcohol POVAL MP203 available from Kuraray Co., Ltd., 0.4 kg of a 20% by mass aqueous solution of sodium triisopropylnaphthalenesulfonate, and 14 kg of water were sufficiently mixed to obtain a slurry. The slurry was transported by a diaphragm pump to a horizontal-type sand mill UVM-2 manufactured by Imex Co. which was packed with zirconia beads having the average diameter of 0.5 mm, and dispersed therein for 5 hours. Then, 0.2 g of benzoisothiazolinone sodium salt and water were added to the dispersed slurry so that the content of the organic polyhalogen compound was 30% by mass, to obtain an organic polyhalogen compound-1 dispersion. The organic polyhalogen compound-1 dispersion contained organic polyhalogen compound grains having the median size of 0.41 μm and the maximum grain size of 2.0 μm or less. The organic polyhalogen compound-1 dispersion was filtrated by a polypropylene filter having the pore diameter of 10.0 μm to remove extraneous substances such as dust, and then stored.

<<Preparation of Organic Polyhalogen Compound-2 Dispersion>>

10 kg of the organic polyhalogen compound-2 (N-butyl-3-tribromomethanesulfonylbenzoamide), 20 kg of a 10% by mass aqueous solution of a modified polyvinyl alcohol POVAL MP203 available from Kuraray Co., Ltd., and 0.4 kg of a 20% by mass aqueous solution of sodium triisopropylnaphthalenesulfonate were sufficiently mixed to obtain a slurry. The slurry was transported by a diaphragm pump to a horizontal-type sand mill UVM-2 manufactured by Imex Co. which was packed with zirconia beads having the average diameter of 0.5 mm, and dispersed therein for 5 hours. Then, 0.2 g of benzoisothiazolinone sodium salt and water were added to the dispersed slurry so that the content of the organic polyhalogen compound was 30% by mass. Thus-obtained dispersion liquid was heated at 40° C. for 5 hours to obtain an organic polyhalogen compound-2 dispersion. The organic polyhalogen compound-2 dispersion contained organic polyhalogen compound grains having the median size of 0.40 μm and the maximum grain size of 1.3 μm or less. The organic polyhalogen compound-2 dispersion was filtrated by a polypropylene filter having the pore diameter of 3.0 μm to remove extraneous substances such as dust, and then stored.

7) Preparation of Silver-iodide-complex Forming Agent 8 kg of a modified polyvinyl alcohol MP203 was dissolved in 174.57 kg of water, and 3.15 kg of a 20% by mass aqueous solution of sodium triisopropylnaphthalenesulfonate and 14.28 kg of a 70% by mass aqueous solution of 6-isopropyl phthalazine were added thereto, to prepare a 5% by mass solution of a silver-iodide-complex forming agent.

8) Preparation of Mercapto Compound

<<Preparation of Aqueous Mercapto Compound-1 Solution>>

7 g of the mercapto compound-1 (1-(3-sulfophenyl)-5-mercaptotetrazole sodium salt) was dissolved in 993 g of water to obtain a 0.7% by mass aqueous solution of the mercapto compound-1.

<<Preparation of Aqueous Mercapto Compound-2 Solution>>

20 g of the mercapto compound-2 (1-(3-methylureidophenyl)-5-mercaptotetrazole) was dissolved in 980 g of water to obtain a 2.0% by mass aqueous solution of the mercapto compound-2.

9) Preparation of SBR Latex Liquid

An SBR latex was prepared as follows. 287 g of distilled water, 7.73 g of a surfactant PIONINE A-43-S having the solid content of 48.5% by mass available from Takemoto Oil & Fat Co., Ltd., 14.06 ml of 1 mol/L aqueous NaOH, 0.15 g of tetrasodium ethylenediaminetetraacetate, 255 g of styrene, 11.25 g of acrylic acid, and 3.0 g of tert-dodecylmercaptan were put in a polymerization kettle of a gas monomer reactor TAS-2J (trade name) manufactured by Taiatsu Techno Corporation. The polymerization kettle was closed and the contents were stirred at the stirring rate of 200 rpm. The resultant mixture was degassed by a vacuum pump, the inner atmosphere of the kettle was replaced with nitrogen gas several times, 108.75 g of 1,3-butadiene was added to the mixture, and the inner temperature was raised to 60° C. Further, a solution prepared by dissolving 1.875 g of ammonium persulfate in 50 ml of water was added to the mixture and stirred for 5 hours. The mixture was heated to 90° C. and further stirred for 3 hours, and the interior temperature was reduced to the room temperature after the reaction. The resultant mixture was treated with a 1 mol/L aqueous NaOH and $NH_4OH$ to control the pH value to 8.4 so that the mol ratio of $Na^+$ ions to $NH_4^+$ ions was 1/5.3. Then, the mixture was filtrated by a polypropylene filter having the pore diameter of 1.0 μm to remove extraneous substances such as dust, and then stored. Thus, 774.7 g of the SBR latex was obtained. As a result of measuring the halogen ion content of the SBR latex by an ion chromatography, the chloride ion content was 3 ppm. The SBR latex had the chelating agent content of 145 ppm, which was measured by a high performance liquid chromatography.

The latex had an average grain diameter of 90 nm, a Tg of 17° C., a solid content of 44% by mass, an equilibrium moisture content under the conditions of 25° C. and 60% RH of 0.6% by mass, an ionic conductivity of 4.80 mS/cm, and a pH of 8.4. With respect to the ionic conductivity, the undiluted latex liquid (44% by mass) was measured at 25° C. by an electric conductivity meter CM-30S available from DKK-TOA Co.

3. Preparation of Coating Solution

1) Preparation of Coating Solutions-1 to 12 for Image-forming Layers

The organic polyhalogen compound-1 dispersion, the organic polyhalogen compound-2 dispersion, the liquid of the SBR latex (Tg 17° C.), the reducing agent-1 dispersion, the reducing agent-2 dispersion, the hydrogen bonding compound-1 dispersion, the development accelerator-1 dispersion, the development accelerator-2 dispersion, the color-controlling agent-1 dispersion, the aqueous mercapto compound-1 solution, and the aqueous mercapto compound-2 solution were successively added to a mixture of 1000 g of the above obtained fatty acid silver salt dispersion and 276 ml of water. To the resulting mixture was further added the silver-iodide-complex forming agent. Then, each of the above silver halide mixed emulsions was added to and well mixed with the mixture to obtain coating solutions-1 to 12 immediately before the application. The amount of each mixed emulsion was determined so that the silver amount in the mixed emulsion was 0.22 mol per 1 mol of the fatty acid silver salt. Each coating solution was directly transported to a coating die and applied.

2) Preparation of Coating Solution for Intermediate Layer 27 ml of a 5% by mass aqueous solution of AEROSOL OT available from American Cyanamid Co., 135 ml of a 20% by mass aqueous solution of diammonium phthalate, and water were added to a mixture of 1000 g of polyvinyl alcohol PVA-205 available from Kuraray Co., Ltd. and 4200 ml of a 19% by mass latex liquid of a copolymer of methyl methacrylate/styrene/butyl acrylate/hydroxyethyl methacrylate/acrylic acid (copolymerization weight ratio 64/9/20/5/2) so that the total amount was 10,000 g. The pH value of the resultant mixture was adjusted to 7.5 with NaOH to obtain a coating solution for an intermediate layer. The coating solution was transported to a coating die at 9.1 ml/$m^2$.

The coating solution had the viscosity of 58 mPa·s when measured by a B-type viscometer at 40° C. (No. 1 rotor, 60 rpm).

3) Preparation of Coating Solution for First Surface Protective Layer 64 g of an inert gelatin was dissolved in water, and thereto was added 112 g of a 19.0% by mass latex liquid of a copolymer of methyl methacrylate/styrene/butyl acrylate/hydroxyethyl methacrylate/acrylic acid (copolymerization weight ratio 64/9/20/5/2), 30 ml of a 15% by mass methanol solution of phthalic acid, 23 ml of a 10% by mass aqueous solution of 4-methylphthalic acid, 28 ml of a 0.5 mol/L sulfuric acid, 5 ml of a 5% by mass aqueous solution of AEROSOL OT available from American Cyanamid Co., 0.5 g of phenoxyethanol, and 0.1 g of benzoisothiazolinone. Water was added to the resultant mixture so that the total amount was 750 g. In this way, the coating solution was obtained. The coating solution was mixed with 26 ml of a 4% by mass chromium alum by a static mixer immediately before the application, and transported to a coating die at 18.6 ml/m$^2$.

The coating solution had the viscosity of 20 mPa·s when measured by a B-type viscometer at 40° C. (No. 1 rotor, 60 rpm).

4) Preparation of Coating Solution for Second Surface Protective Layer 80 g of an inert gelatin was dissolved in water, and thereto was added 102 g of a 27.5% by mass latex liquid of a copolymer of methyl methacrylate/styrene/butyl acrylate/hydroxyethyl methacrylate/acrylic acid (copolymerization weight ratio 64/9/20/5/2), 5.4 ml of a 2% by mass solution of the fluorine-containing surfactant (F-1), 5.4 ml of a 2% by mass aqueous solution of the fluorine-containing surfactant (F-2), 23 ml of a 5% by mass solution of AEROSOL OT available from American Cyanamid Co., 4 g of fine polymethyl methacrylate grains having the average grain diameter of 0.7 μm which corresponds to 30% point on the volume-weighted average distribution, 21 g of fine polymethyl methacrylate grains having the average grain diameter of 3.6 μm and the volume-weighted average distribution of 60%, 1.6 g of 4-methylphthalic acid, 4.8 g of phthalic acid, 44 ml of 0.5 mol/L sulfuric acid, and 10 mg of benzoisothiazolinone. Water was added to the resultant mixture so that the total amount was 650 g. In this way, the coating solution was obtained. The coating solution was mixed with 445 ml of an aqueous solution containing 4% by mass of chromium alum and 0.67% by mass of phthalic acid by a static mixer immediately before the application, and transported to a coating die at 8.3 ml/m$^2$.

The coating solution had the viscosity of 19 mPa·s when measured by a B-type viscometer at 40° C. (No. 1 rotor, 60 rpm).

4. Production of Photothermographic Materials-1 to 12

The image-forming layer, the intermediate layer, the first protective layer, and the second protective layer were provided in this order on the undercoating by simultaneous multilayer coating using a slide-bead application method, whereby samples of photothermographic materials-1 to 12 were produced respectively. In the simultaneous multilayer coating, the temperature of the image-forming layer and the temperature of the intermediate layer were controlled at 31° C., the temperature of the first protective layer was controlled at 36° C., and the temperature of the second protective layer was controlled at 37° C. The total applied silver amount of the fatty acid silver salt and the silver halide in the image-forming layer was 0.821 g/m$^2$ per one surface. The coating solutions were applied to the both surfaces of the support.

In the image-forming layer, the amounts (g/m$^2$) of the compounds per one surface were as follows.

| | |
|---|---|
| Fatty acid silver salt | 2.80 |
| Polyhalogen compound-1 | 0.028 |

-continued

| | |
|---|---|
| Polyhalogen compound-2 | 0.094 |
| Silver-iodide-complex forming agent | 0.46 |
| SBR latex | 5.20 |
| Reducing agent-1 | 0.33 |
| Reducing agent-2 | 0.13 |
| Hydrogen bonding compound-1 | 0.15 |
| Development accelerator-1 | 0.005 |
| Development accelerator-2 | 0.035 |
| Color-controlling agent-1 | 0.002 |
| Mercapto compound-1 | 0.001 |
| Mercapto compound-2 | 0.003 |
| Silver halide (Ag content) | 0.146 |

The conditions for the application and drying were as follows.

The charge of the support was removed by an ionic wind before the application. The application was carried out at the rate of 160 m/min. The conditions were controlled within the following ranges to obtain the most stable surface state.

The distance between the support and the tip of the coating die was 0.10 to 0.30 mm.

The inner pressure of the decompression chamber was 196 to 882 Pa-lower than the atmospheric pressure.

The coating solution was cooled by a wind having the dry-bulb temperature of 10 to 20° C. in the chilling zone.

The coating solution was transported in a non-contact menner and dried by a helical type non-contact drying apparatus with a drying wind having the dry-bulb temperature of 23 to 45° C. and the wet-bulb temperature of 15 to 21° C.

The humidity was controlled to 40 to 60% RH at 25° C. after the drying.

The dried layer was heated to 70 to 90° C. and then cooled to 25° C.

Regarding the matt degree of the produced photothermographic materials, the Beck smoothness of the image-forming layer side was 550 seconds and the Beck smoothness of the back layer side was 130 seconds. The pH value of the surface on the image-forming layer side was 6.0.

The chemical structures of the compounds used in Example are shown below.

Tellurium sensitizer C

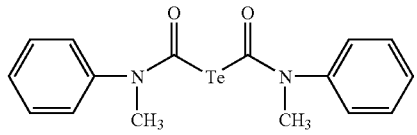

Comparative compound 1

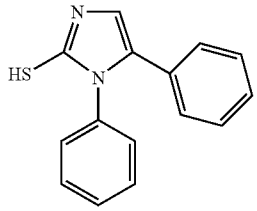

Comparative compound 2

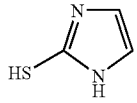

-continued
Comparative compound 3
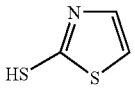
(Reducing agent-1)
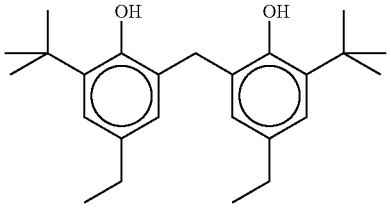
(Reducing agent-2
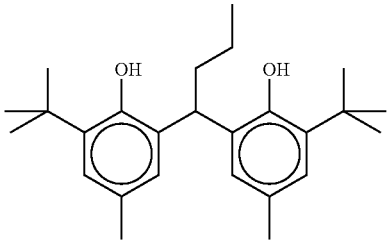
(Hydrogen bonding compound-1)
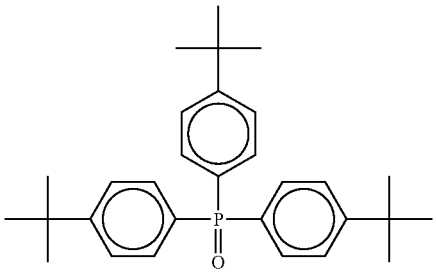
(Polyhalogen compound-1)
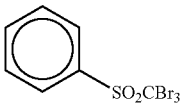
(Polyhalogen compound-2)
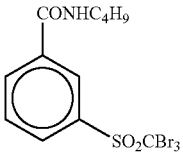
(Mercapto compound-1)
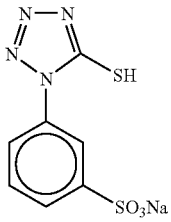
-continued
(Mercapto compound-2)
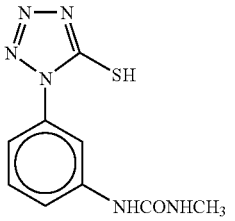
(Silver-iodide-complex forming agent)
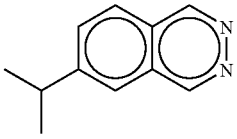
(Development accelerator-1)
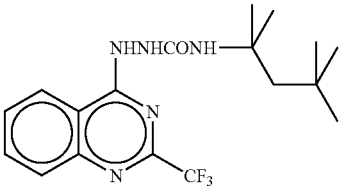
(Development accelerator-2)
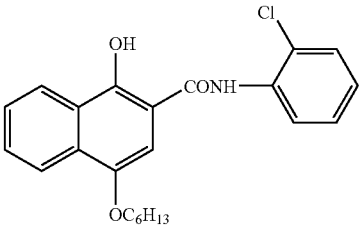
(Color-controlling agent-1)
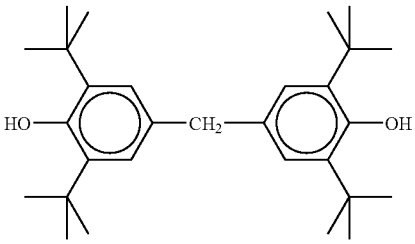
(F-1)
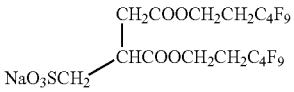
(F-2)
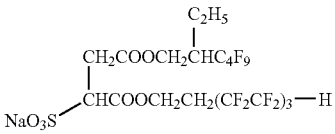

5. Evaluation of Properties

1) Preparation

The obtained samples-1 to 12 were cut into the half-size (35.6×43.2 cm), enclosed in the following packaging material under conditions of 25° C. and 40% RH, and stored at the ordinary temperature for 2 weeks, respectively. The packaged samples were further stored in different conditions to prepare two groups of the following samples.

A) Fresh samples stored at the room temperature for 16 hours.

B) Harshly stored samples stored under a hard condition at 60° C. for 16 hours.

<Packaging Material>

Structure: 10 μm of PET/12 μm of PE/9 μm of aluminum foil/15 μm of Ny/50 μm of polyethylene containing 3% by mass of carbon.

Oxygen permeability: 0.02 ml/atm·$m^2$·25° C.·day.

Water permeability: 0.10 g/atm·$m^2$·25° C.·day.

2) Exposure and Development

<Exposure>

Each sample was disposed between two X-ray regular screens (HI-SCREEN B3 available from Fuji Photo Film Co., Ltd., which used $CaWO_4$ as a fluorescent material and had the emission peak wavelength of 425 nm) to prepare an image forming assembly. The assembly was exposed to X-ray for 0.05 seconds and subjected to an X-ray sensitometry. DRX-3724HD (trade name) available from Kabushiki Kaisha Toshiba was used as an X-ray apparatus with a tungsten target. Voltage of 80 kVp was applied to the three phases by a pulse generator, and the X-ray was passed through a 7 cm filter having an absorption approximately equal to human body. The X-ray irradiation amount was changed by the distance method, and the exposure was carried out stepwise at intervals of log E=0.15.

<Development>

The heat development part of Fuji Medical Dry Laser Imager FM-DPL was modified to prepare a heat development apparatus capable of heating the both surfaces of a sample. Further, the transporting roller of the heat development part was replaced by a heat drum, whereby it became possible to transport the film sheet. The temperatures of the four panel heaters were controlled at 112° C.-118° C.-120° C.-120° C., and the temperature of the heat drum was 120° C. Further, the transporting rate was increased so that the sample could be transported in 14 seconds.

A wet-developing type regular photosensitive material RX-U available from Fuji Photo Film Co., Ltd. was exposed under the same conditions, and treated for 45 seconds with an automatic developing apparatus CEPROS-M2 and a processing liquid CE-D 1 available from Fuji Photo Film Co., Ltd.

As the result of comparing the images of the photothermographic materials of the invention with the image of the wet-developing type material, the samples of the invention had as good photographic properties as the wet-developing type material.

3) Evaluation Items (Fogging)

The fogging was the density of the unexposed portions.

(Sensitivity)

The sensitivity was the reciprocal of the exposure that gave the optical density of (the fogging+0.5). The sensitivity was shown in Table 1 as relative values to that of the sample 1.

(Pressure Resistance)

The image-forming layer surface of each of Fresh samples was scratched by a sphere stainless having the radius of 0.5 mm at the rate of 1 cm/second while applying the load of 50 g under the conditions of 25° C. and 40% RH. Then, the Fresh samples were exposed and developed in the above manner. The pressure variation width was obtained as a value of ΔD/Dmax×100 in which Dmax was the maximum density and ΔD was the density difference between the portion subjected to the load and the portion subjected to no load in the maximum density area. ΔD was a positive value when the portion subjected to the load was pressure-sensitized to have a higher density. ΔD was a negative value when the portion subjected to the load was pressure-desensitized to have a lower density. It is not preferred that the absolute value of ΔD is large in both the cases of the pressure sensitization and the pressure desensitization. The absolute value of ΔD is preferably approximately 0. The samples with the smaller absolute value are considered to be excellent in the pressure resistance.

4) Results

The results are shown in Table 1.

TABLE 1

| Sample No. | Added compound | Fogging of Fresh sample | Sensitivity of Fresh sample | Fogging of Harshly stored sample after 16 hours at 60° C. | Sensitivity of Harshly stored sample after 16 hours at 60° C. | ΔD/Dmax | Note |
|---|---|---|---|---|---|---|---|
| 1 | — | 0.2 | 100 | 0.23 | 65 | −30 | Comparative Example |
| 2 | Comparative compound 1 | 0.22 | 105 | 0.25 | 67 | −28 | Comparative Example |
| 3 | Comparative compound 2 | 0.2 | 85 | 0.24 | 70 | −27 | Comparative Example |
| 4 | Comparative compound 3 | 0.2 | 95 | 0.26 | 68 | −25 | Comparative Example |
| 5 | A-2 | 0.17 | 243 | 0.19 | 140 | −5 | The Invention |
| 6 | A-8 | 0.16 | 231 | 0.18 | 139 | −6 | The Invention |
| 7 | A-10 | 0.16 | 229 | 0.18 | 141 | −4 | The Invention |
| 8 | A-14 | 0.17 | 239 | 0.19 | 139 | −6 | The Invention |
| 9 | A-19 | 0.18 | 248 | 0.2 | 137 | −7 | The Invention |
| 10 | A-24 | 0.16 | 235 | 0.17 | 139 | −4 | The Invention |
| 11 | A-27 | 0.19 | 250 | 0.21 | 136 | −8 | The Invention |
| 12 | A-30 | 0.18 | 245 | 0.2 | 138 | −6 | The Invention |

As shown in Table 1, the samples according to the invention were highly sensitive, and unexpectedly excellent in the storage stability and the pressure resistance.

The present invention provides the silver halide emulsion, the silver halide photosensitive material, and the photothermographic material excellent in the sensitivity.

What is claimed is:

1. A silver halide emulsion comprising a silver halide and a compound represented by the following formula (1) or (2):

Formula (1)

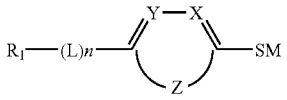

Formula (2)

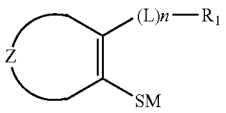

wherein in Formula (1) and Formula (2), $R_1$ represents an OH group, an SH group, or an —$NR_2R_3$ group in which $R_2$ and $R_3$ each independently represent a hydrogen atom, an alkyl group, an aryl group, a heterocyclic group, an alkylsulfonyl group, or an arylsulfonyl group; L represents an alkenylene group, an arylene group, an —N═N— group, a divalent aromatic heterocyclic group, or a —$C(R_4)$═N— group in which $R_4$ represents a hydrogen atom, an alkyl group, an aryl group, or a heterocyclic group; n represents 0 or 1; X and Y each independently represent a nitrogen atom or a —$CR_5$— group in which $R_5$ represents a hydrogen atom or a substituent that can be bonded to the carbon atom; Z represents an atomic group that is necessary for forming the ring selected from a benzene ring, a naphthalene ring, a pyridine ring, a quinoline ring, an isocquinoline ring, a pyrrole ring, a furan ring, a thiophene ring, an imidazole ring, a thiazole ring, an oxazole ring, a triazole ring, a thiadiazole ring a pyrimidine ring, and a triazine ring; and M represents a hydrogen atom, a metal ion, or a quaternary ammonium ion.

2. A silver halide emulsion according to claim 1, wherein the compound of Formula (1) or (2) is represented by the following formula (1-a):

Formula (1-a)

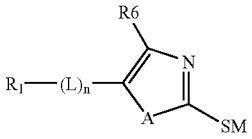

wherein in Formula (1-a), $R_1$ represents an OH group, an SH group, or an $NR_2R_3$ group in which $R_2$ and $R_3$ each independently represent a hydrogen atom, an alkyl group, an aryl group, a heterocyclic group, an alkylsulfonyl group, or an arylsulfonyl group; L represents an alkenylene group, an arylene group, an —N═N— group, a divalent aromatic heterocyclic group, or a —$C(R_4)$═N— group in which $R_4$ represents a hydrogen atom, an alkyl group, an aryl group, or a heterocyclic group; n represents 0 or 1; R6 represents a hydrogen atom or a substituent that can be bonded to the carbon atom; A represents a sulfur atom or an —$NR_7$— group in which $R_7$ represents a hydrogen atom, an alkyl group, an aryl group, or a heterocyclic group; and M represents a hydrogen atom, a metal ion, or a quaternary ammonium ion.

3. A silver halide emulsion according to claim 1, wherein the compound of Formula (1) or (2) has a group that can adsorb the silver halide.

4. A silver halide emulsion according to claim 1, wherein the compound of Formula (1) or (2) has a ballast group or a polymer moiety.

5. A silver halide photosensitive material comprising a support and the silver halide emulsion according to claim 1 provided on at least one surface of the support.

6. A silver halide photosensitive material according to claim 5, wherein the compound of Formula (1) or (2) is represented by the following formula (1-a):

Formula (1-a)

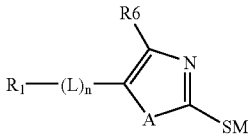

wherein in Formula (1-a), $R_1$ represents an OH group, an SH group, or an $NR_2R_3$ group in which $R_2$ and $R_3$ each independently represent a hydrogen atom, an alkyl group, an aryl group, a heterocyclic group, an alkylsulfonyl group, or an arylsulfonyl group; L represents an alkenylene group, an arylene group, an —N═N— group, a divalent aromatic heterocyclic group, or a —$C(R_4)$═N— group in which $R_4$ represents a hydrogen atom, an alkyl group, an aryl group, or a heterocyclic group; n represents 0 or 1; R6 represents a hydrogen atom or a substituent that can be bonded to the carbon atom; A represents a sulfur atom or an —$NR_7$— group in which $R_7$ represents a hydrogen atom, an alkyl group, an aryl group, or a heterocyclic group; and M represents a hydrogen atom, a metal ion, or a quaternary ammonium ion.

7. A silver halide photosensitive material according to claim 5, wherein the compound of Formula (1) or (2) has a group that can adsorb the silver halide.

8. A silver halide photosensitive material according to claim 5, wherein the compound of Formula (1) or (2) has a ballast group or a polymer moiety.

9. A silver halide photosensitive material according to claim 5, wherein the silver halide has an average silver iodide content of 40 to 100 mol %.

10. A silver halide photosensitive material according to claim 5, wherein the photosensitive silver halide comprises silver halide grains having an average sphere-equivalent diameter of 0.3 to 5.0 μm.

11. A silver halide photosensitive material according to claim 5, wherein the photosensitive silver halide comprises silver halide grains and 50% or more of a projected area of the silver halide grains is occupied by tabular grains having aspect ratios of 2 to 50.

12. A photothermographic material comprising a support and an image-forming layer provided on at least one surface of the support, wherein the image-forming layer comprises a non-photosensitive organic silver salt, a reducing agent for silver ions, a binder, and the silver halide emulsion according to claim 1.

13. A photothermographic material according to claim 12, wherein the compound is represented by the following formula (1-a):

Formula (1-a)

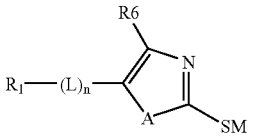

wherein in Formula (1-a), $R_1$ represents an OH group, an SH group, or an $NR_2R_3$ group in which $R_2$ and $R_3$ each independently represent a hydrogen atom, an alkyl group, an aryl group, a heterocyclic group, an alkylsulfonyl group, or an arylsulfonyl group; L represents an alkenylene group, an arylene group, an —N═N— group, a divalent aromatic heterocyclic group, or a —C($R_4$)═N— group in which $R_4$ represents a hydrogen atom, an alkyl group, an aryl group, or a heterocyclic group; n represents 0 or 1; R6 represents a hydrogen atom or a substituent that can be bonded to the carbon atom; A represents a sulfur atom or an —$NR_7$— group in which $R_7$ represents a hydrogen atom, an alkyl group, an aryl group, or a heterocyclic group; and M represents a hydrogen atom, a metal ion, or a quaternary ammonium ion.

14. A photothermographic material according to claim 12, wherein the silver halide has an average silver iodide content of 40 to 100 mol %.

15. A photothermographic material according to claim 13, wherein the silver halide has an average silver iodide content of 40 to 100 mol %.

16. A photothermographic material according to claim 12, wherein the photosensitive silver halide comprises silver halide grains having an average sphere-equivalent diameter of 0.3 to 5.0 μm.

17. A photothermographic material according to claim 13, wherein the photosensitive silver halide comprises silver halide grains having an average sphere-equivalent diameter of 0.3 to 5.0 μm.

18. A photothermographic material according to claim 12, wherein the photosensitive silver halide comprises silver halide grains and 50% or more of a projected area of the silver halide grains is occupied by tabular grains having aspect ratios of 2 to 50.

19. A photothermographic material according to claim 13, wherein the photosensitive silver halide comprises silver halide grains and 50% or more of a projected area of the silver halide grains is occupied by tabular grains having aspect ratios of 2 to 50.

* * * * *